US009725224B2

(12) United States Patent
Han

(10) Patent No.: US 9,725,224 B2
(45) Date of Patent: Aug. 8, 2017

(54) VACUUM SEALING LID FOR FOOD STORAGE CONTAINER

(71) Applicant: BARENTHAL NORTH AMERICA, INC., Whippany, NJ (US)

(72) Inventor: Hongyuan Han, New Vernon, NJ (US)

(73) Assignee: BARENTHAL NORTH AMERICA, INC., Whippany, NJ (US)

( * ) Notice: Subject to any disclaimer, the term of this patent is extended or adjusted under 35 U.S.C. 154(b) by 0 days.

(21) Appl. No.: 14/955,448

(22) Filed: Dec. 1, 2015

(65) Prior Publication Data

US 2016/0167863 A1 Jun. 16, 2016

Related U.S. Application Data

(60) Provisional application No. 62/091,084, filed on Dec. 12, 2014.

(51) Int. Cl.

| | |
|---|---|
| ***B65D 51/16*** | (2006.01) |
| ***B65D 81/20*** | (2006.01) |
| ***F04B 43/00*** | (2006.01) |
| ***B65B 31/04*** | (2006.01) |
| ***A47J 47/06*** | (2006.01) |
| ***A47J 47/10*** | (2006.01) |
| ***B65D 43/02*** | (2006.01) |

(Continued)

(52) U.S. Cl.

CPC ..... *B65D 81/2038* (2013.01); *B65D 43/02* (2013.01); *B65D 51/1644* (2013.01); *B65D 51/18* (2013.01); *B65D 53/02* (2013.01); *B65D 2251/009* (2013.01); *B65D 2251/0018* (2013.01); *B65D 2251/0028* (2013.01); *B65D 2251/0081* (2013.01)

(58) Field of Classification Search

CPC ..... F04B 43/0072; B65D 51/1644; B65D 81/2038; B65D 81/2007; B65D 81/2015; B65B 31/04; A47J 47/06; A47J 47/10

See application file for complete search history.

(56) References Cited

U.S. PATENT DOCUMENTS 2,890,810 A * 6/1959 Rohling ..... B65B 31/00 206/508
3,083,861 A * 4/1963 Amberg ..... B65D 43/0208 220/371

(Continued)

FOREIGN PATENT DOCUMENTS

DE 82 27 597 U1 11/1982
DE 94 10 760 U1 9/1994

(Continued)

*Primary Examiner* — Andrew T Kirsch
(74) *Attorney, Agent, or Firm* — Preti Flaherty Beliveau & Pachios LLP

(57) ABSTRACT

A system for enabling the efficient evacuation of air within a food container. A bellows-enabled lid fits into a respective container in an air-tight relationship. A bellows mechanism having plural resilient members and dual one-way valves provides efficient manual operation and resulting air evacuation from the container interior. A lid-mounted release valve with associated resilient member enables efficient release of vacuum conditions within the container. Plural ornamental configurations of the container with associated bellows-enabled lid are illustrated.

14 Claims, 88 Drawing Sheets

(51) Int. Cl.
*B65D 51/18* (2006.01)
*B65D 53/02* (2006.01)

(56) References Cited

U.S. PATENT DOCUMENTS

| | | | | |
|---|---|---|---|---|
| 5,406,992 | A * | 4/1995 | Miramon | A47G 19/2272 141/64 |
| 5,957,317 | A * | 9/1999 | Lee | B65D 81/2038 215/228 |
| 6,044,756 | A | 4/2000 | Chang | |
| 6,994,227 | B2 * | 2/2006 | Kwon | B65D 81/2038 116/309 |

FOREIGN PATENT DOCUMENTS

| | | |
|---|---|---|
| DE | 602 25 896 T2 | 4/2009 |
| EP | 1 447 037 A1 | 12/2006 |

* cited by examiner

VACUUM SEALING LID FOR FOOD STORAGE CONTAINER

STATEMENT REGARDING FEDERALLY SPONSORED RESEARCH OR DEVELOPMENT

N/A

BACKGROUND OF THE INVENTION

It is generally known that harvested or prepared food can be kept in a palatable, edible condition longer if stored in an enclosure that inhibits entry and/or circulation of air across the surface of the food. In a simple form, plastic containers having interference-fit lids partially achieve this goal at very low cost. Rigid containers having threads adjacent an opening for receiving a counter-threaded lid are also well known, such as glass jars having metal, threaded lids. Further still, rigid containers may be provided with sealing lids that are otherwise forced onto or clamped against the opening of the container, such as through the use of an external spring clamp or other deformable member. Yet while all such mechanisms prevent the flow of air into or out of a container, they also serve to seal a certain quantity of air within the container itself.

For many years, people have practiced the food preservation technique known as canning in which the food to be stored and the respective container are raised to an elevated temperature before an airtight lid is secured against the container opening. It is often recommended that for best results, as much of the container's interior space should be taken up by the food to be preserved, thus displacing air within the container itself. An airtight seal is thus achieved, but only through significant effort, employment of heating means such as a large water bath, racks or stands for retaining the containers within the heated bath, and scrupulously cleaned containers and lids, and use of great care and patience. While sealing the container and its contents at an elevated temperature results in a slight vacuum under the respective lid once the container and contents are cooled, the effort and logistics required are substantial and absent proper technique spoilage may still occur.

A more simple and effective technique has been identified for food storage. A lid, configured for air-tight sealing of a respective container, is provided with a hand-operated bellows mechanism for evacuating a significant amount of air from the closed container. To achieve such vacuum conditions, the bellows mechanism includes a first one-way valve for enabling air to flow out of the bellows and into the surrounding atmosphere when the bellows is compressed by manual depression of an upper contact surface. Once fully compressed and manual pressure is released, the bellows retracts upward through the force of a resilient member such as a spring. This creates a lower pressure state compared to that within the container itself. A second one-way valve associated with the bellows lid allows air from within the container to flow into the bellows until pressure is equalized. This process is repeated until the pressure within the container is lowered to a point where it is equal to that within the bellows.

Prior art bellows have typically employed a central, axially disposed spring. Such an arrangement, however, is susceptible to frictional interference between the bellows and the lid frame surrounding the bellows when an off-axis component of compressive force is non-negligible. This can be frustrating to a user who perceives a greater amount of force is required to achieve evacuation of the food container than would otherwise be required. This could lead to excessive application of force which may result in breakage of the bellows mechanism.

A further deficiency associated with prior art bellows-enabled container lids is the mechanism for releasing the vacuum state within the container. In a simplest approach, the prior art has employed a projecting member with a knob or other grippable member. The member acts as a manually actuatable valve. A user is required to grip or grasp the knob and pull against the force of the vacuum pressure until a sealing member is disengaged and air is allowed to rush into the container. Such an embodiment may also utilize a resilient member or members such as a spring surrounding the projecting member for urging the sealing member into a sealing position. In that such containers may be employed in wet or oily environments where food is being prepared, grasping such a projecting member and pulling with sufficient force to overcome the vacuum in the container may be difficult.

Alternative techniques for vacuum release have employed complex rotatable arms or levers which translate rotational movement into linear movement, including depression of a one-way valve. The complexity associated with such prior art approaches increases cost, likelihood of material failure, and potential for contamination.

What is lacking in the art is a simple bellows-enabled lid for vacuum sealing a food container, the bellows enabling easy and reliable use even with off-axis manual pressure, and having a simplified vacuum release mechanism that can be operated even in wet or oily environments.

BRIEF SUMMARY OF THE INVENTION

Disclosed is a system and method for enabling the reliable and selective vacuum sealing of a food container. A bellows-equipped container lid is configured to be snuggly received within a respective container. The lid is provided with a manually operated bellows having at least two one-way valves. In order to function even when manual pressure is applied off-axis, the bellows is provided with plural, and preferably four, resilient members such as compression coil springs disposed about a bellows pressure plate. To enable simple pressure equalization of the container interior with the surrounding atmosphere, a further one-way valve is provided in the container lid adjacent the bellows. This valve is provided with a resilient member, such as a spring, that is sufficiently resistant to compression such that it can prevent movement of the respective valve even when the food container is under vacuum. The valve is only opened once a user applies pressure to the valve member, such as by pushing a finger downward on the valve member, overcoming the resilient member resistance. The negative pressure within the container is thus released and the lid may be removed.

BRIEF DESCRIPTION OF THE SEVERAL VIEWS OF THE DRAWINGS

Embodiments of the present invention may be better understood by referring to the following description in conjunction with the accompanying drawings in which.

DETAILED DESCRIPTION OF THE INVENTION

Depicted in FIGS. 1A through 12G are various embodiments of containers with bellows-equipped lids according to the presently disclosed invention. The containers, as depicted and when viewed from above or below, may take the shape of a rectangle, circle, or square. Alternatively, while not depicted, other shapes may be utilized. The size of the container and respective lid can depend upon the intended use. The various illustrated containers are sized to hold from approximately 0.5 quarts to 3.5 quarts, though the depicted configurations can be adapted to a wide range of volumes. Dry, moist or liquid contents can be retained therein.

The container itself may be provided in one of a variety of materials, depending upon the intended application and market. The container must be of sufficient rigidity to resist deforming while under internal vacuum conditions, and to enable multiple containers to be vertically stacked, as discussed with respect to FIGS. 16A and 16B. Further, translucent or transparent materials may be desired to enable a user to visually ascertain the type and amount of contents within a container without the need to open the respective lid. However, opaque materials may be employed, such as in the case of retaining photosensitive materials. Various color tints may also be employed for aesthetic or design reasons. The container surface may be smooth and reflective, which may enable easy cleaning. However, in certain applications, a matte finish may be preferred. Various labels or artistic decorations may be applied to the outer surface thereof, and the container itself may be embossed or otherwise imprinted with decorative design or advertising information. Suitable materials for the container include plastics or metals.

Figure 1A:
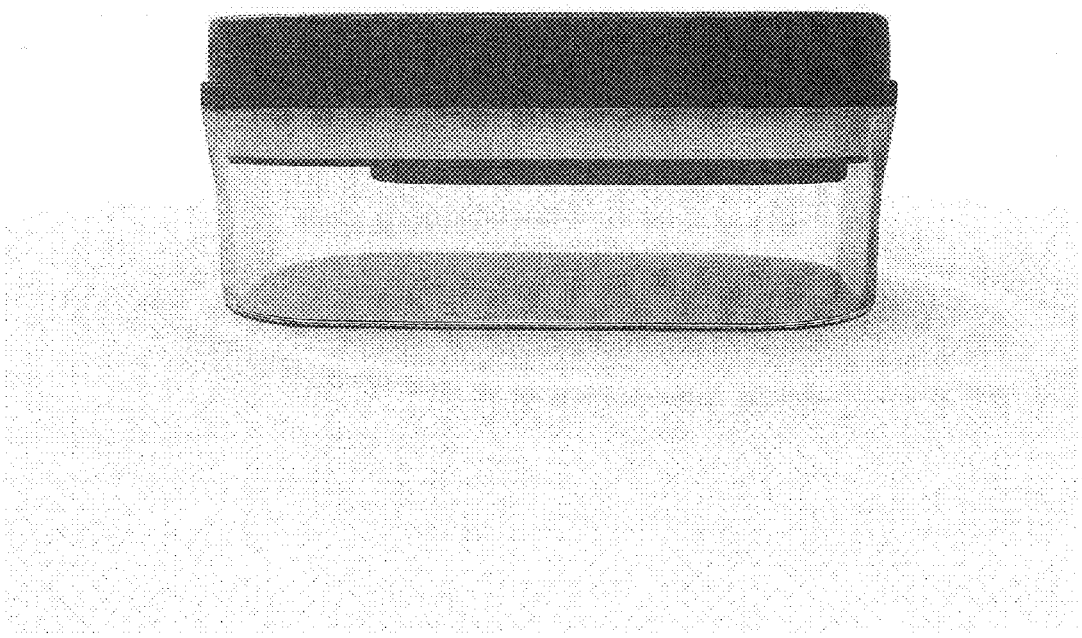
FIGS. 1A-1G illustrate a first embodiment of a rectangular container with a bellows-equipped lid according to the presently disclosed invention.
Figure 1B:
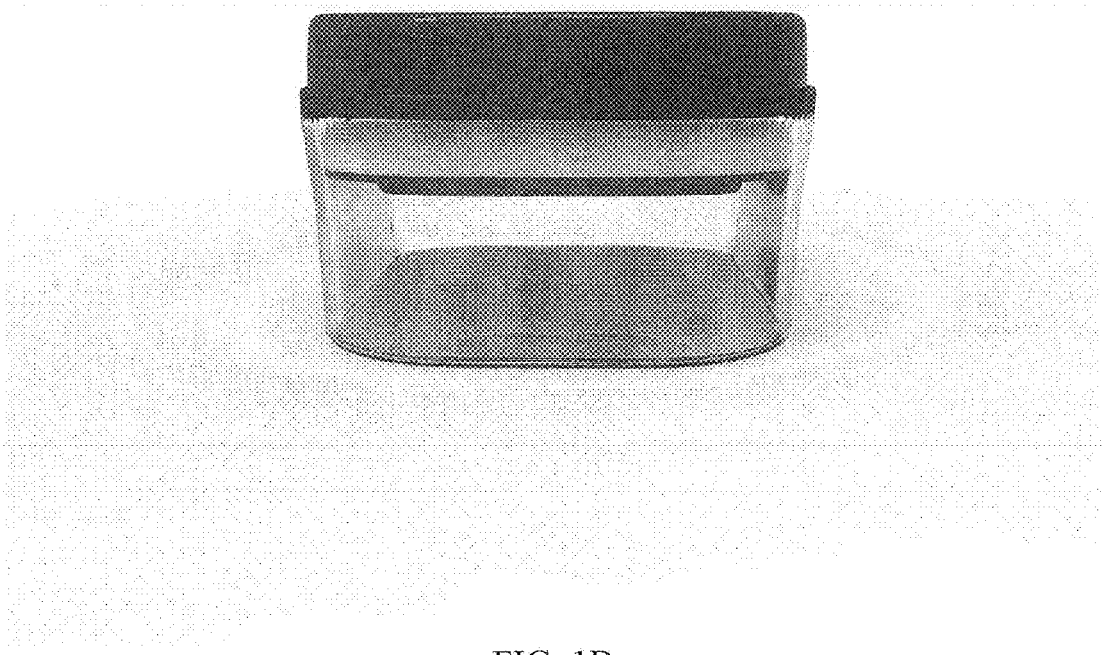
Figure 1C:
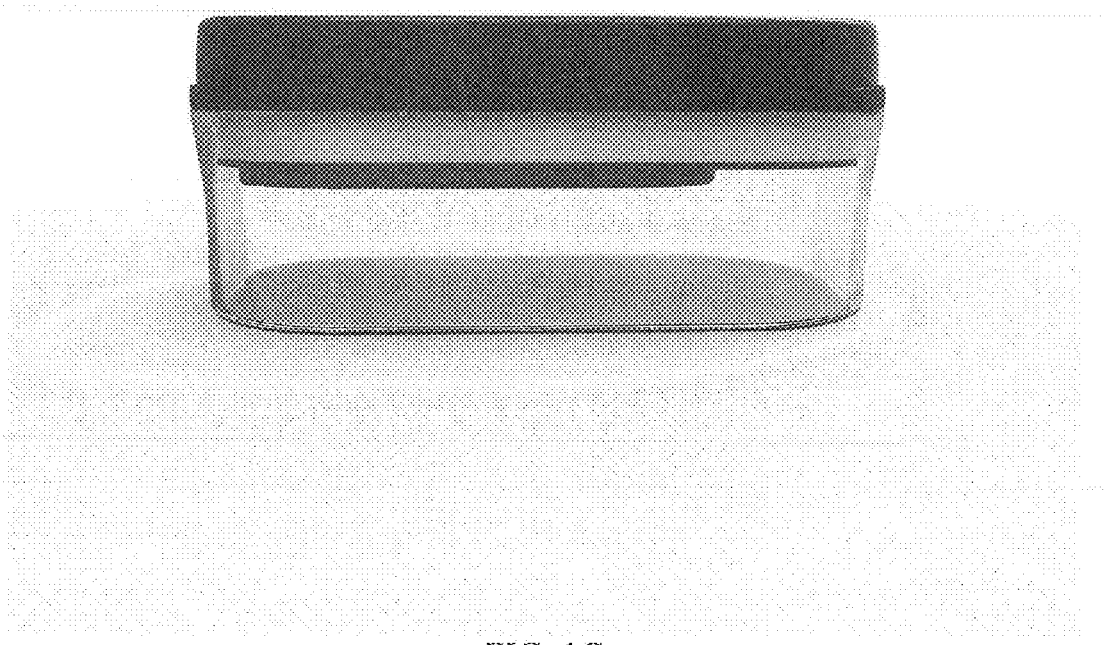
Figure 1D:
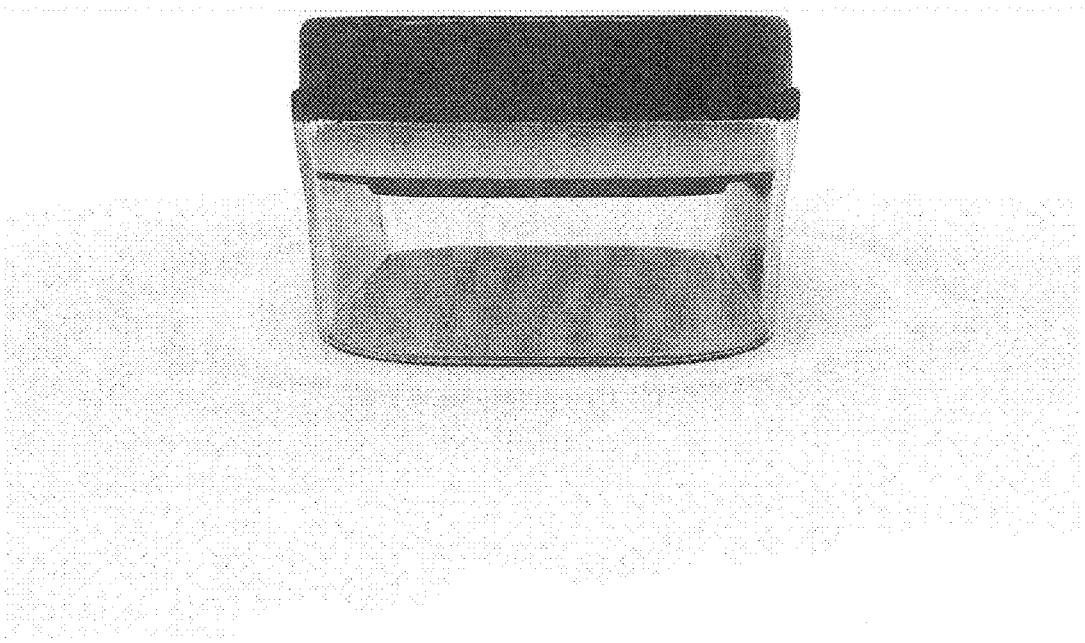
Figure 1E:
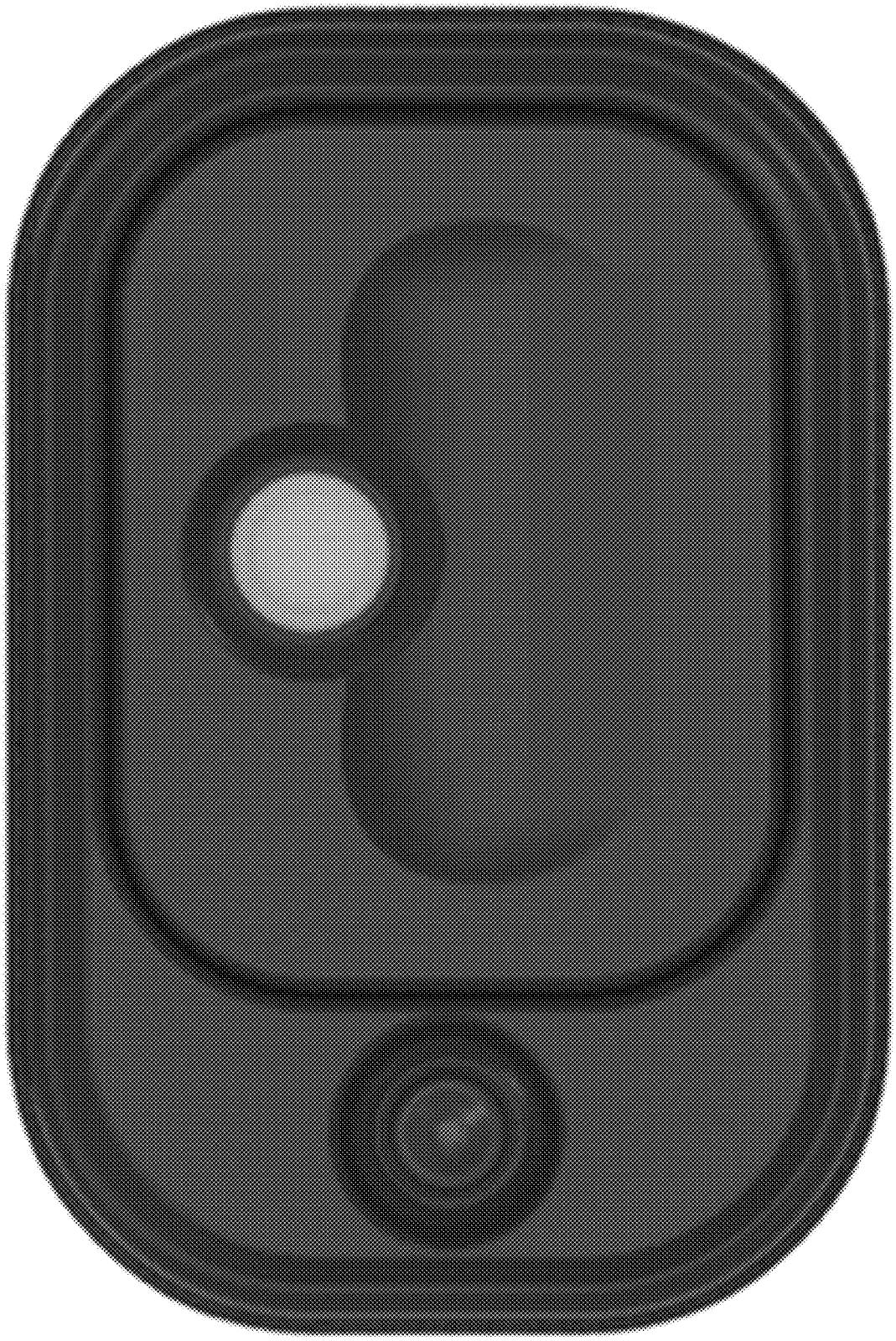
Figure 1F:
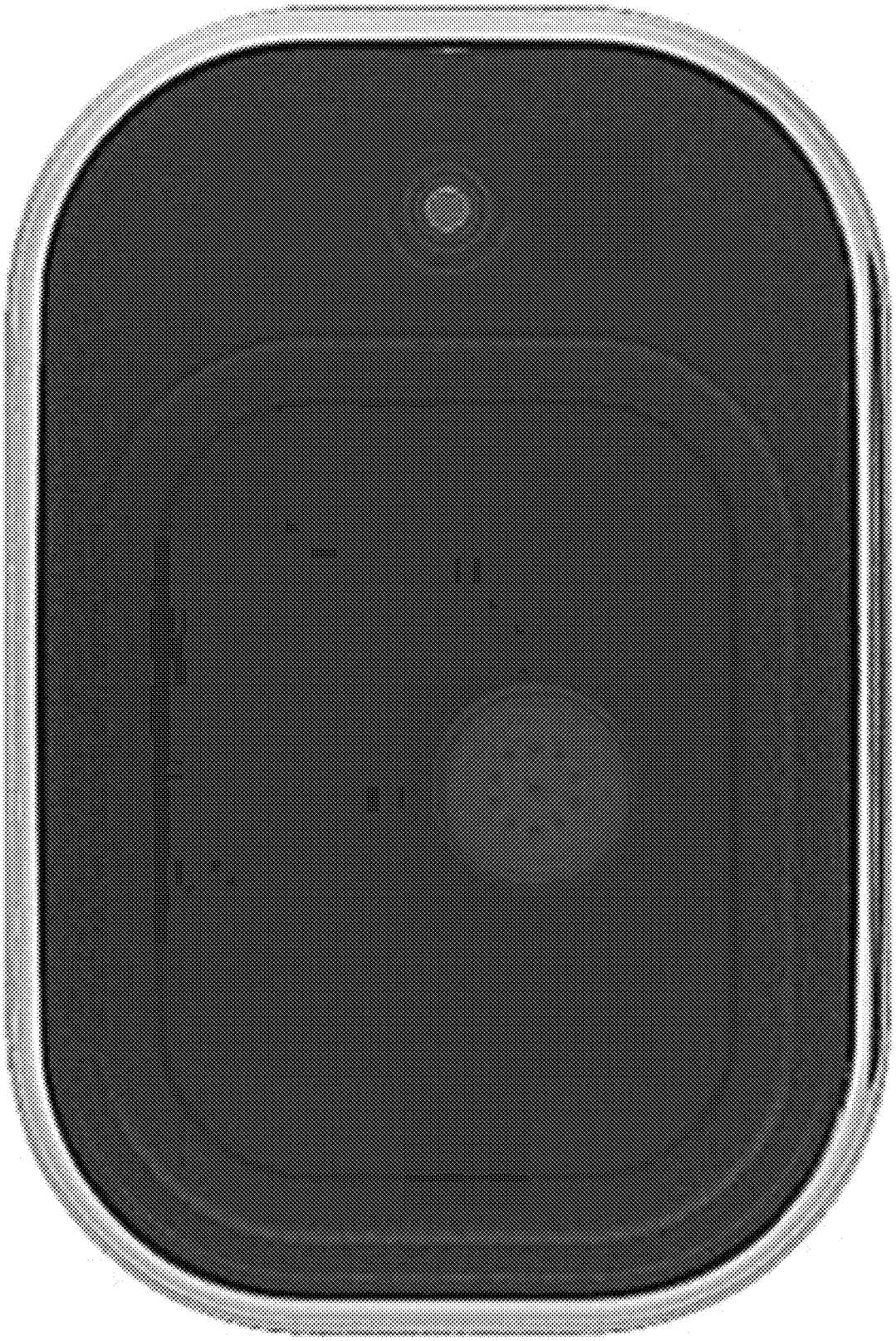
Figure 1G:
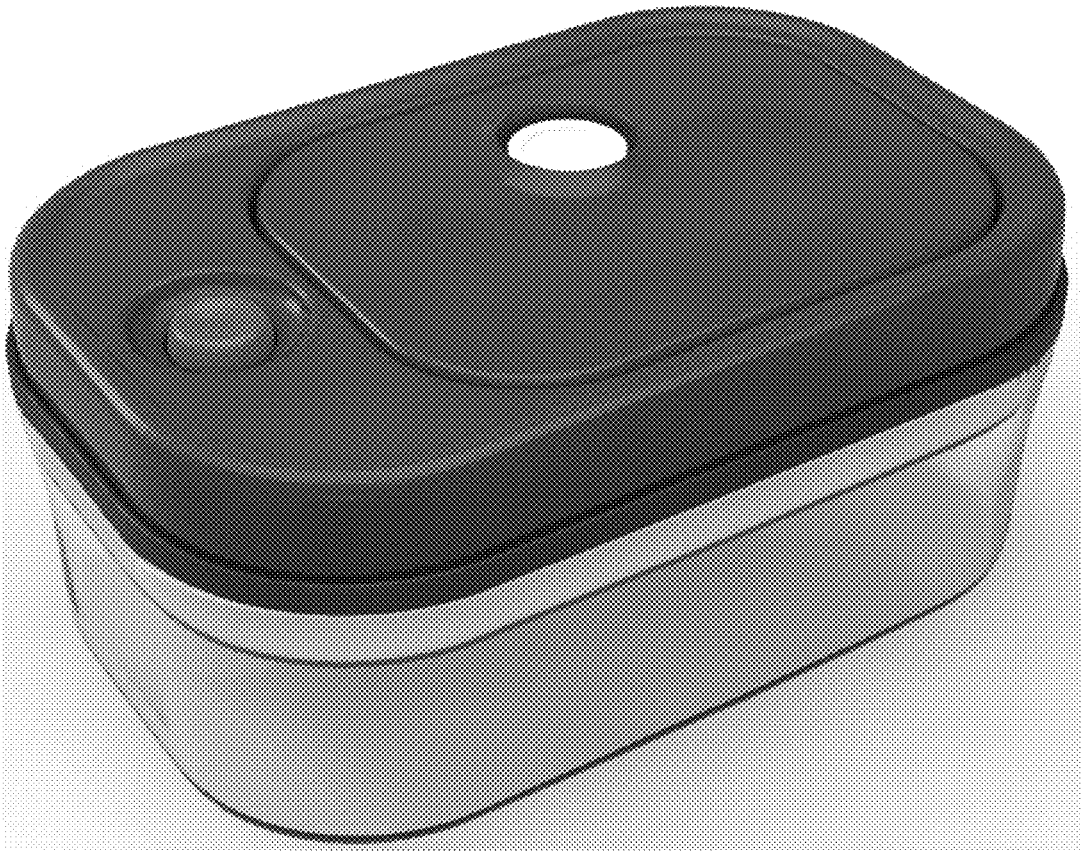
Figure 2A:
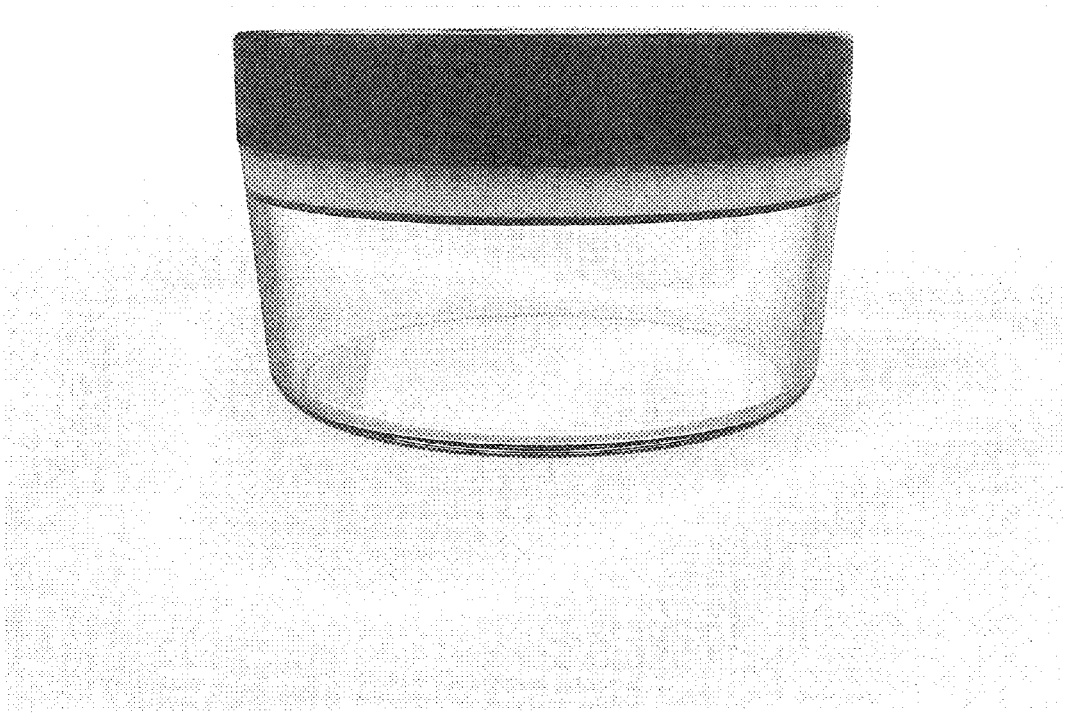
FIGS. 2A-2G illustrate a first embodiment of a round container with a bellows-equipped lid according to the presently disclosed invention.
Figure 2B:
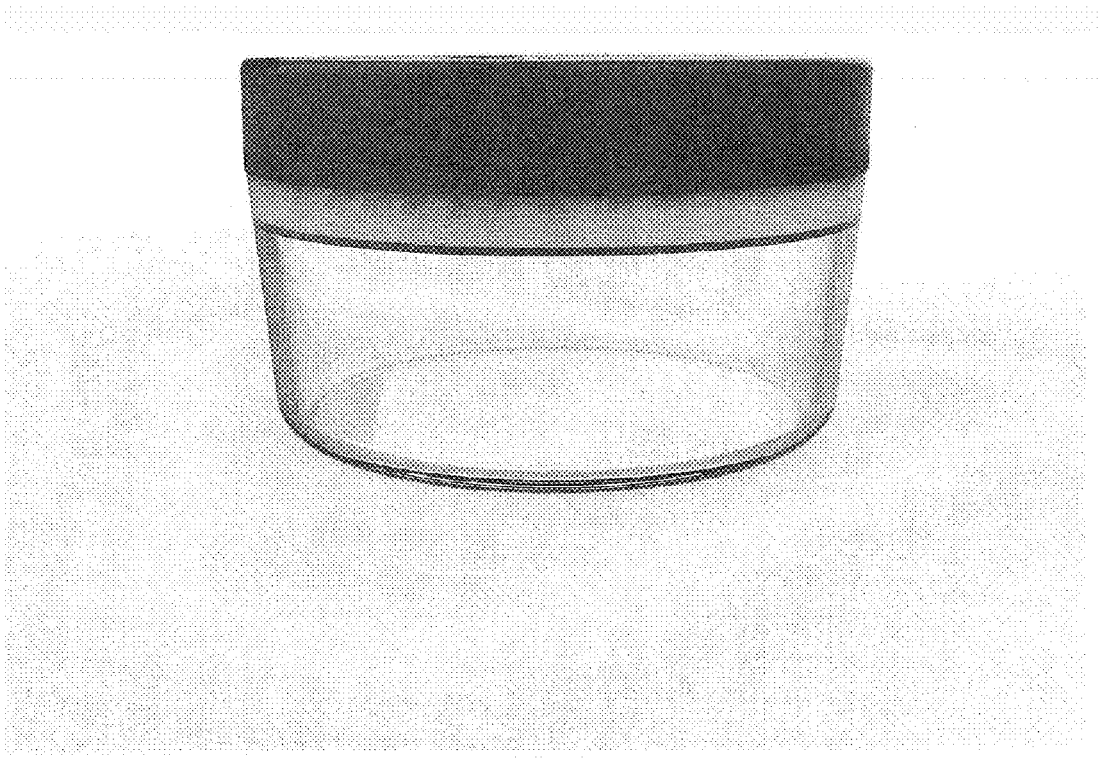
Figure 2C:
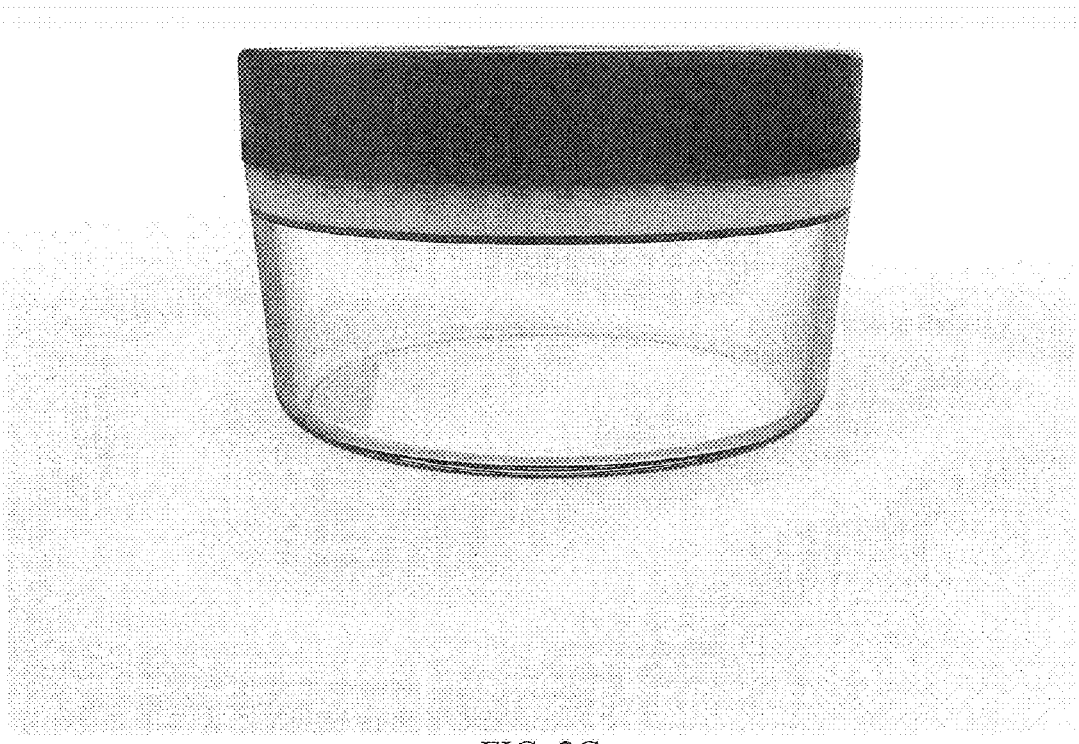
Figure 2D:
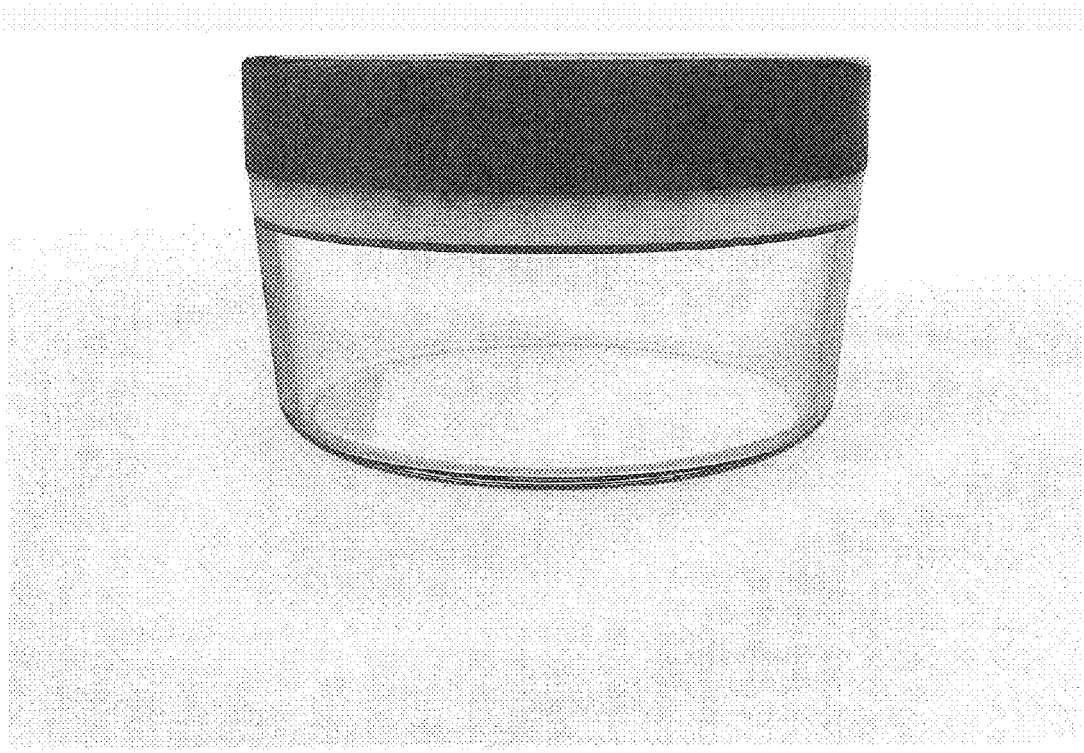
Figure 2E:
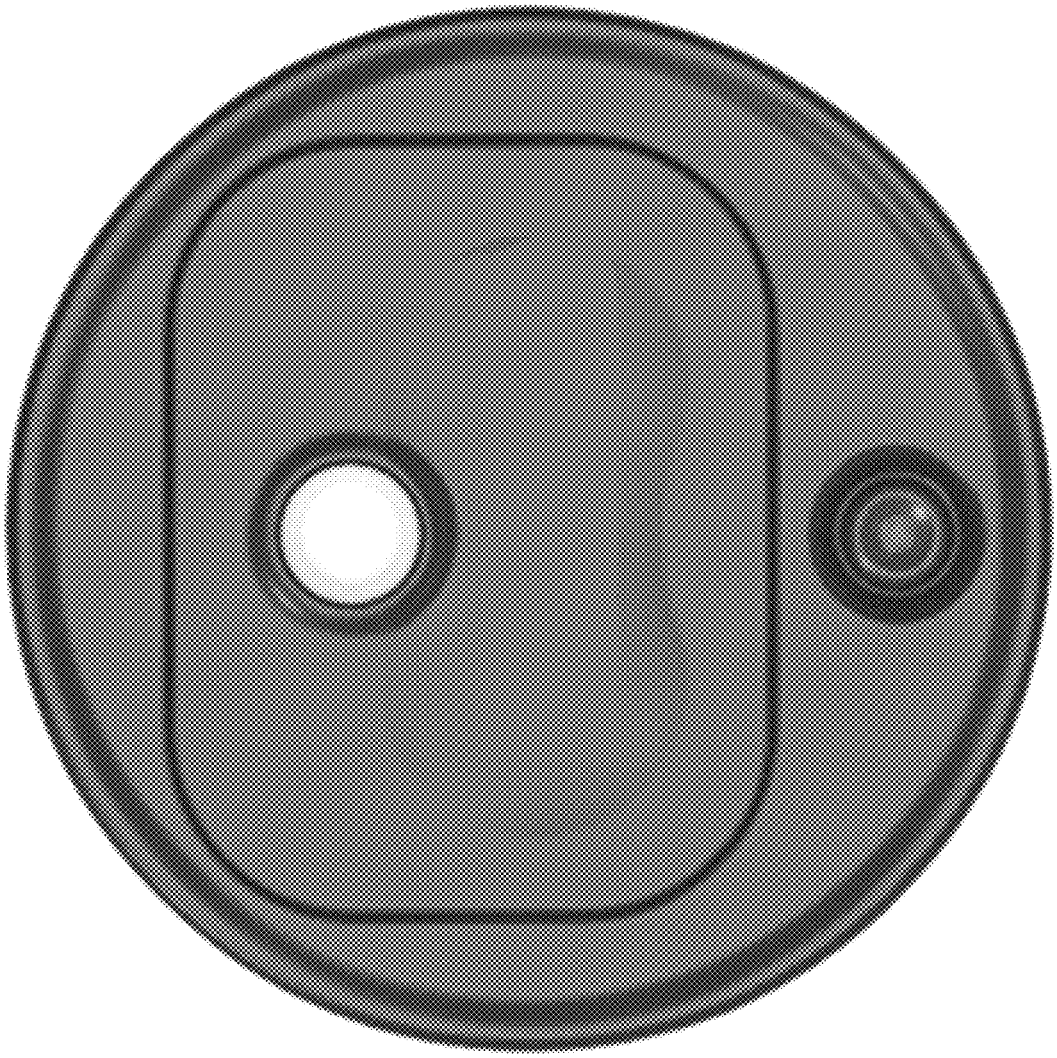
Figure 2F:
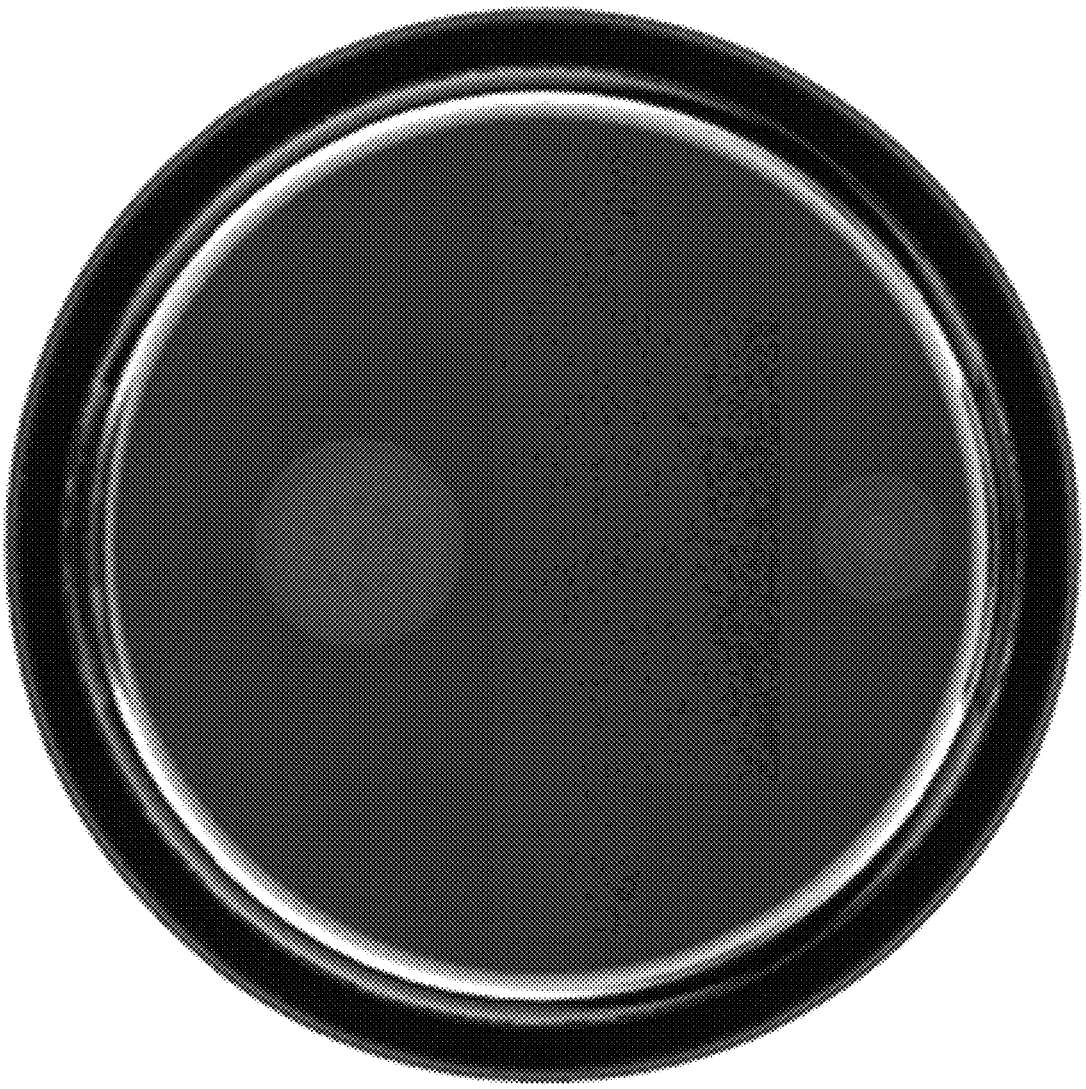
Figure 2G:
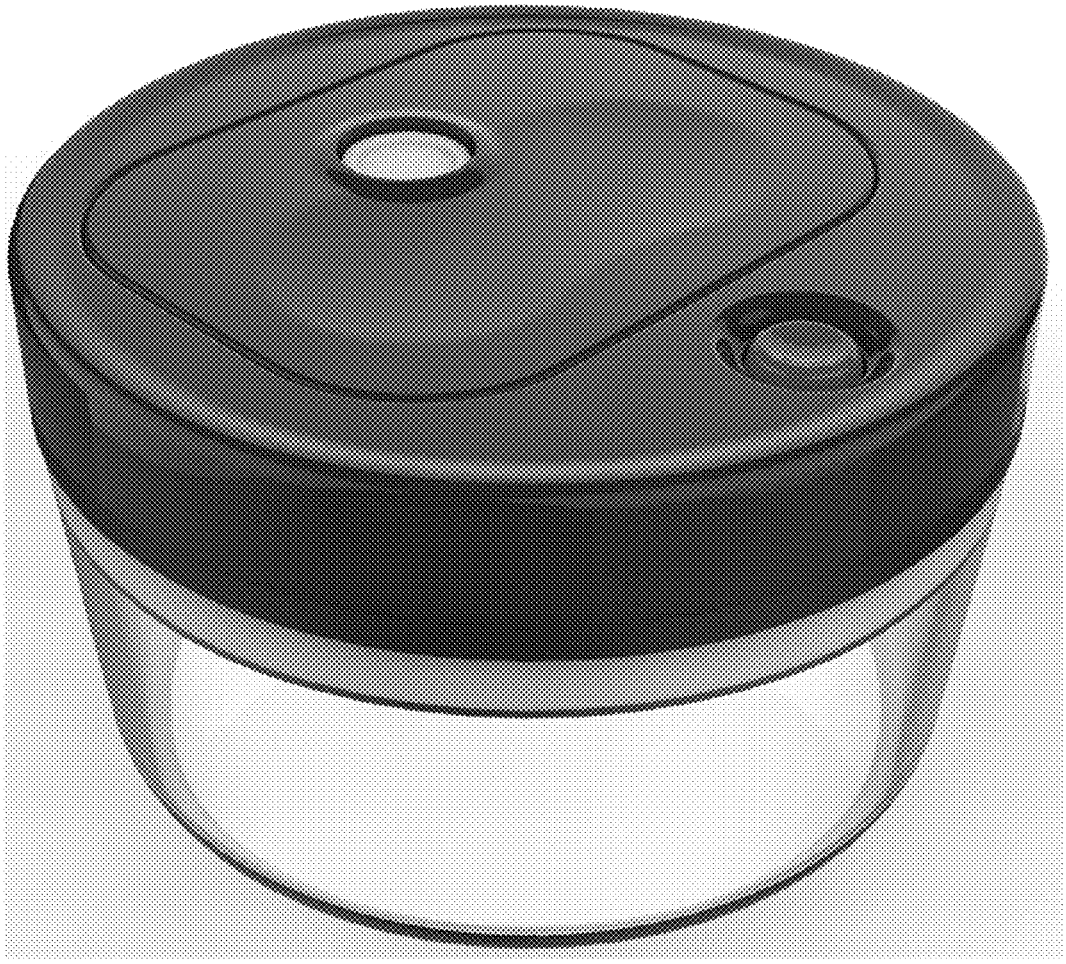
Figure 3A:
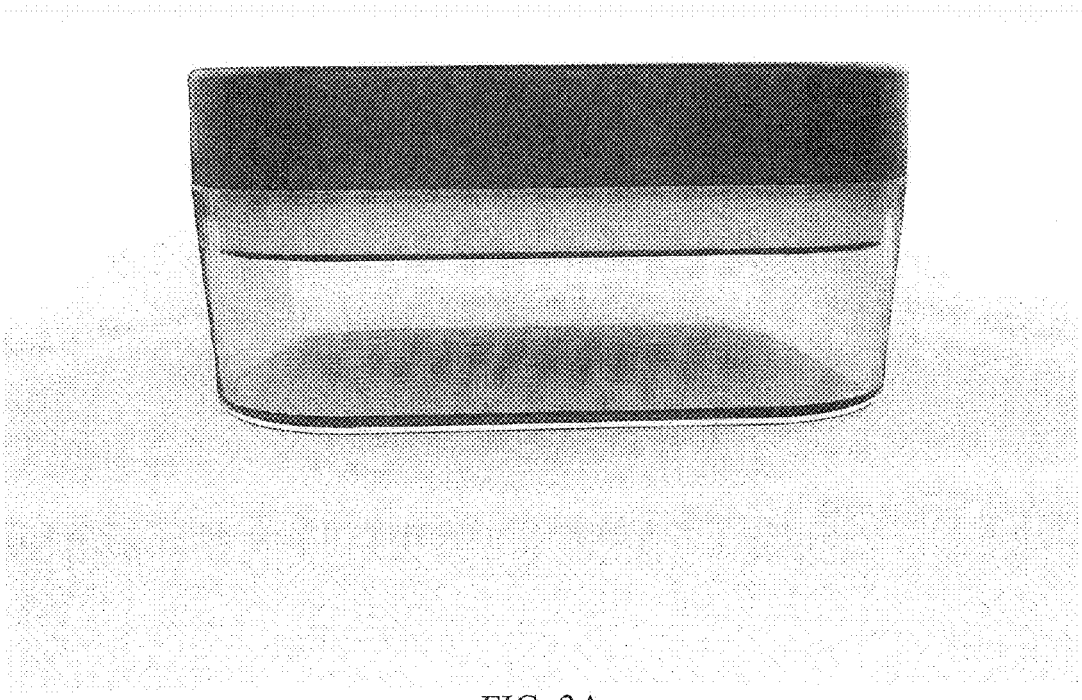
FIGS. 3A-3G illustrates a first embodiment of a square container with a bellows-equipped lid according to the presently disclosed invention.
Figure 3B:
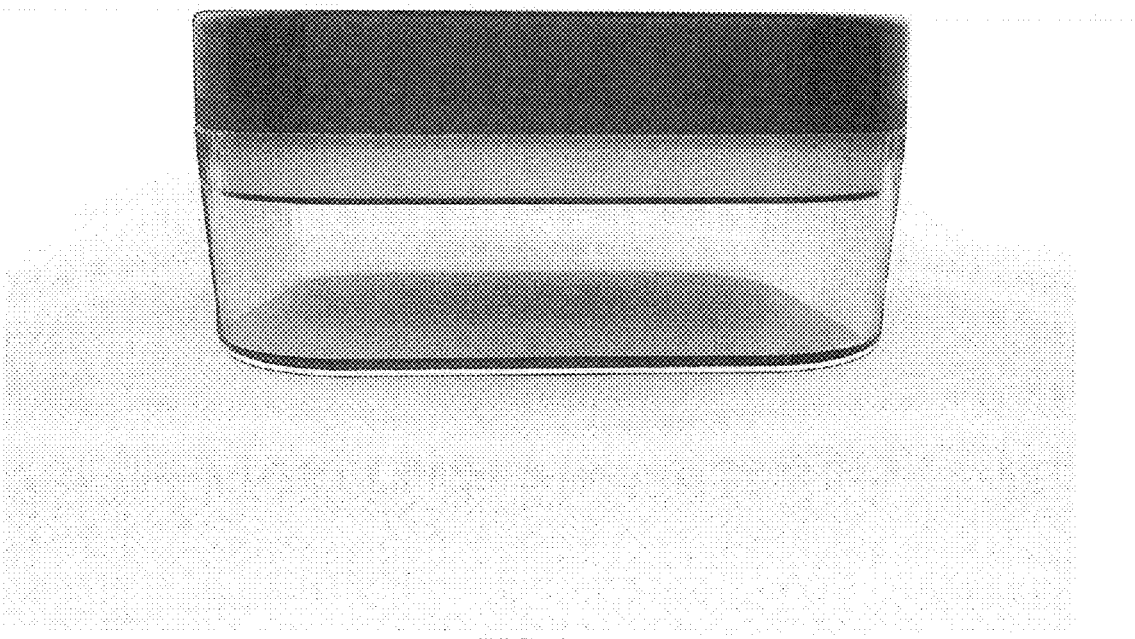
Figure 3C:
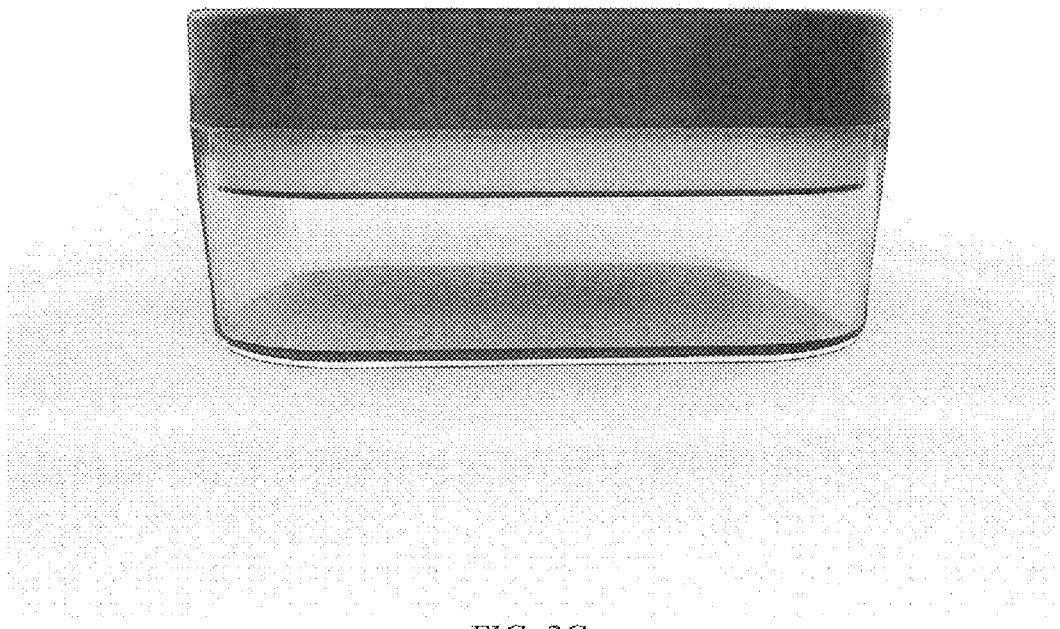
Figure 3D:
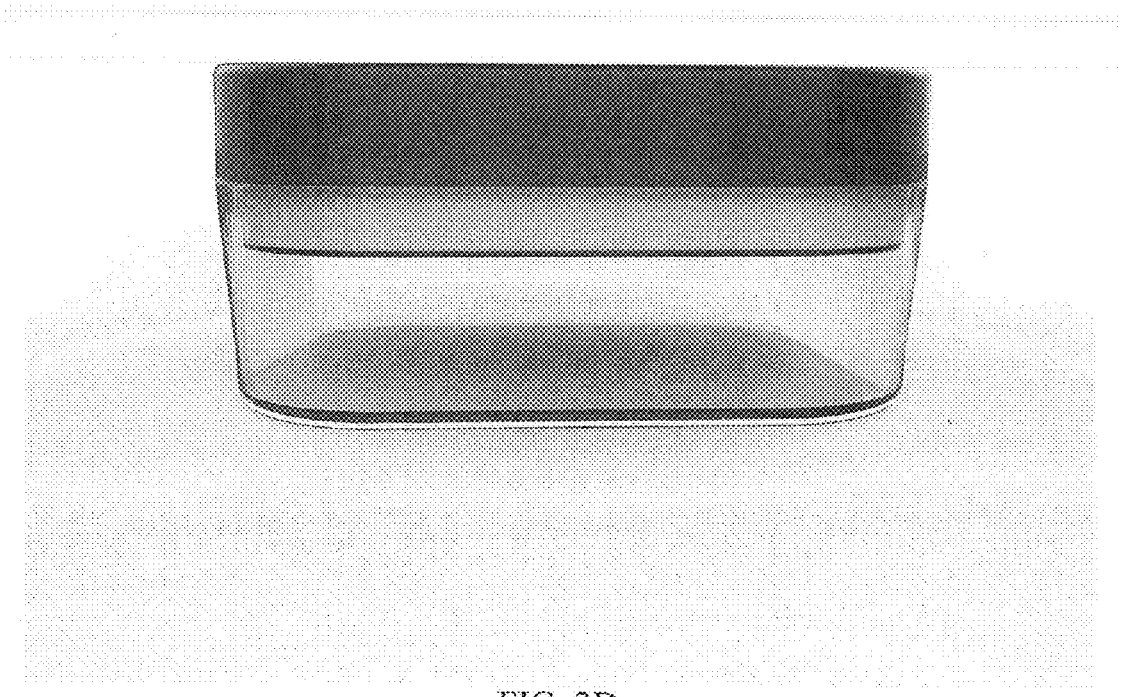
Figure 3E:
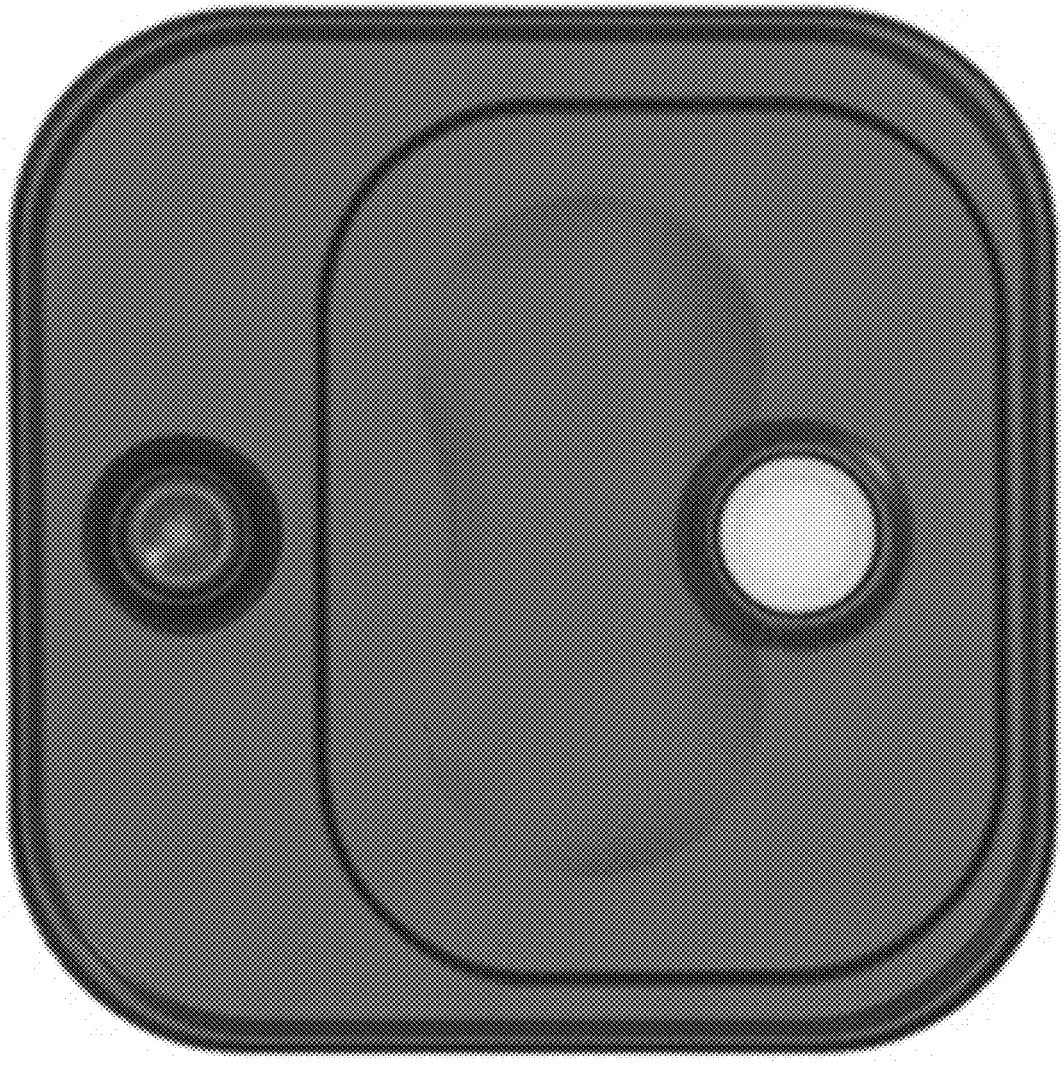
Figure 3F:
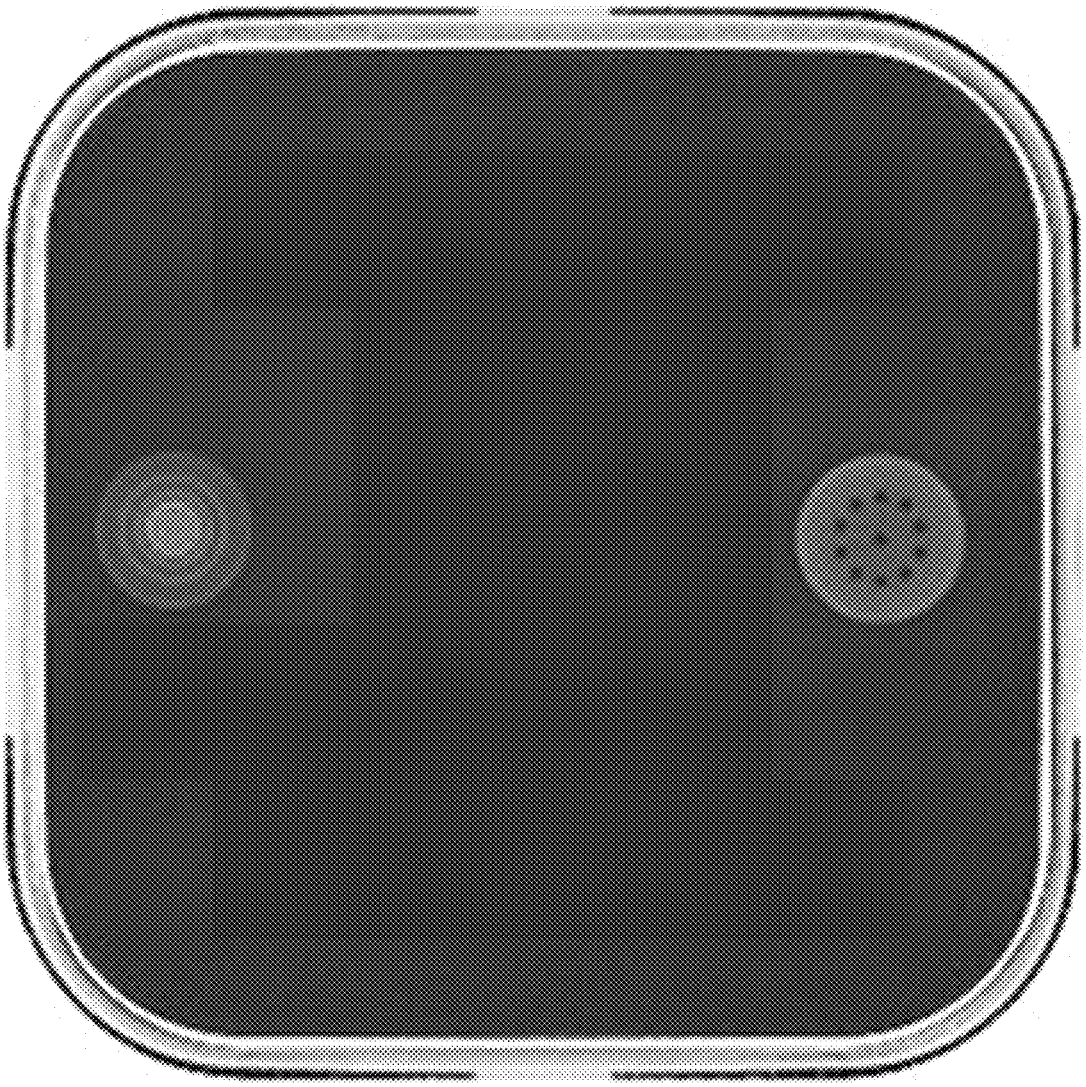
Figure 3G:
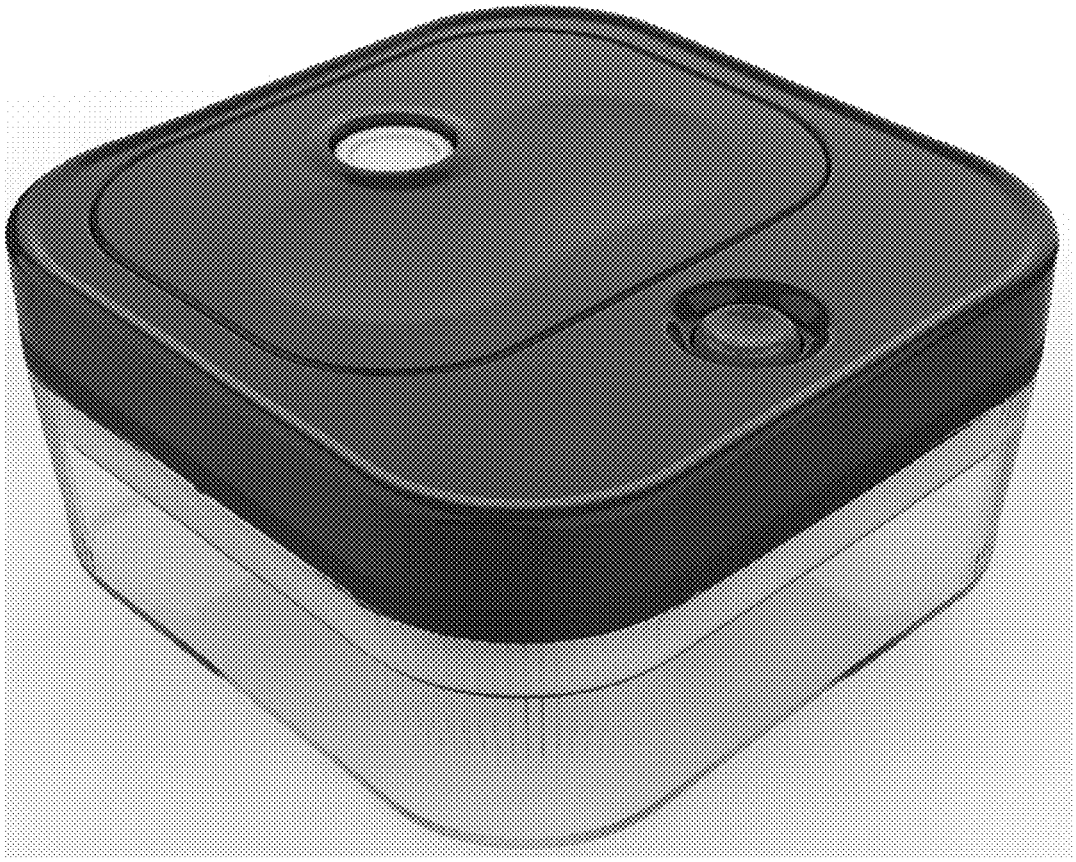
Figure 4A:
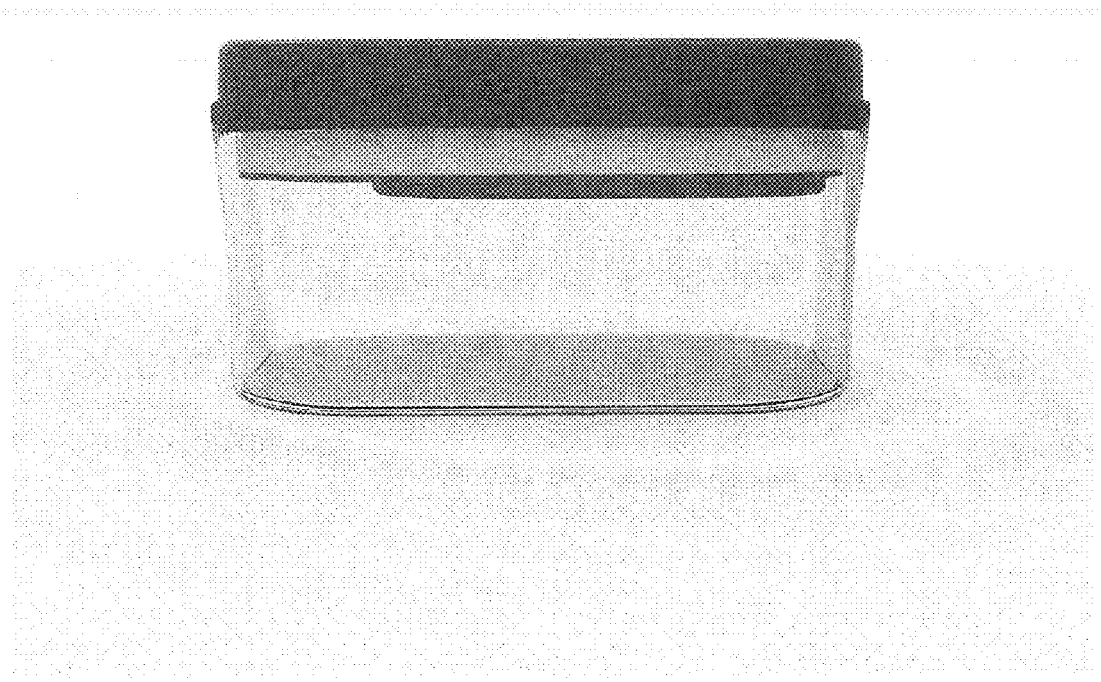
FIGS. 4A-4G illustrate a second embodiment of a rectangular container with a bellows-equipped lid according to the presently disclosed invention.
Figure 4B:
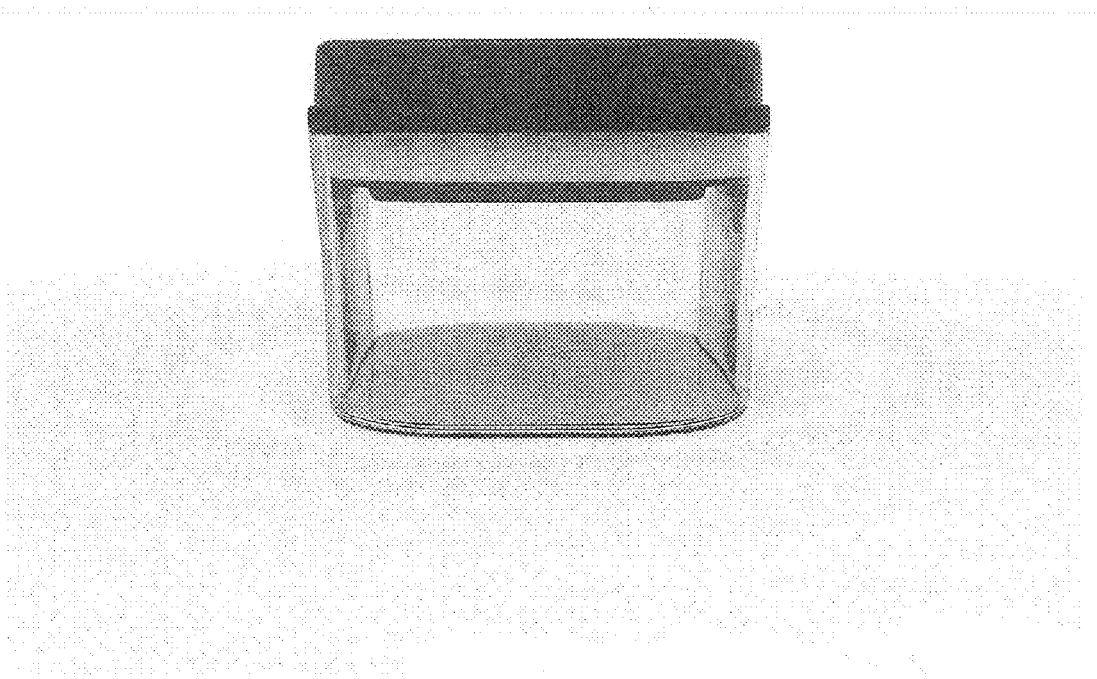
Figure 4C:
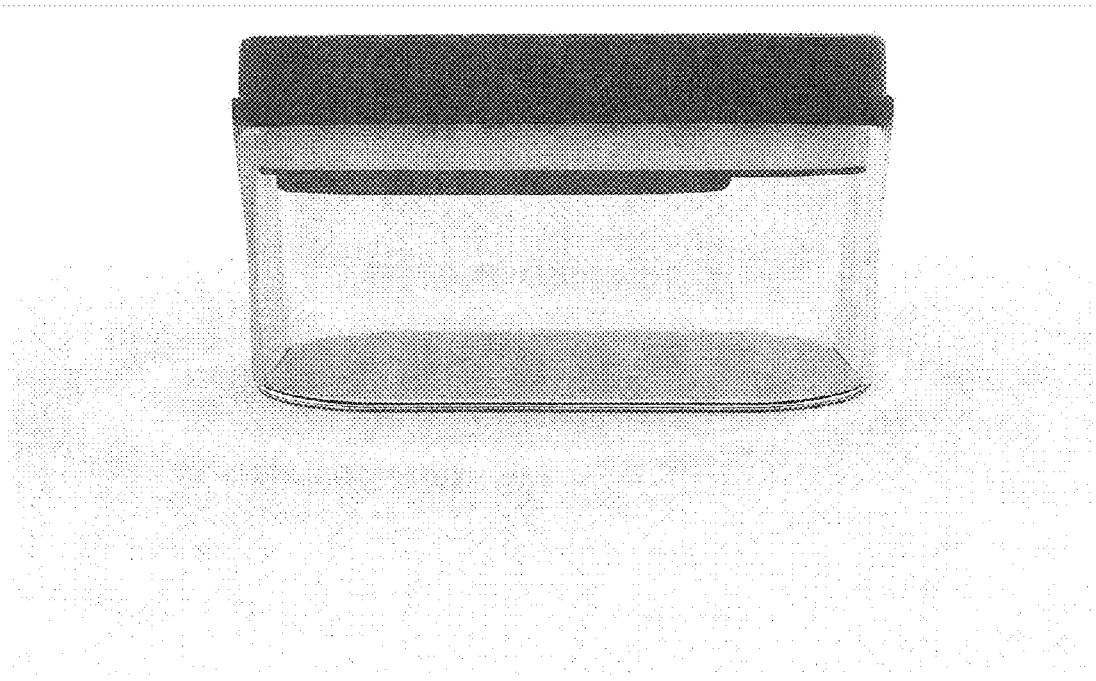
Figure 4D:
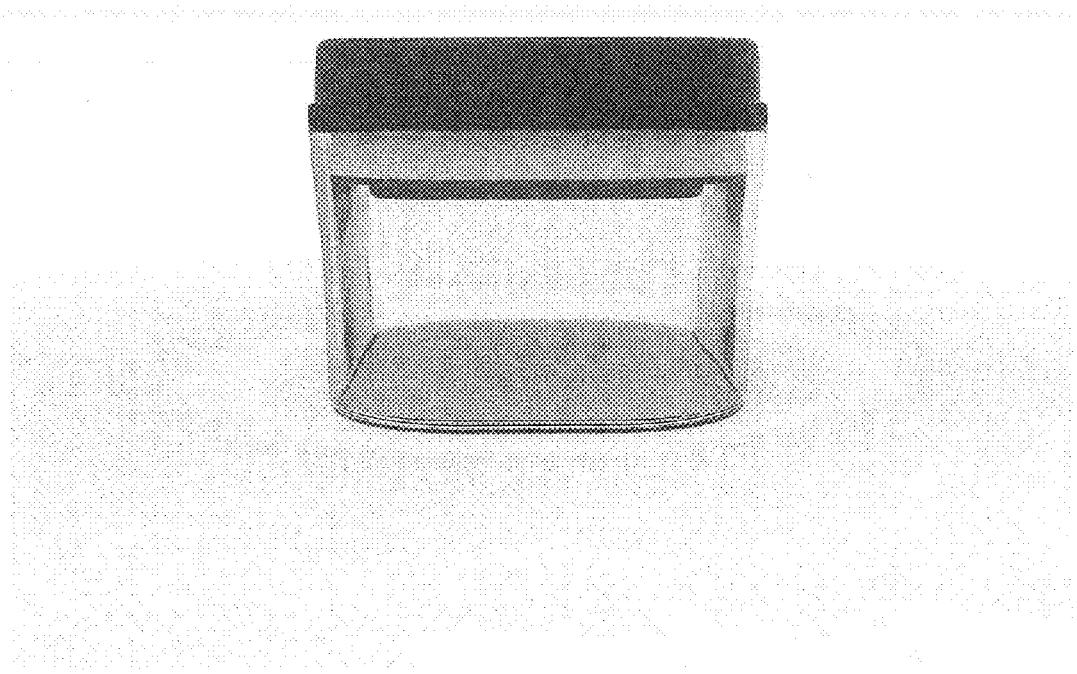
Figure 4E:
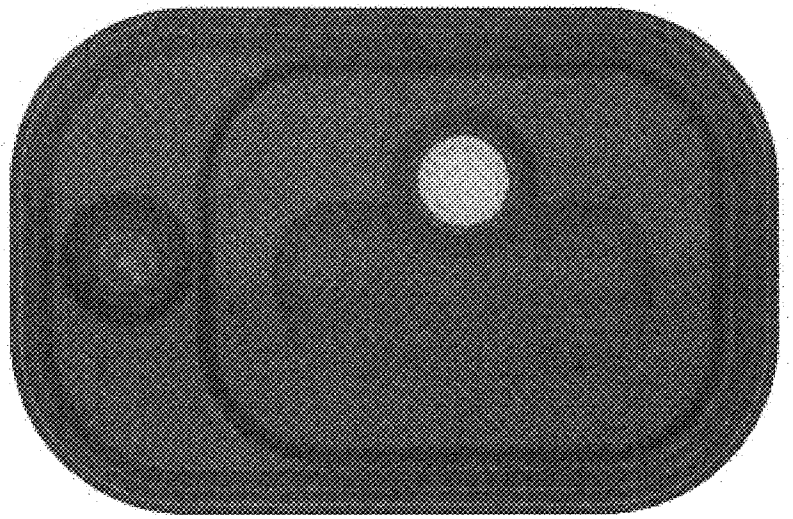
Figure 4F:
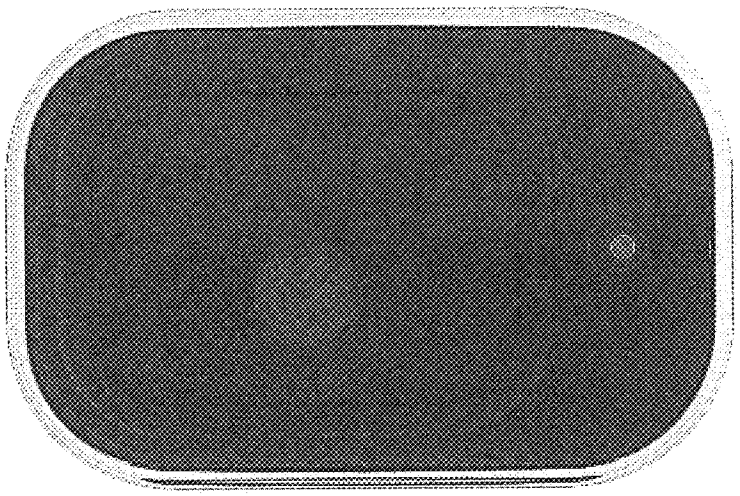
Figure 4G:
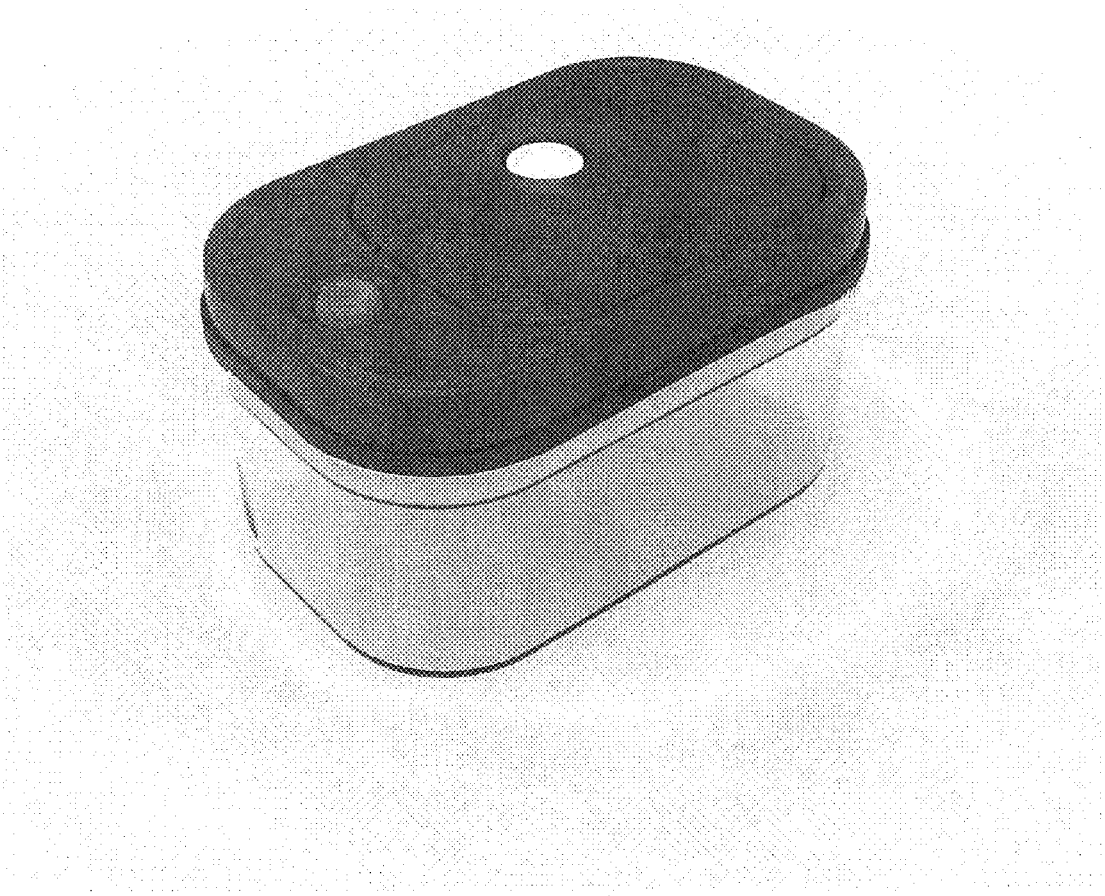
Figure 5A:
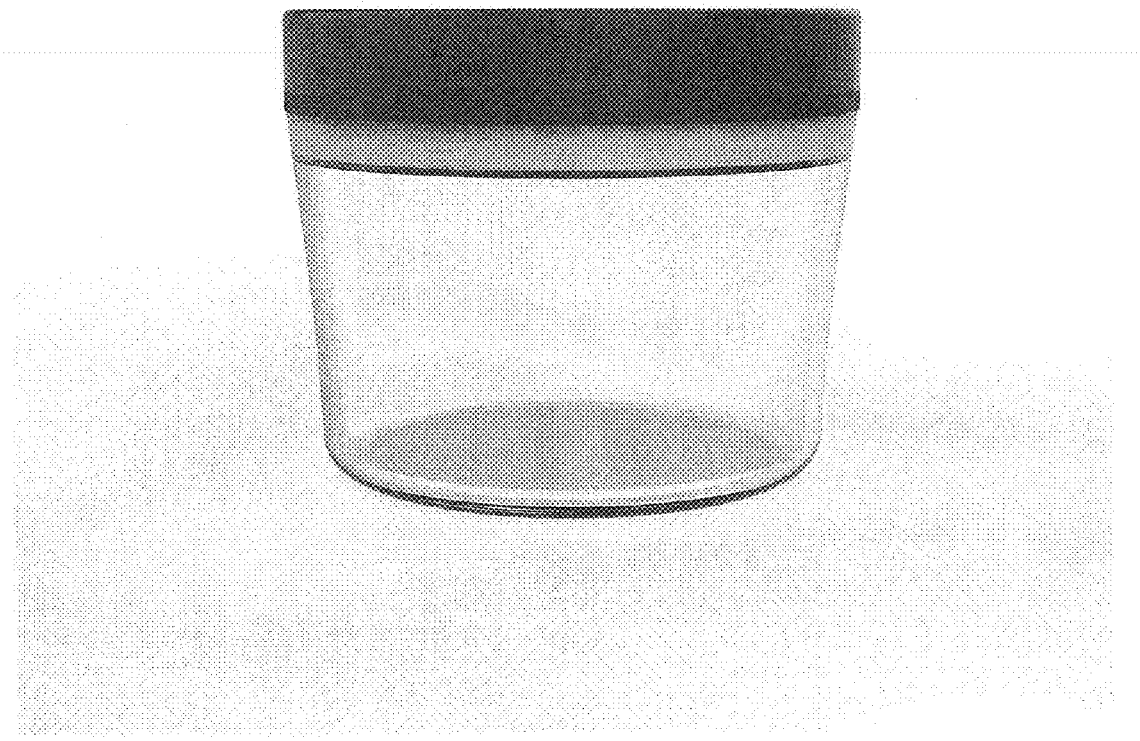
FIGS. 5A-5G illustrate a second embodiment of a round container with a bellows-equipped lid according to the presently disclosed invention.
Figure 5B:
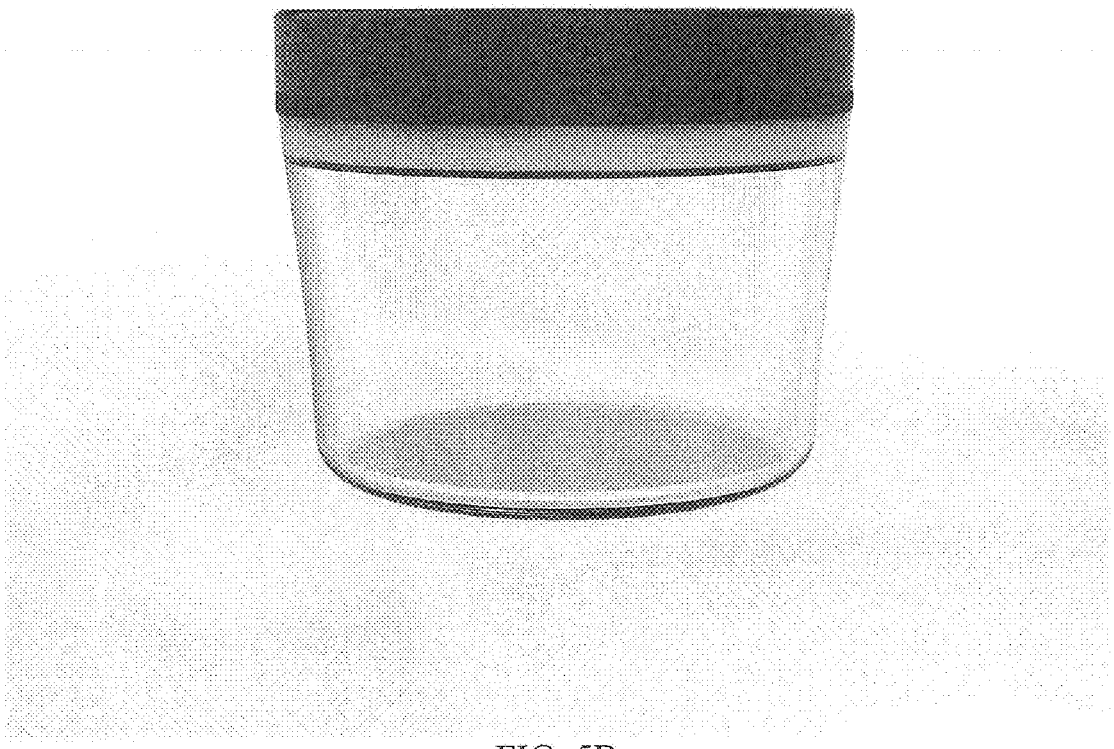
Figure 5C:
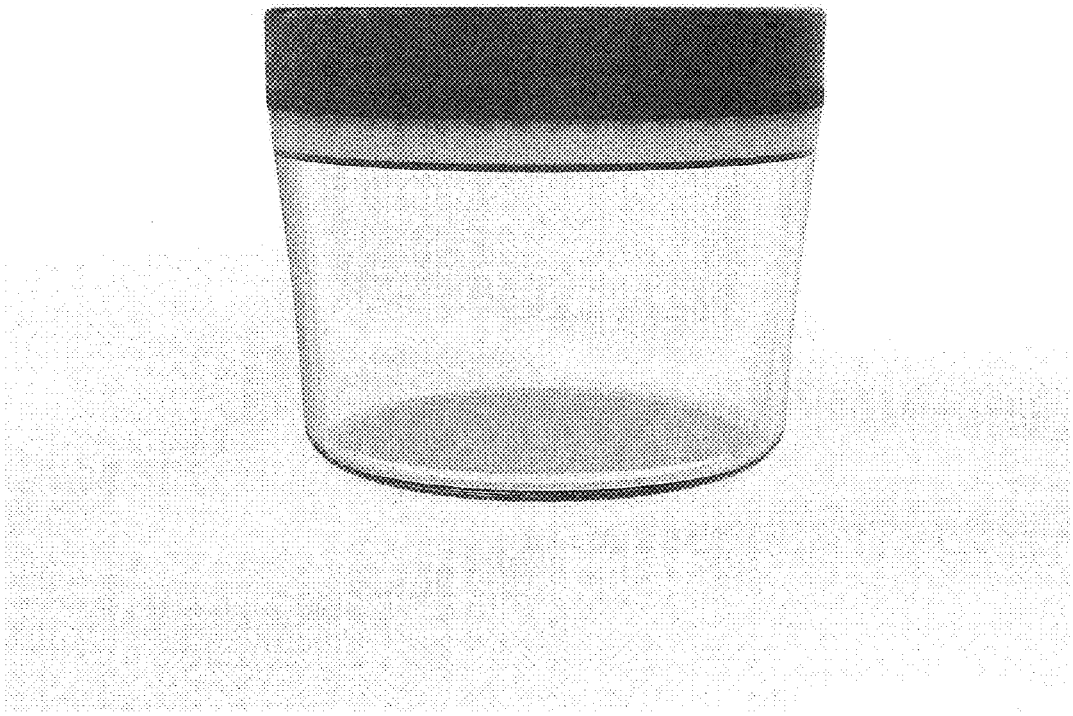
Figure 5D:
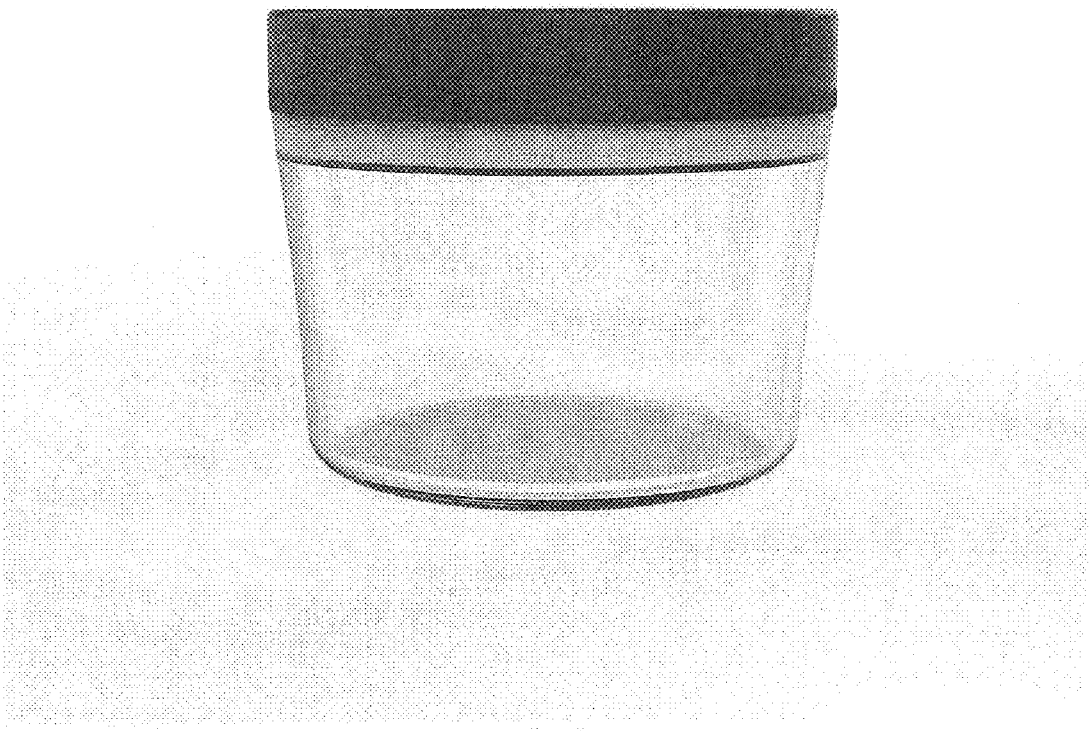
Figure 5E:
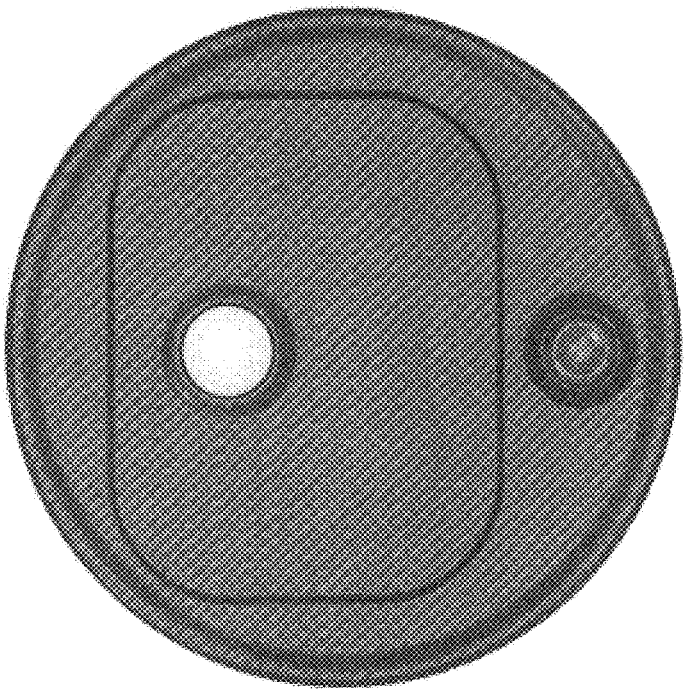
Figure 5F:
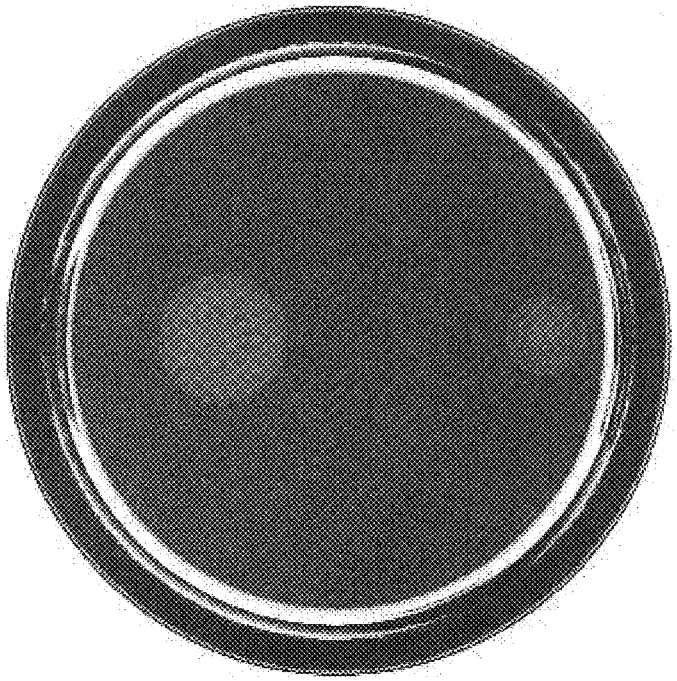
Figure 5G:
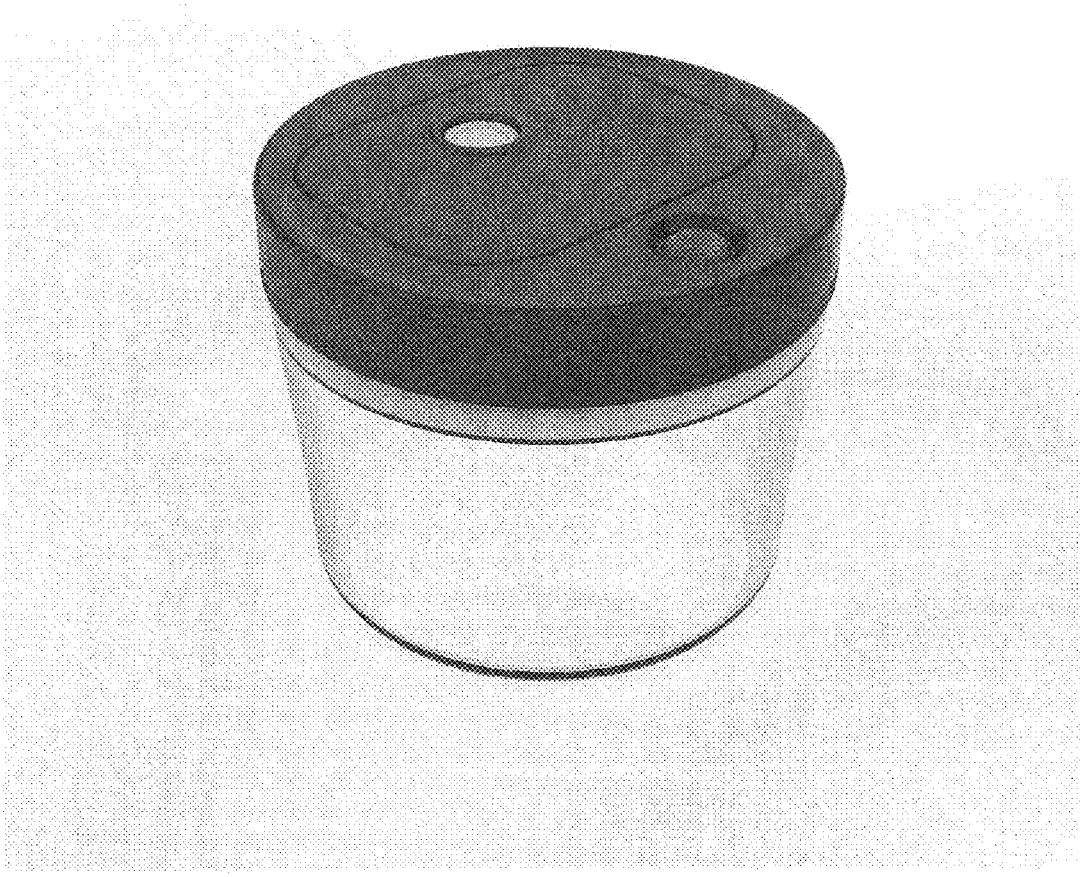
Figure 6A:
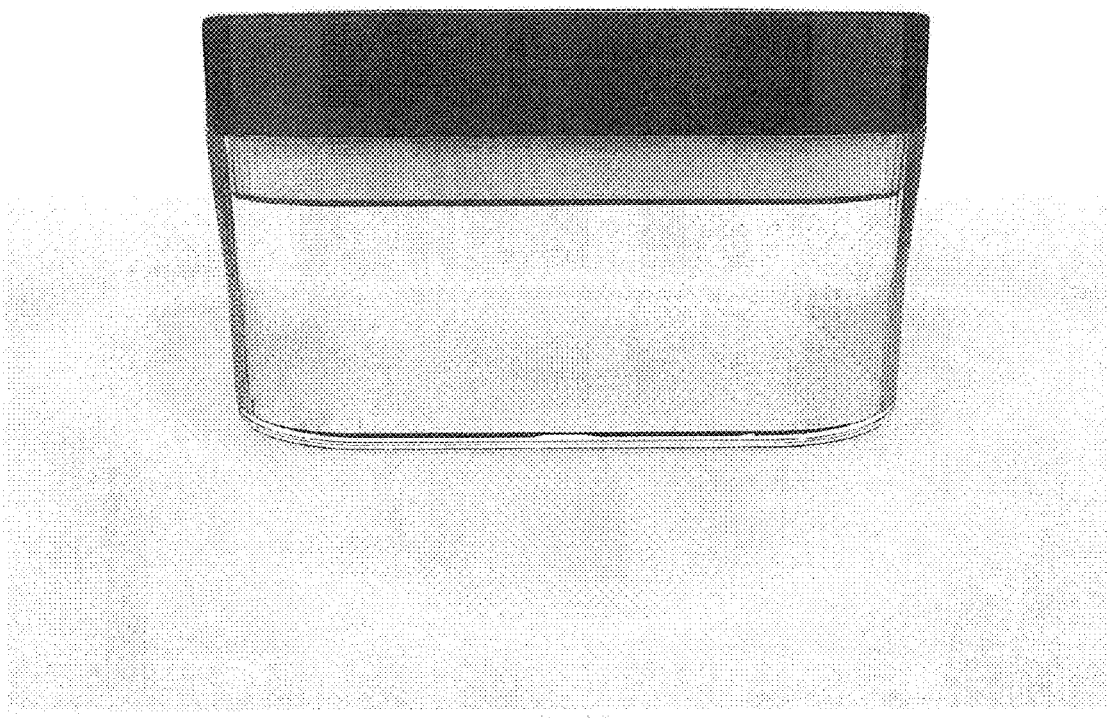
FIGS. 6A-6G illustrates a second embodiment of a square container with a bellows-equipped lid according to the presently disclosed invention.
Figure 6B:
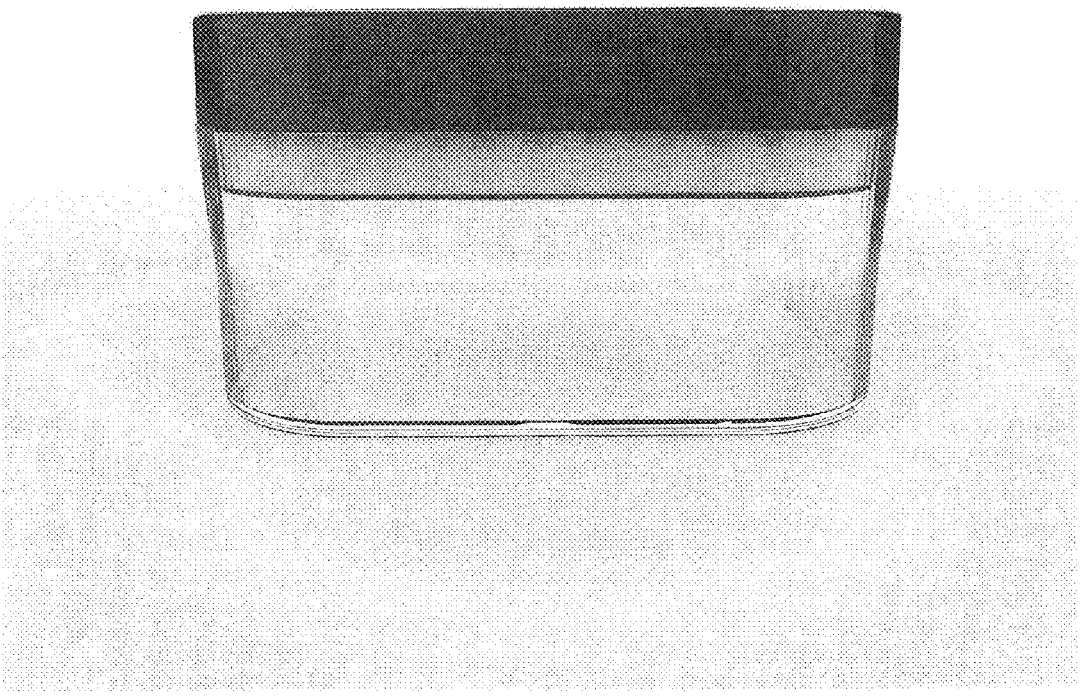
Figure 6C:
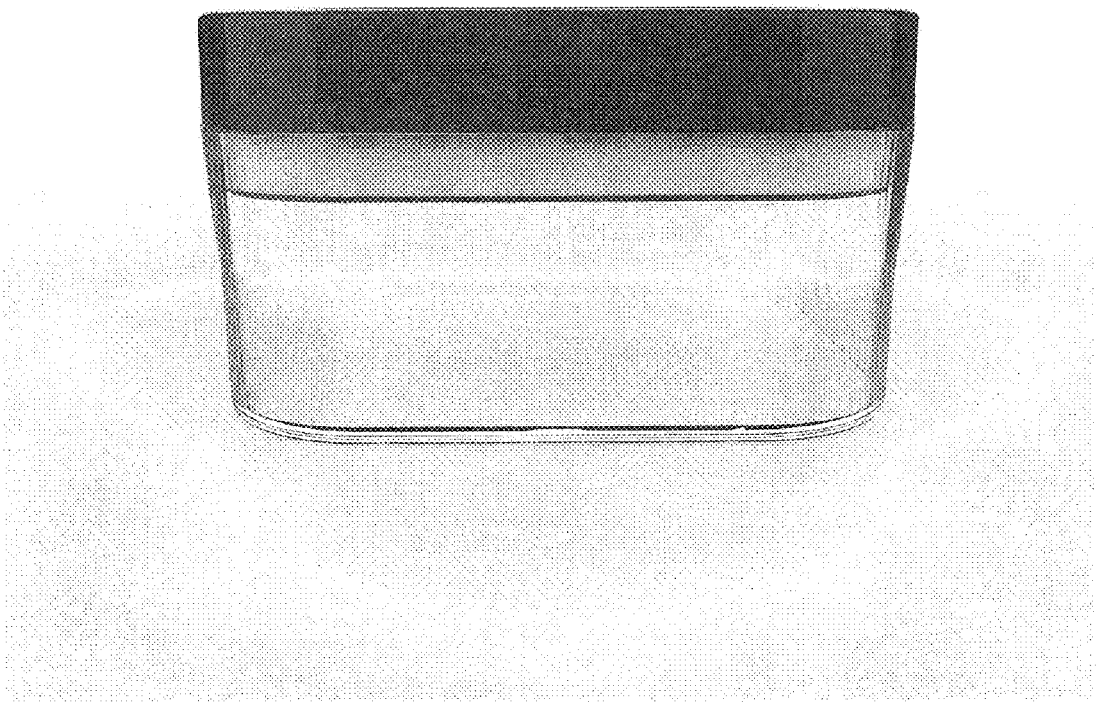
Figure 6D:
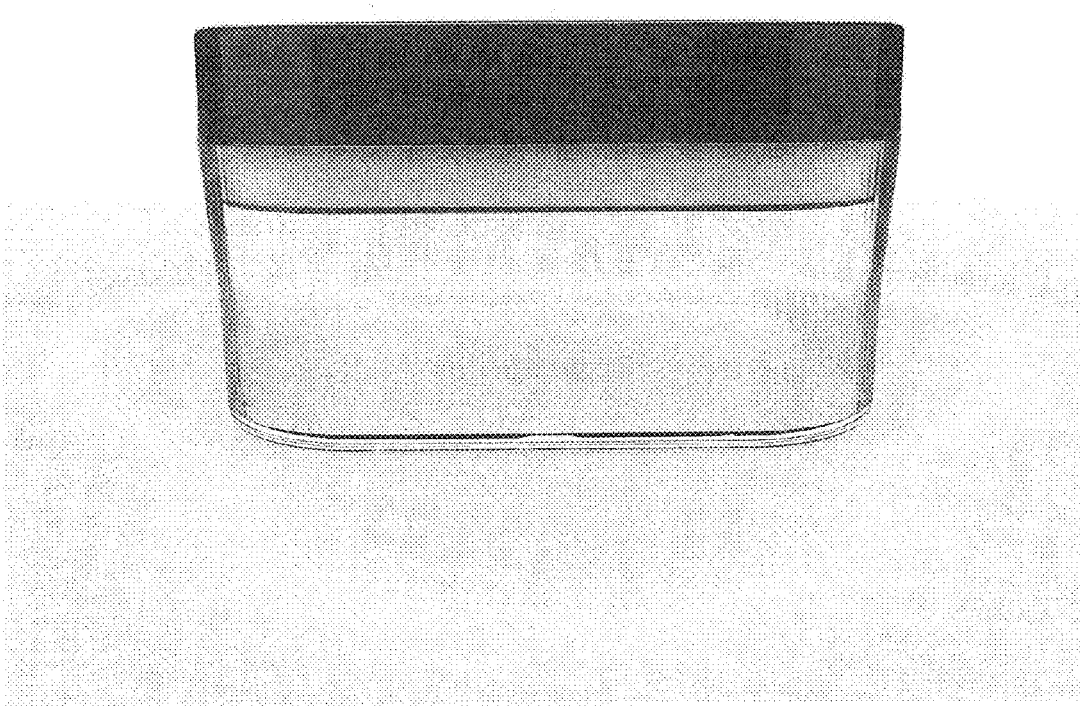
Figure 6E:
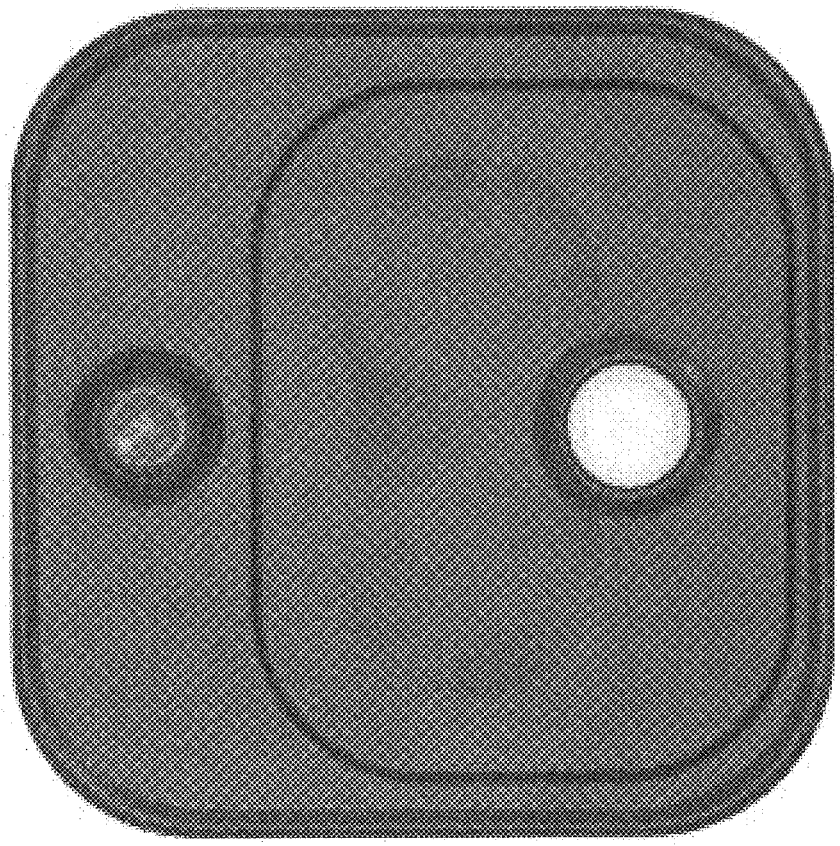
Figure 6F:
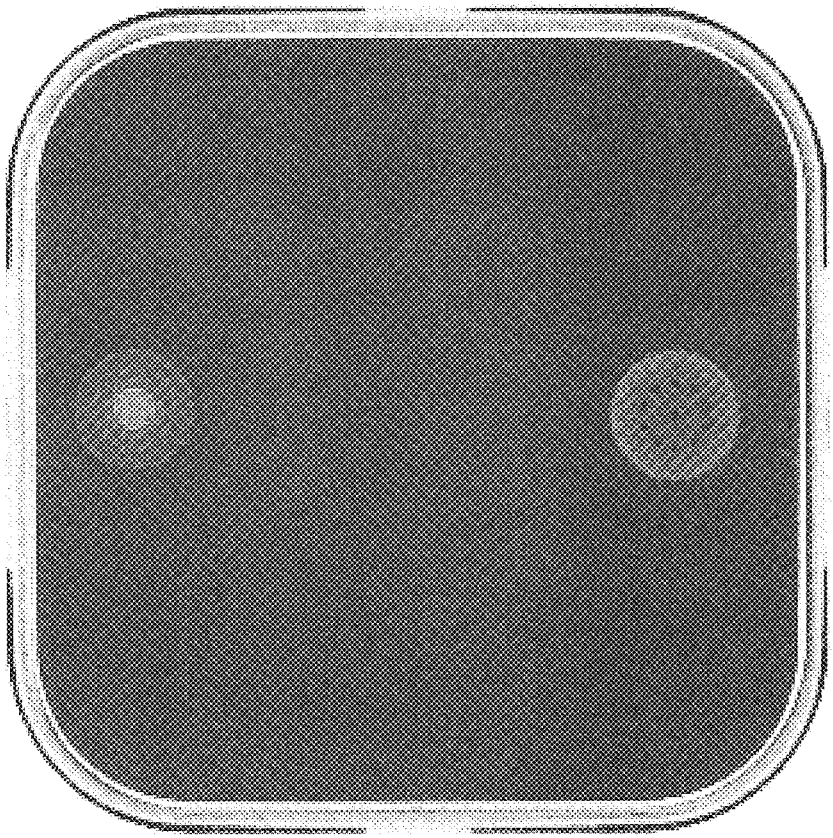
Figure 6G:
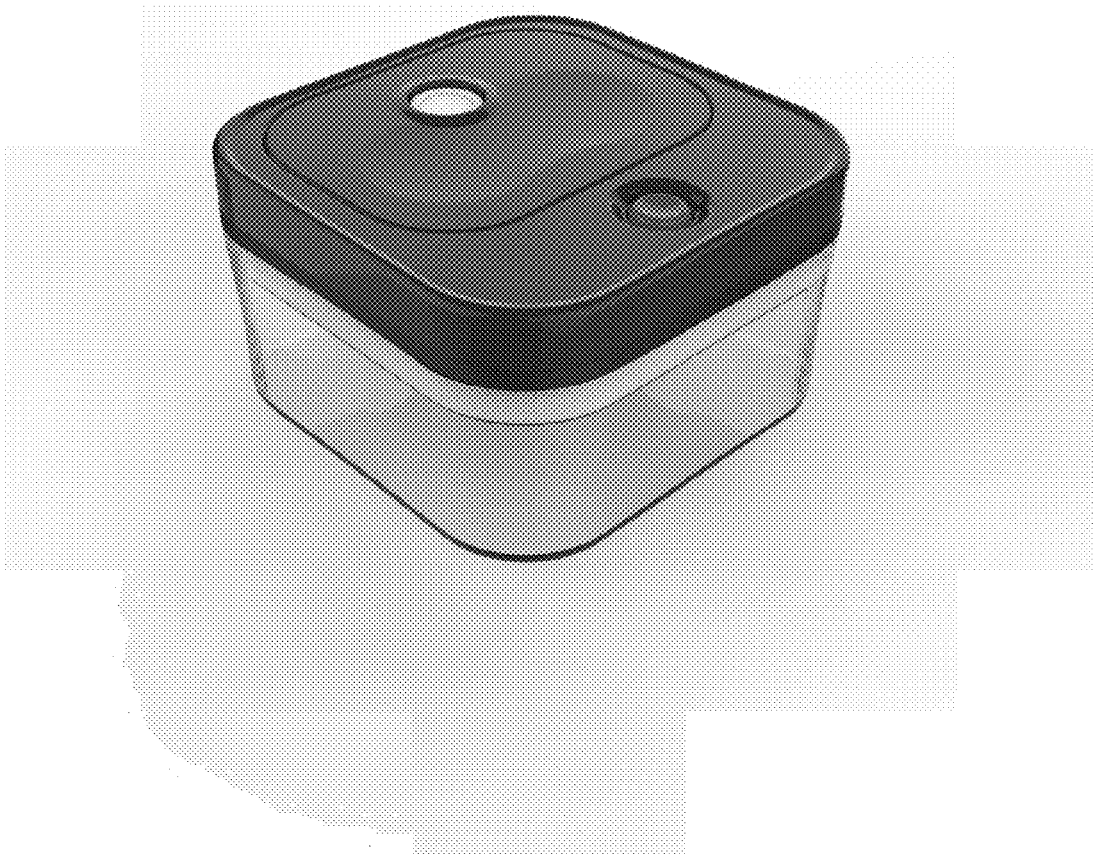
Figure 7A:
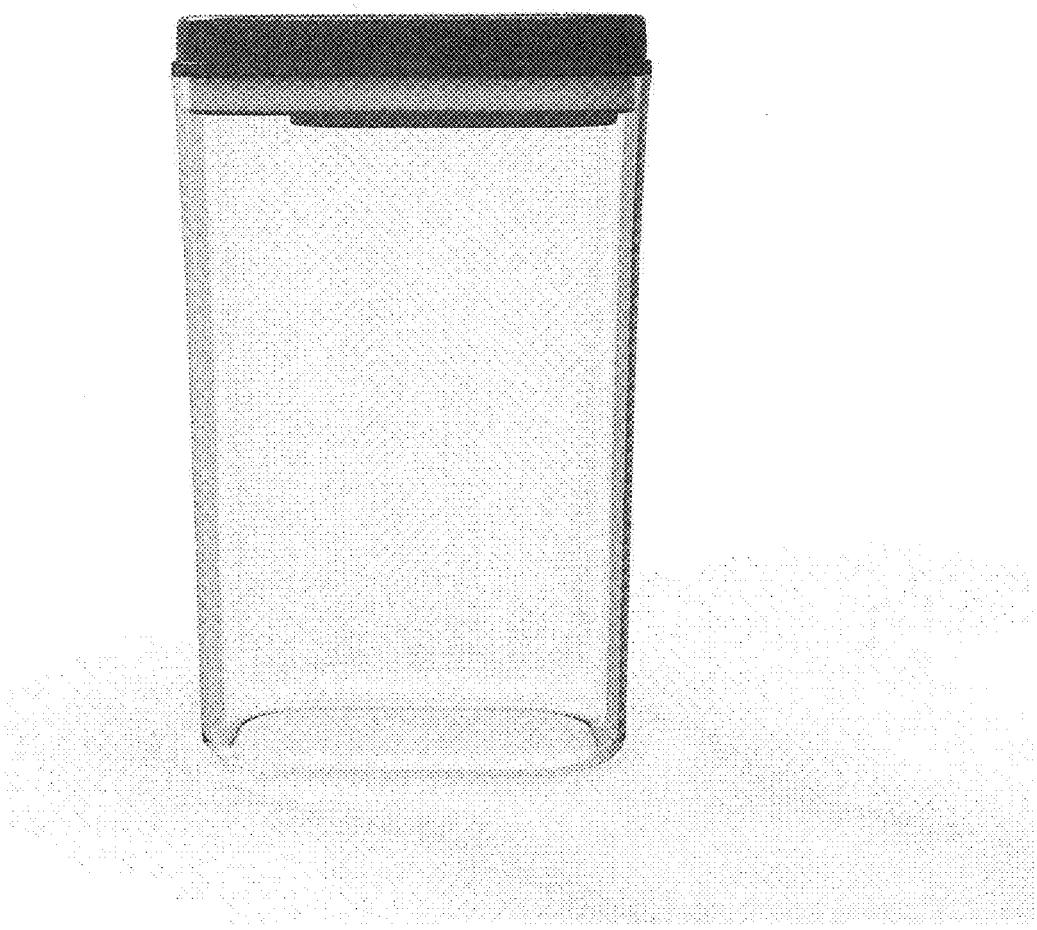
FIGS. 7A-7G illustrate a third embodiment of a rectangular container with a bellows-equipped lid according to the presently disclosed invention.
Figure 7B:
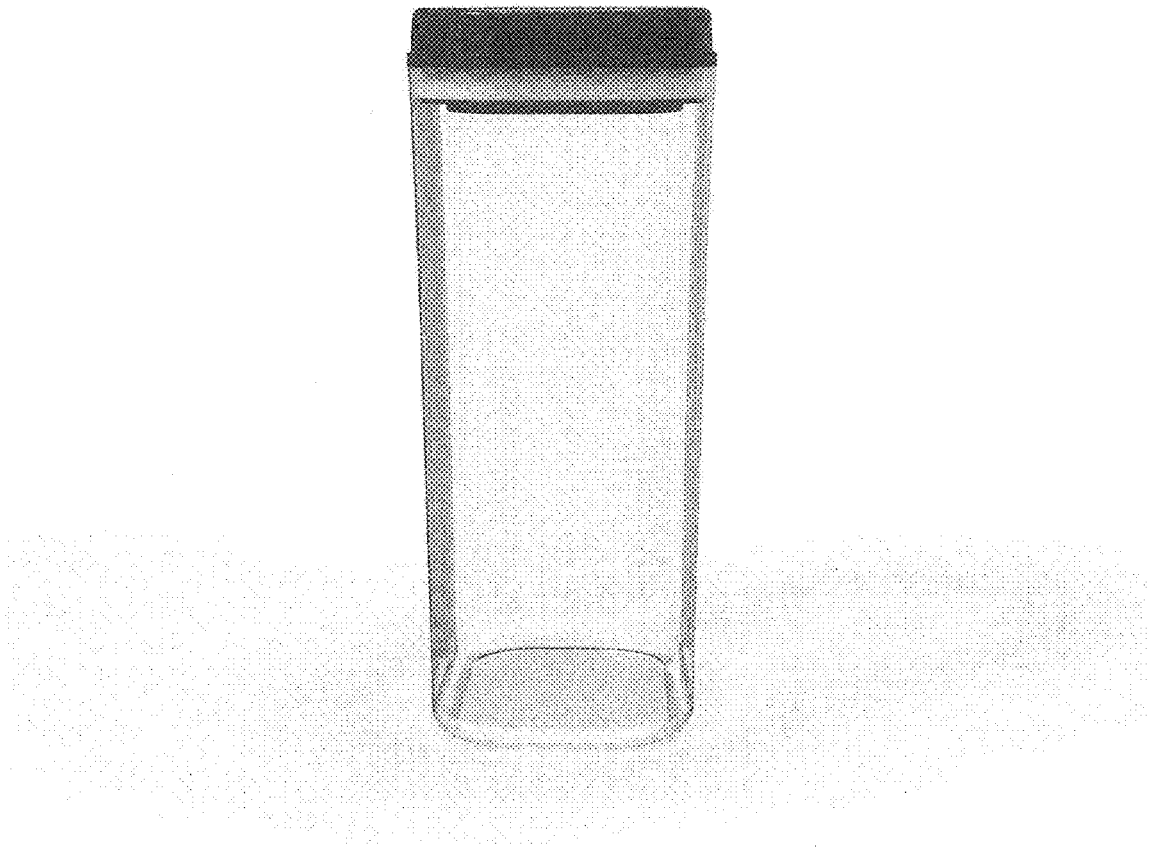
Figure 7C:
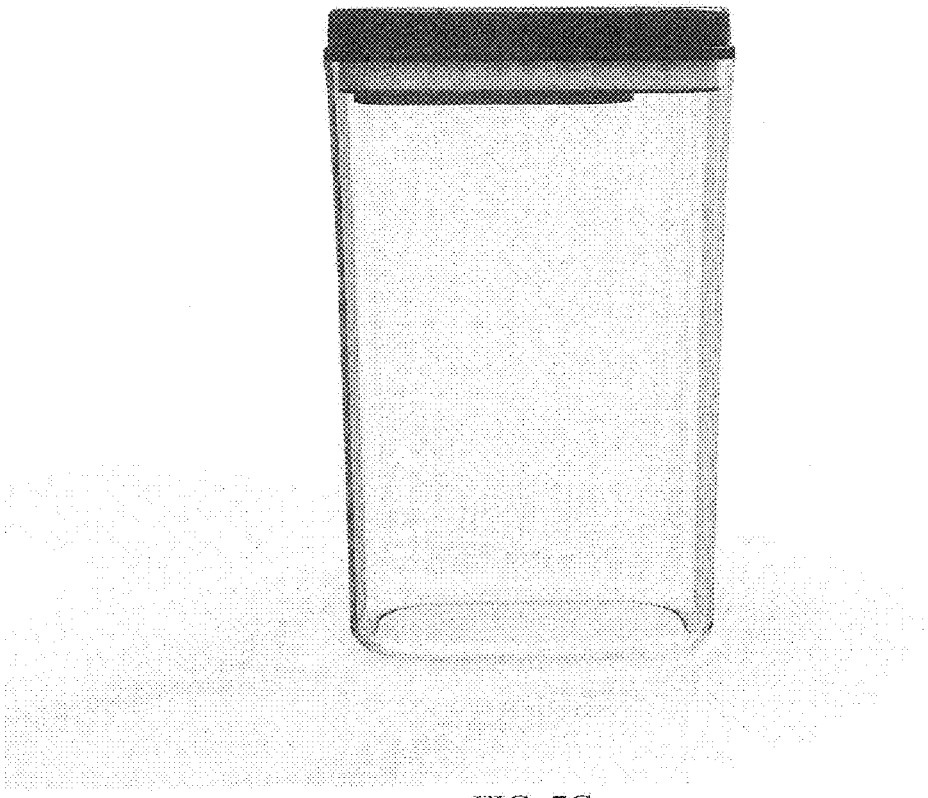
Figure 7D:
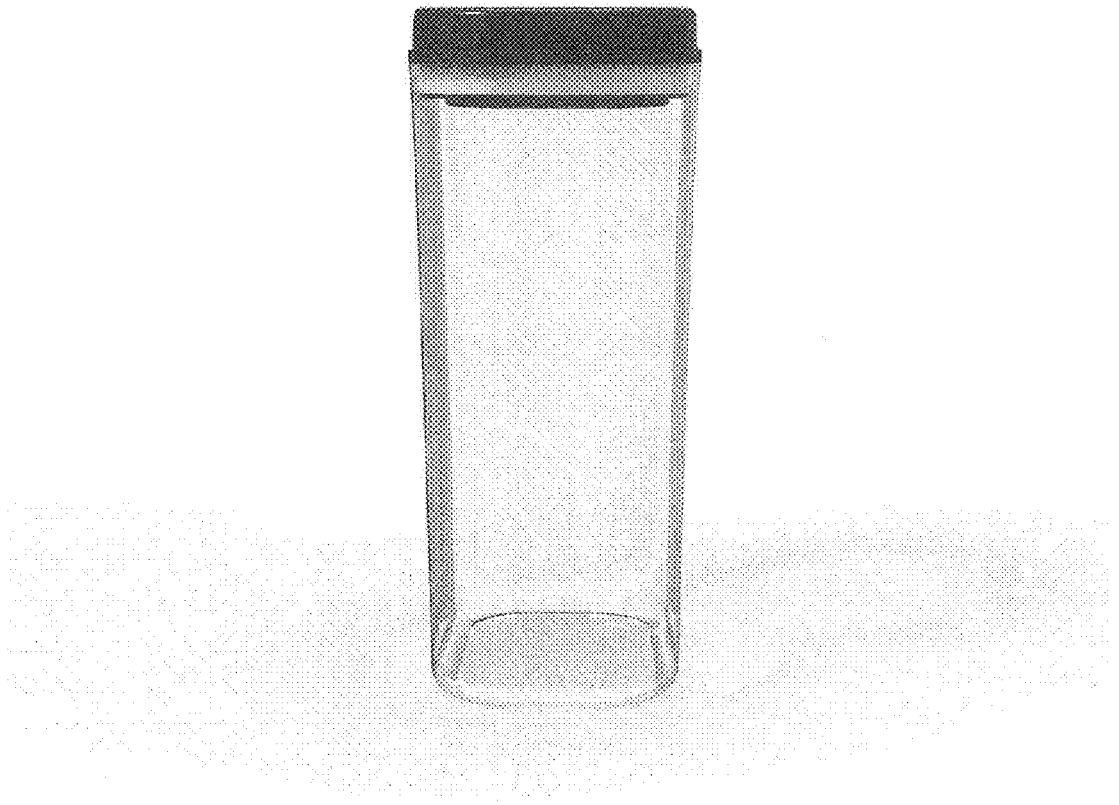
Figure 7E:
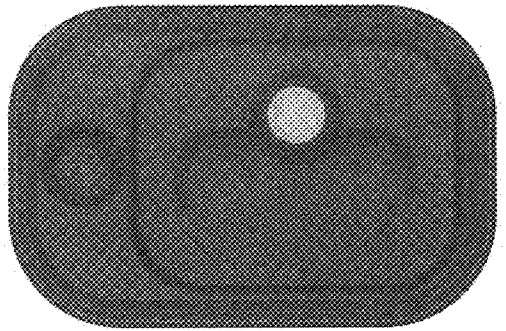
Figure 7F:
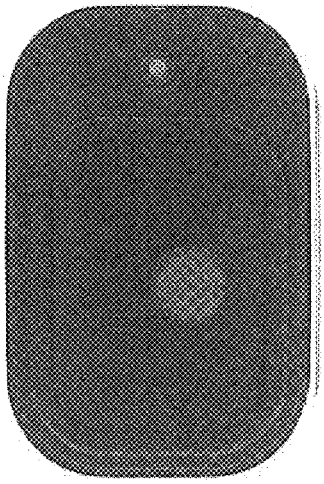
Figure 7G:
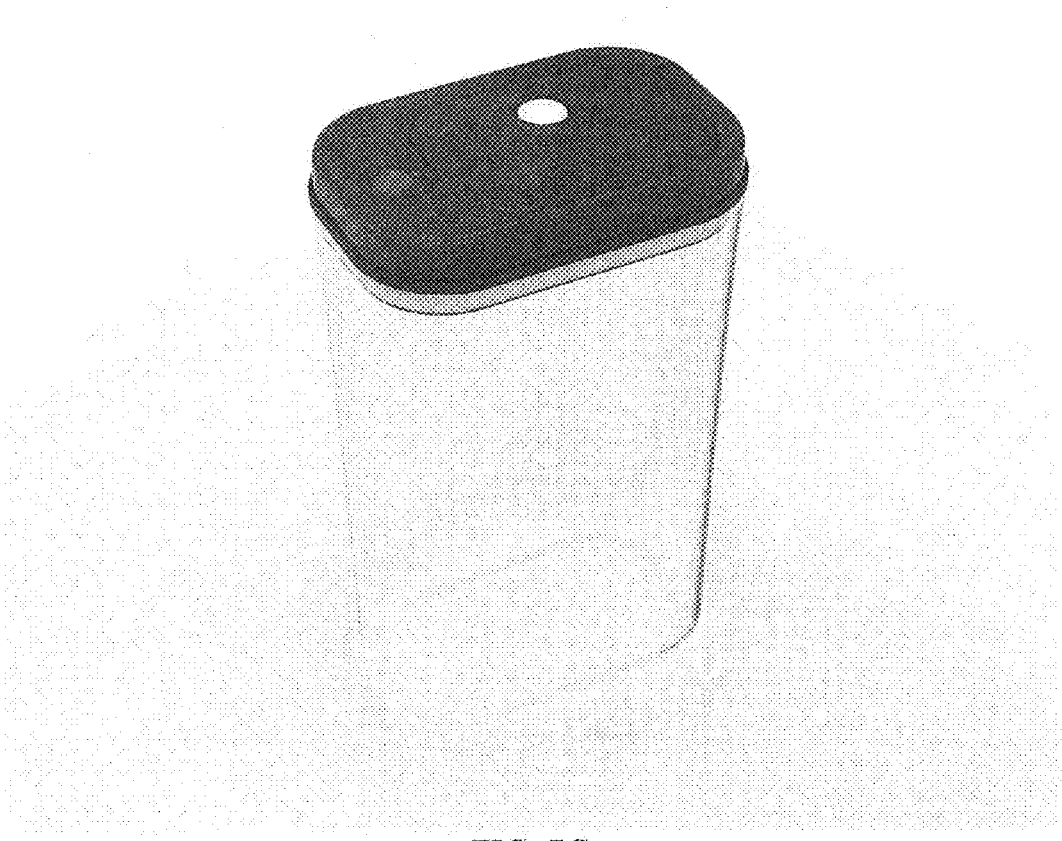
Figure 8A:
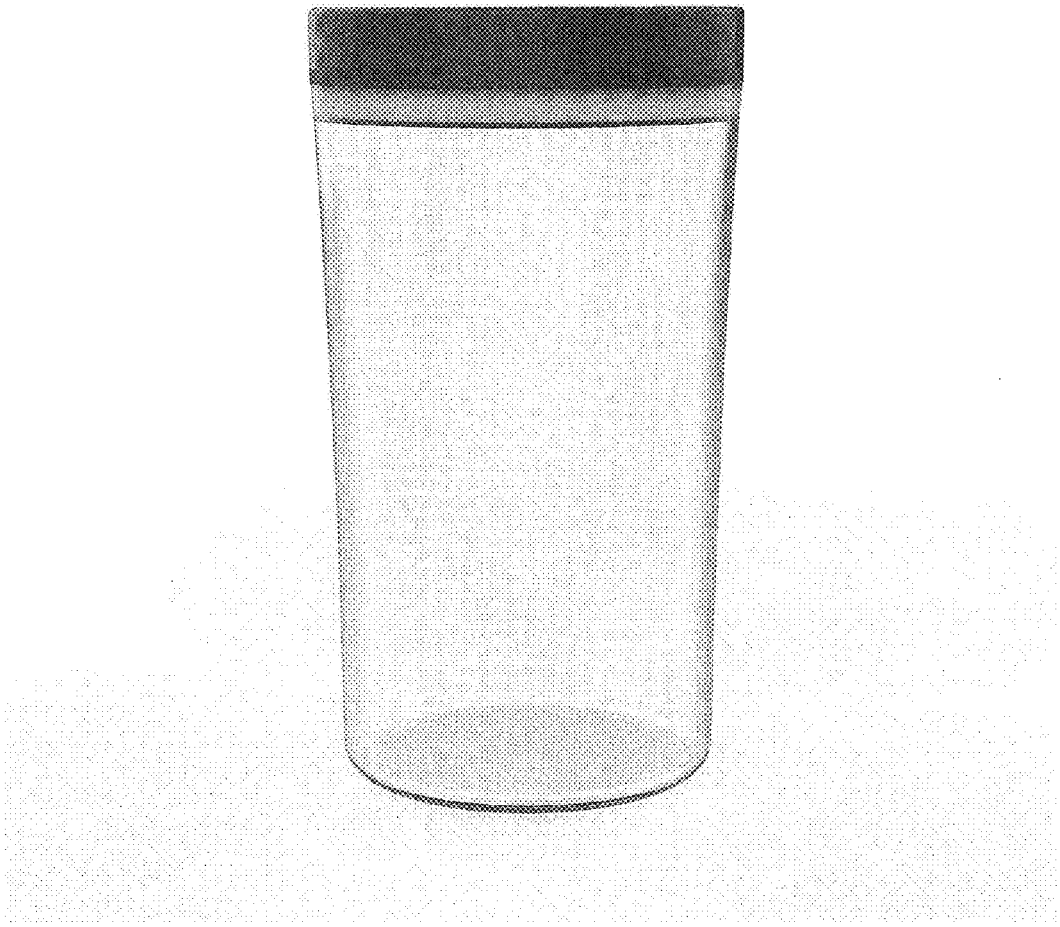
FIGS. 8A-8G illustrate a third embodiment of a round container with a bellows-equipped lid according to the presently disclosed invention.
Figure 8B:
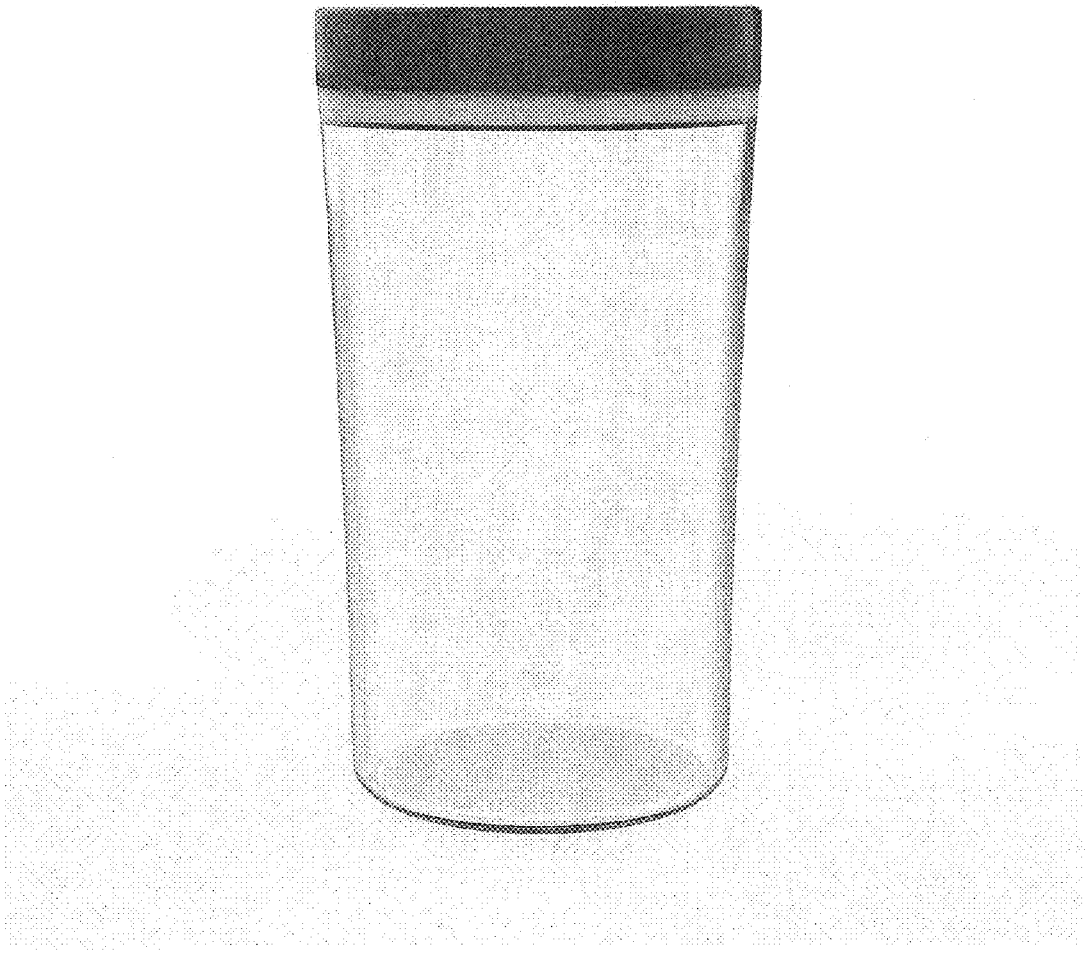
Figure 8C:
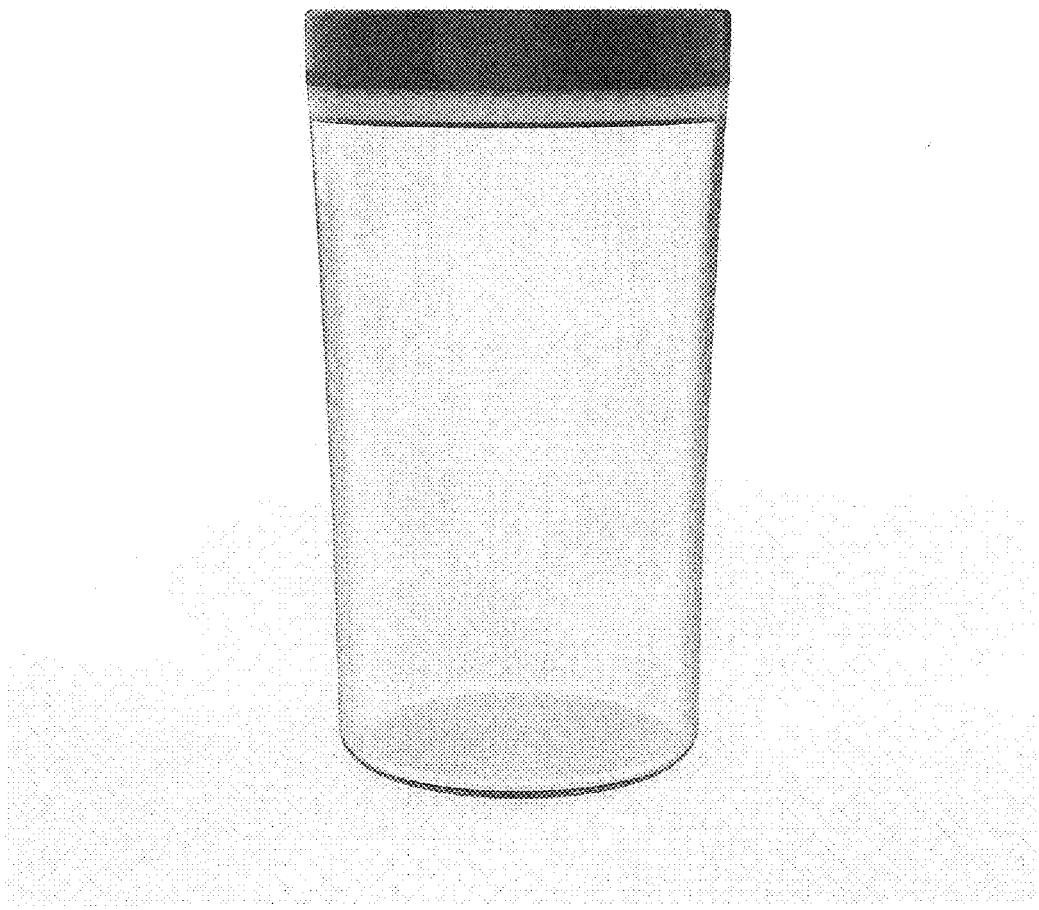
Figure 8D:
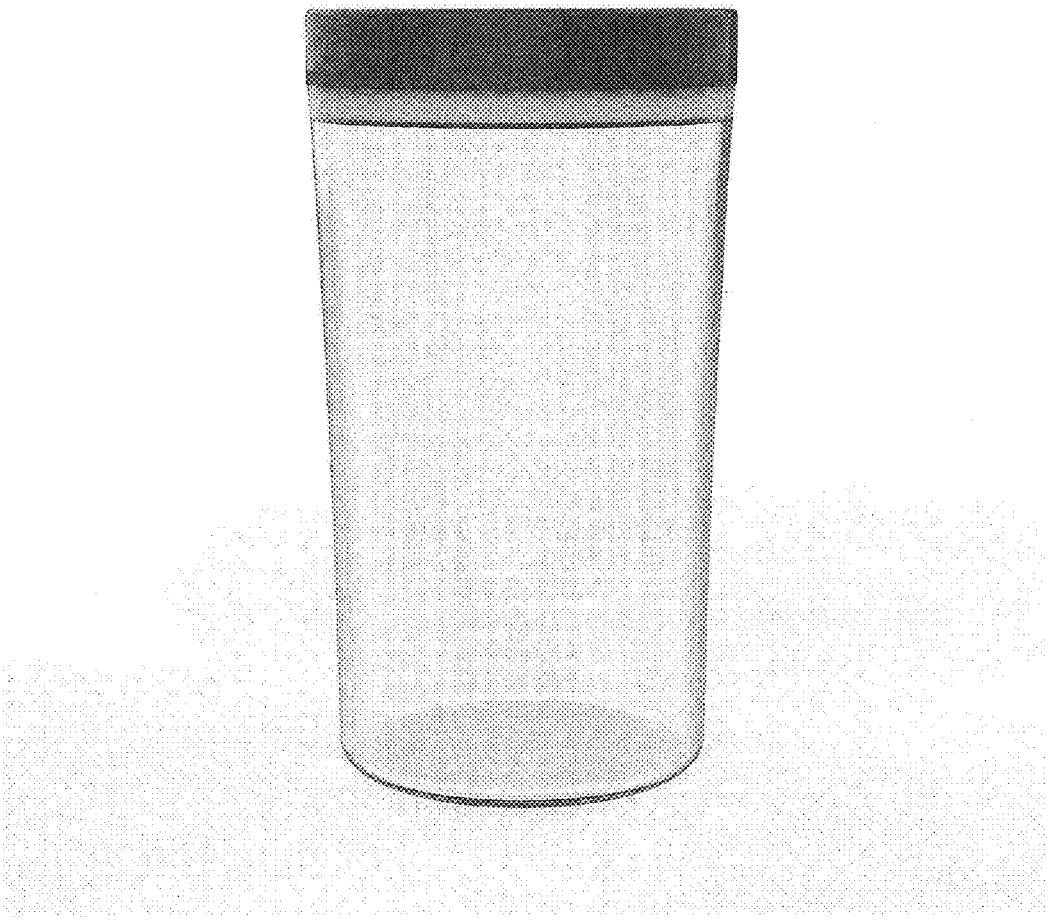
Figure 8E:
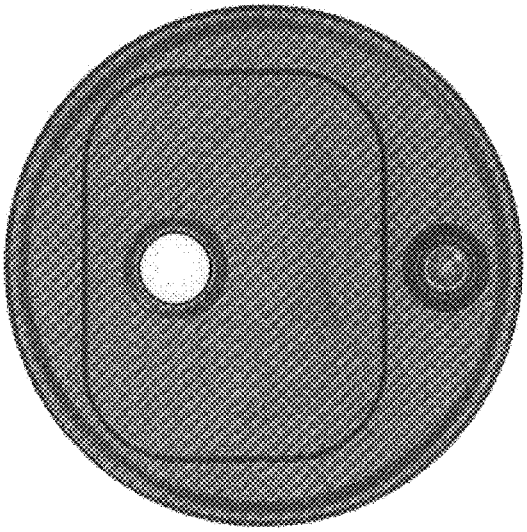
Figure 8F:
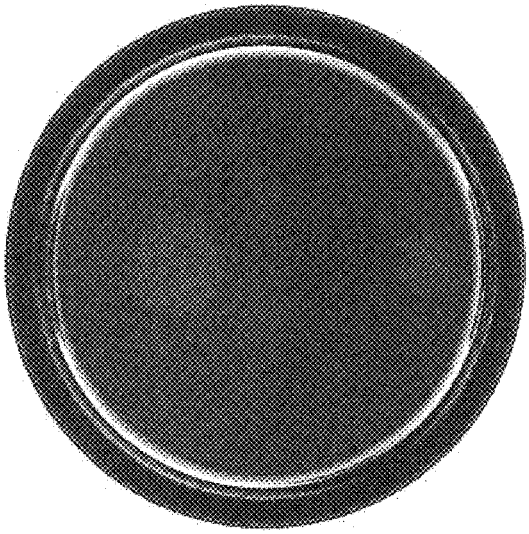
Figure 8G:
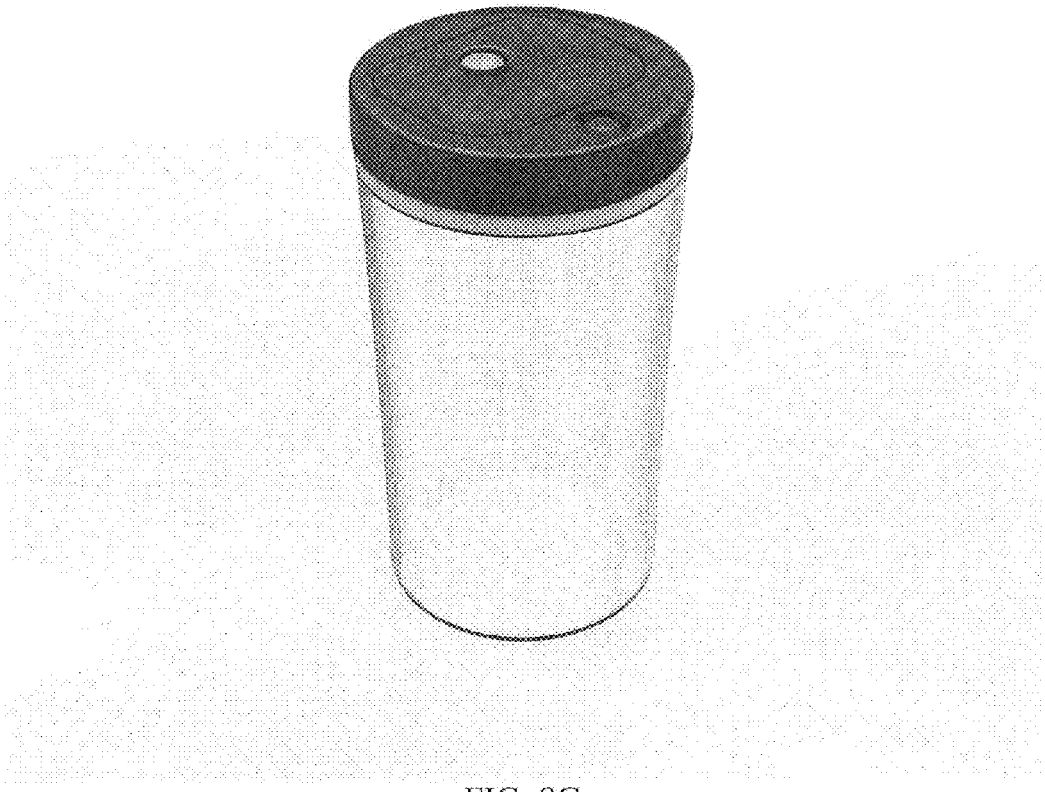
Figure 9A:
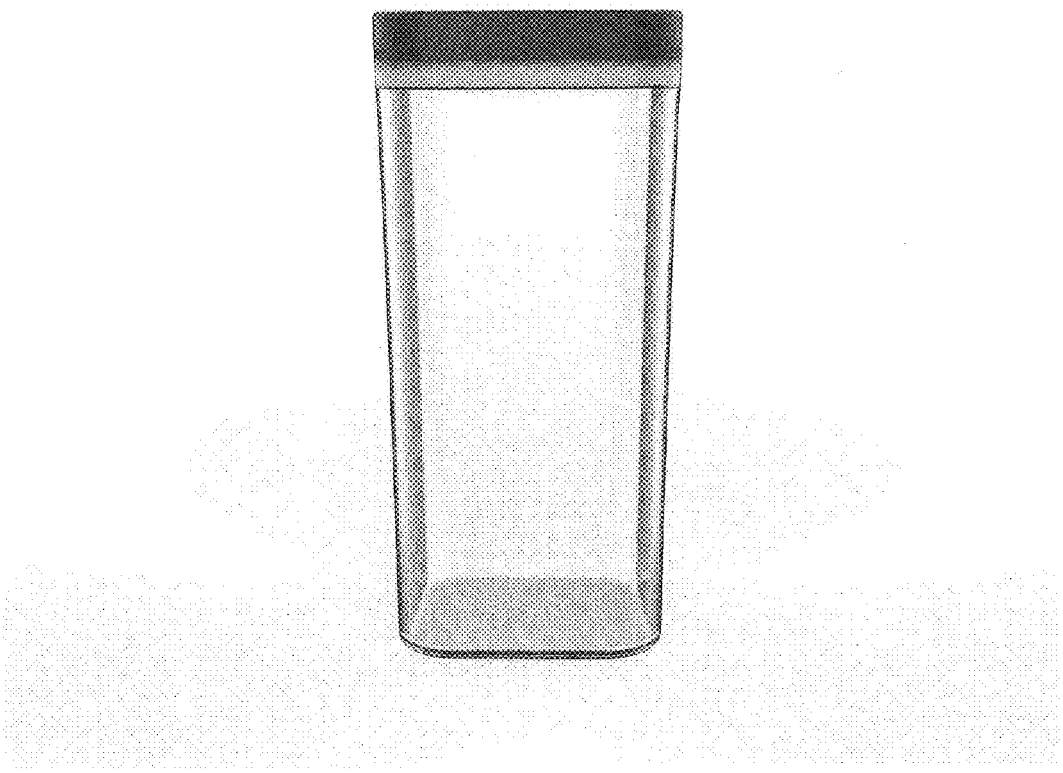
FIGS. 9A-9G illustrates a third embodiment of a square container with a bellows-equipped lid according to the presently disclosed invention.
Figure 9B:
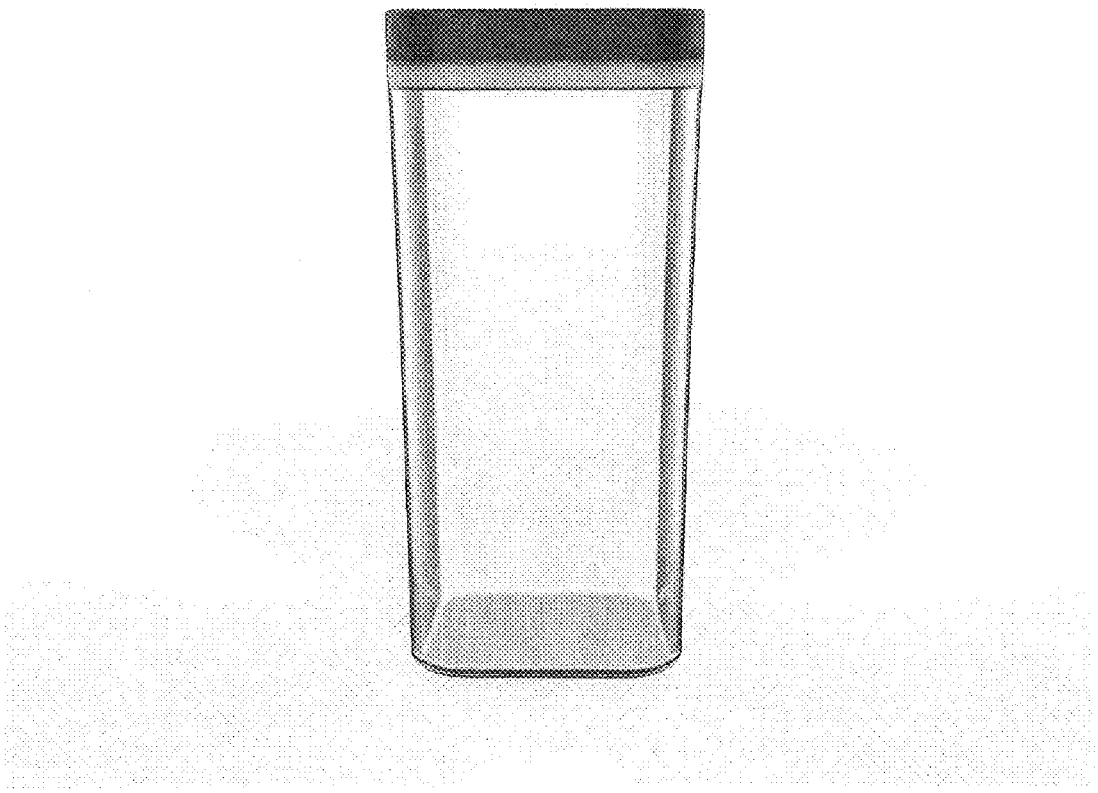
Figure 9C:
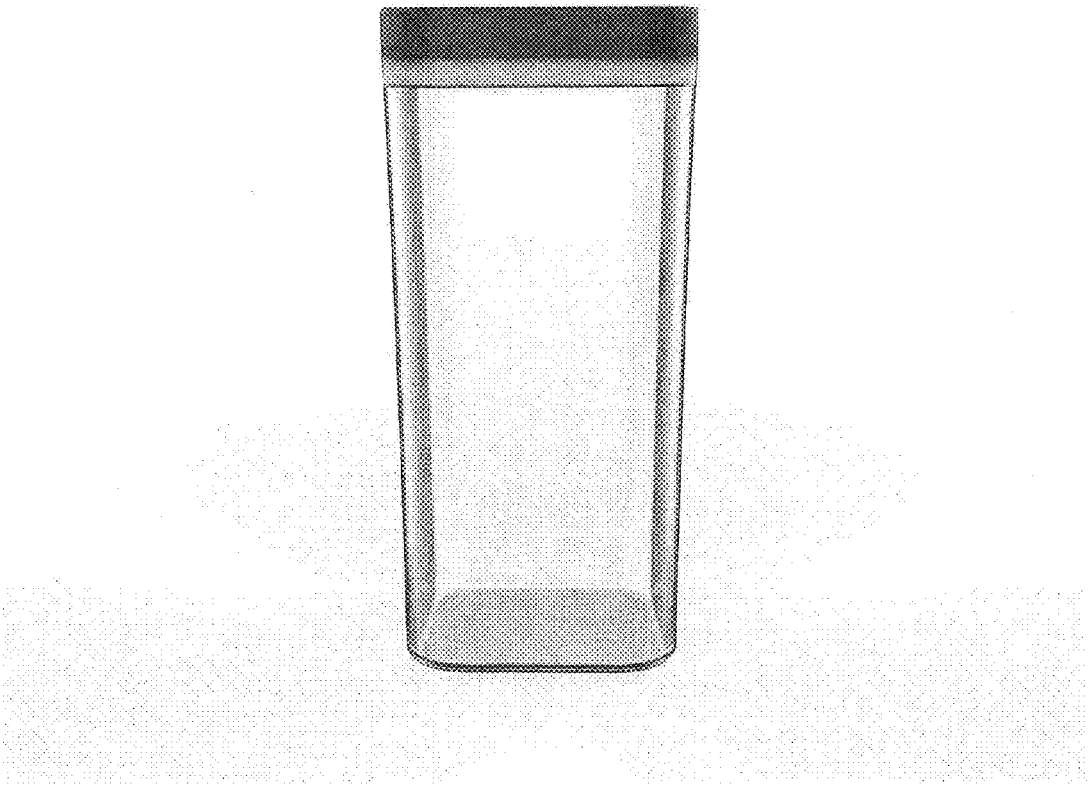
Figure 9D:
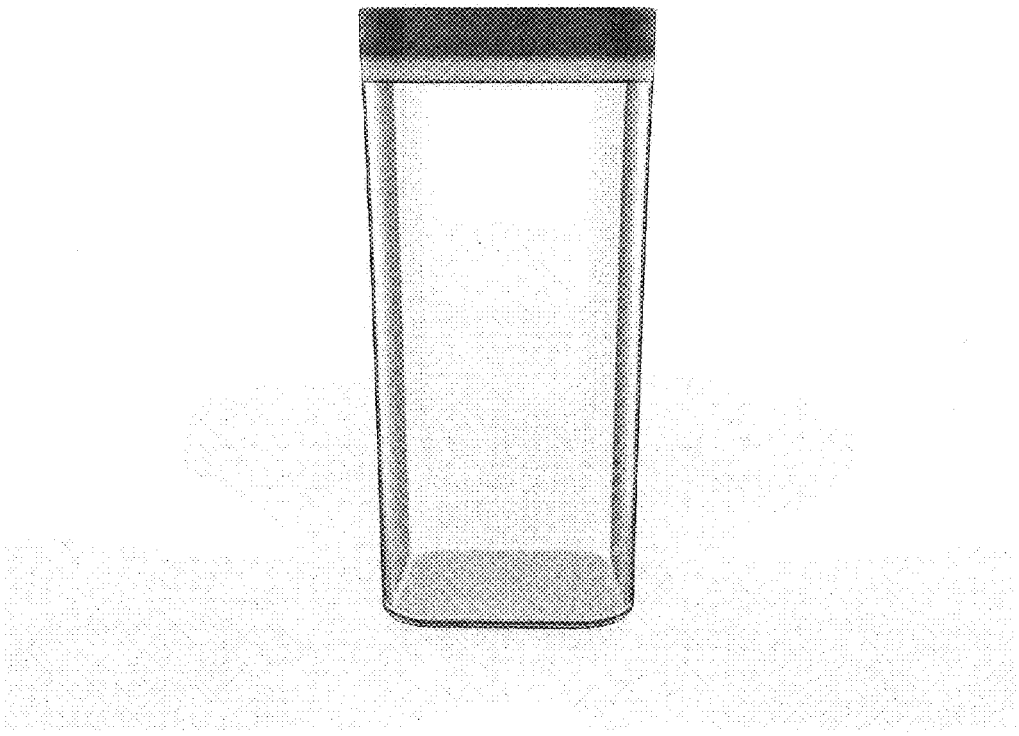
Figure 9E:
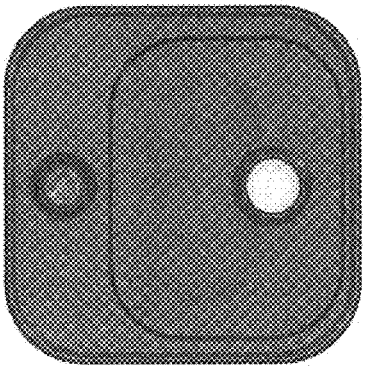
Figure 9F:
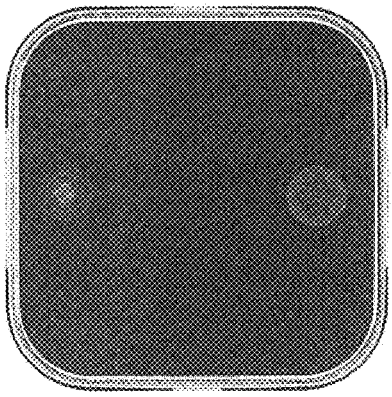
Figure 9G:
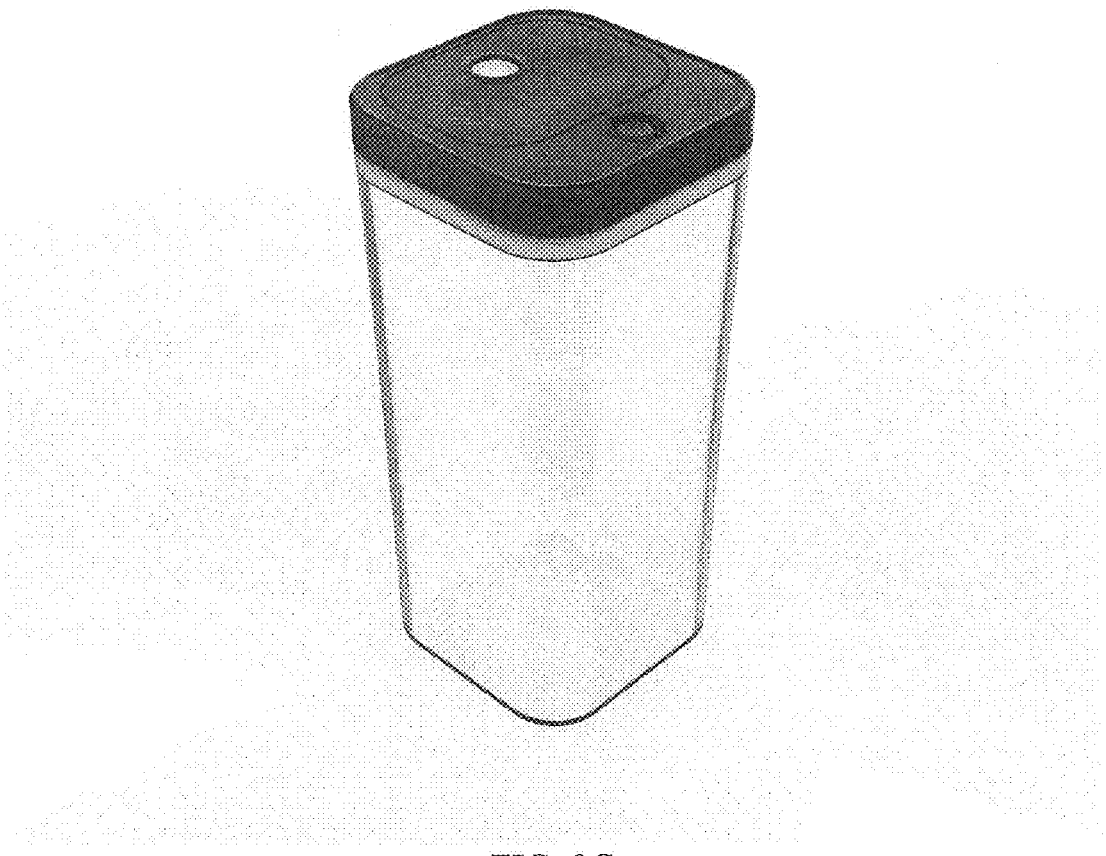
Figure 10A:
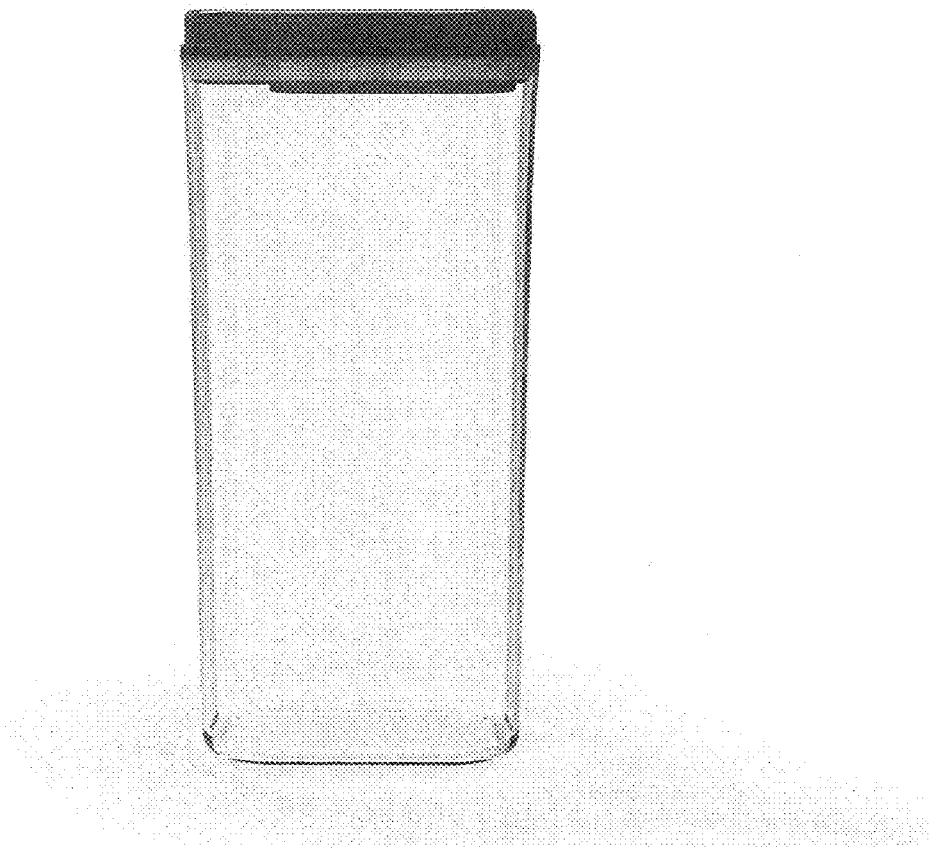
FIGS. 10A-10G illustrate a fourth embodiment of a rectangular container with a bellows-equipped lid according to the presently disclosed invention.
Figure 10B:
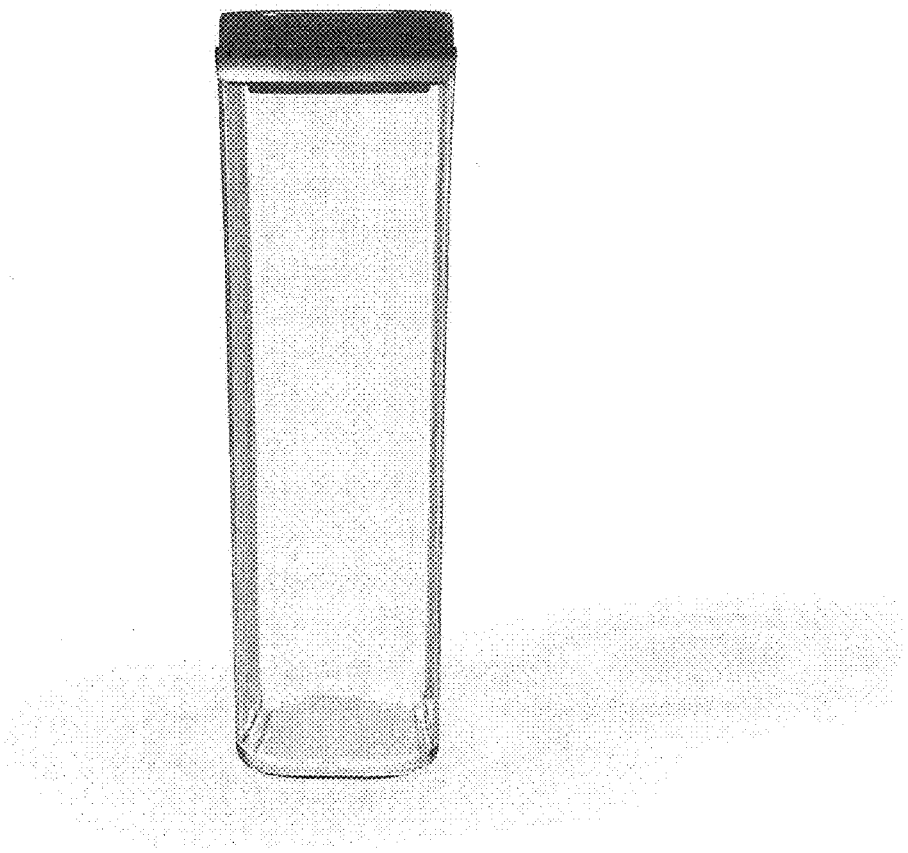
Figure 10C:
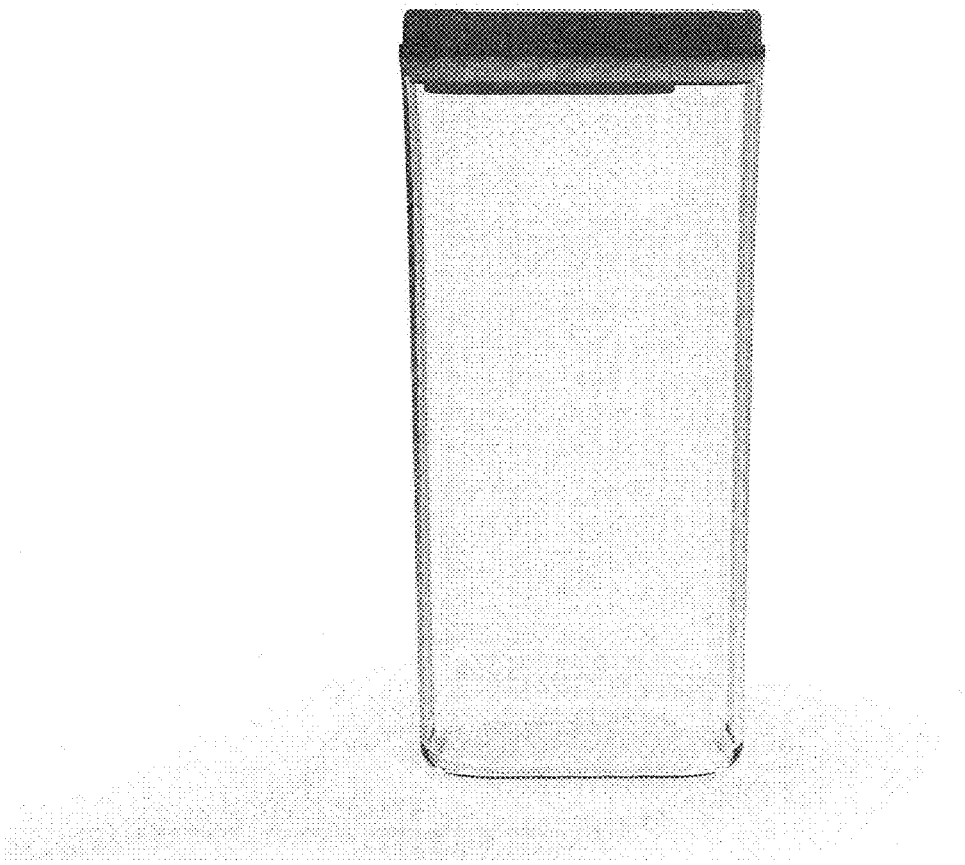
Figure 10D:
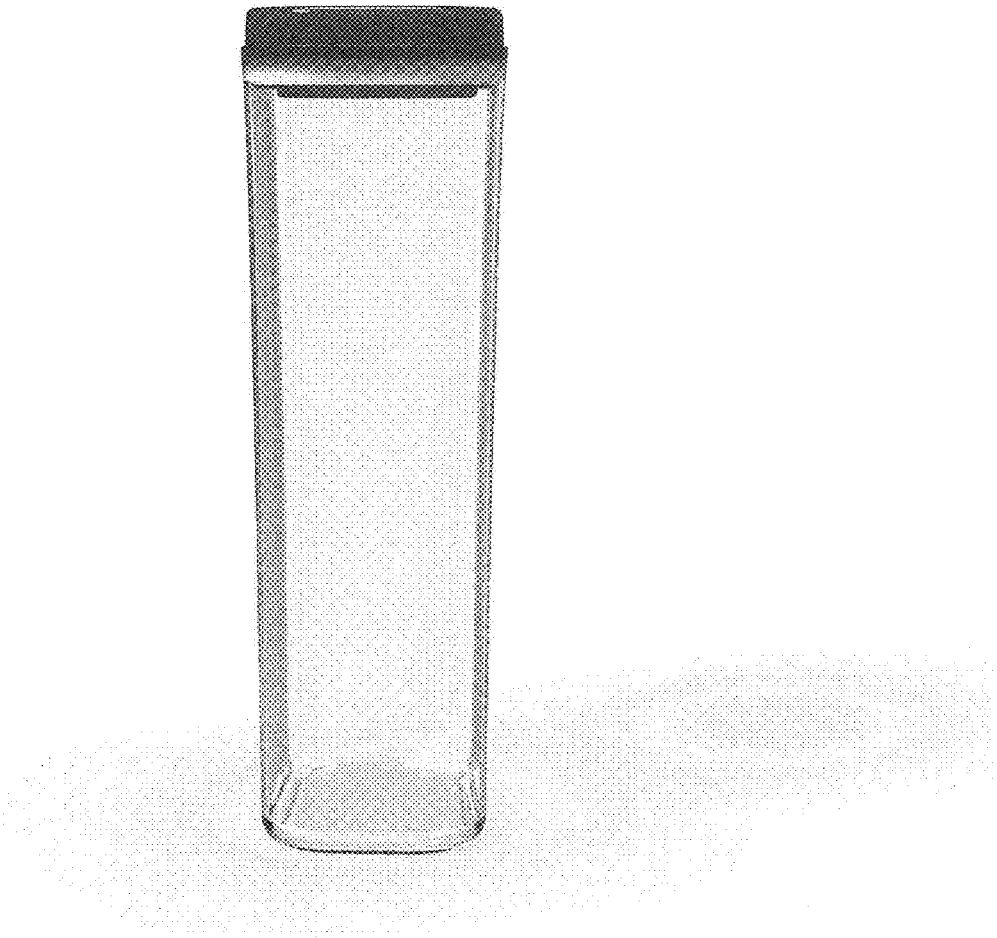
Figure 10E:
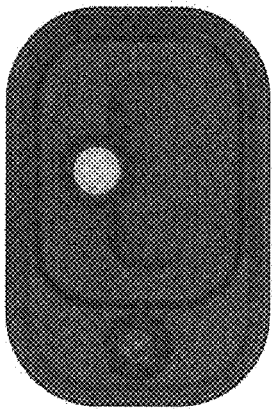
Figure 10F:
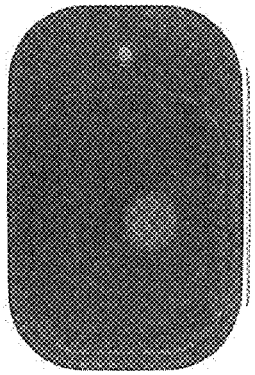
Figure 10G:
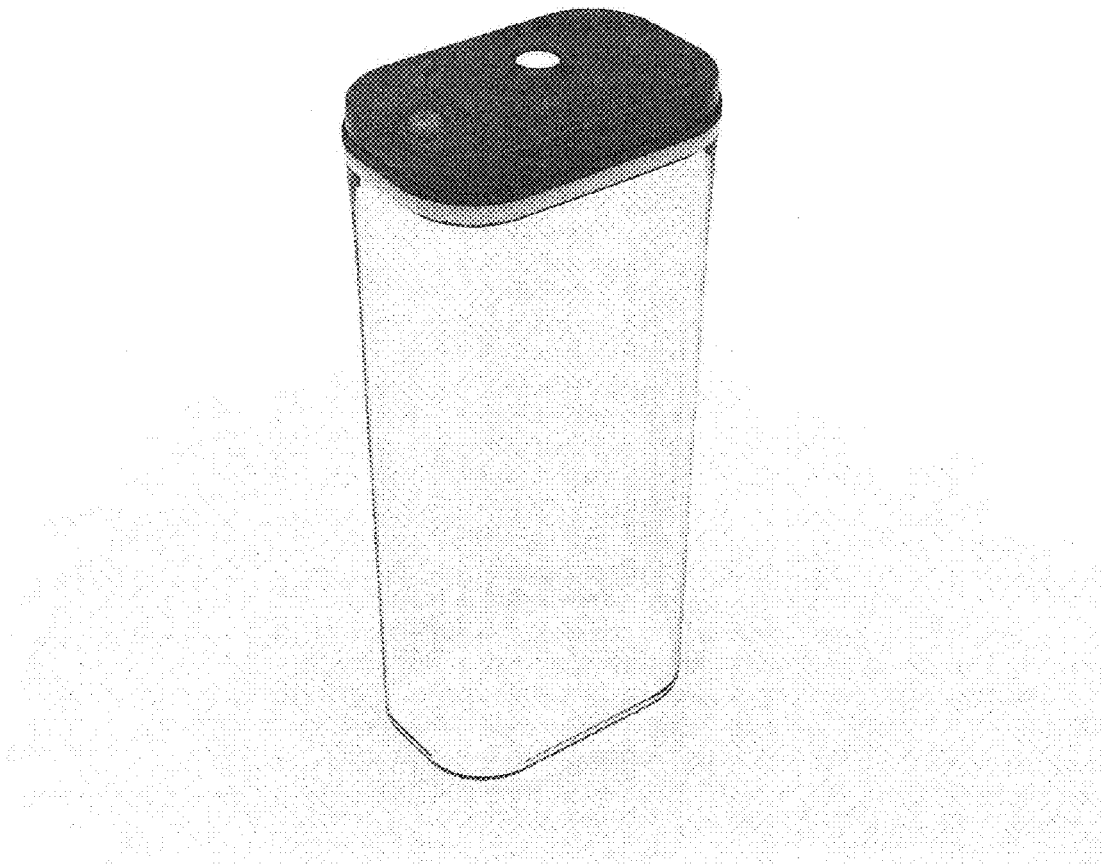
Figure 11A:
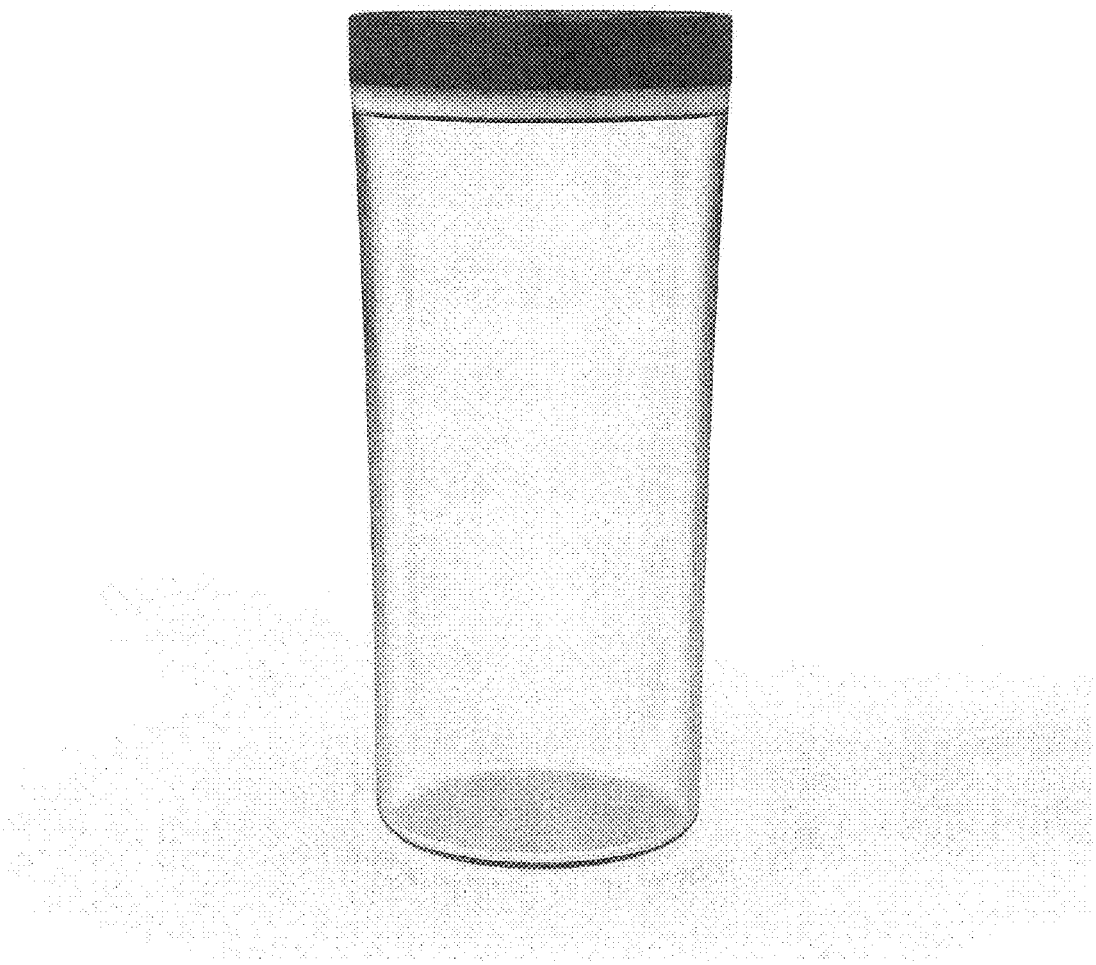
FIGS. 11A-11G illustrate a fourth embodiment of a round container with a bellows-equipped lid according to the presently disclosed invention.
Figure 11B:
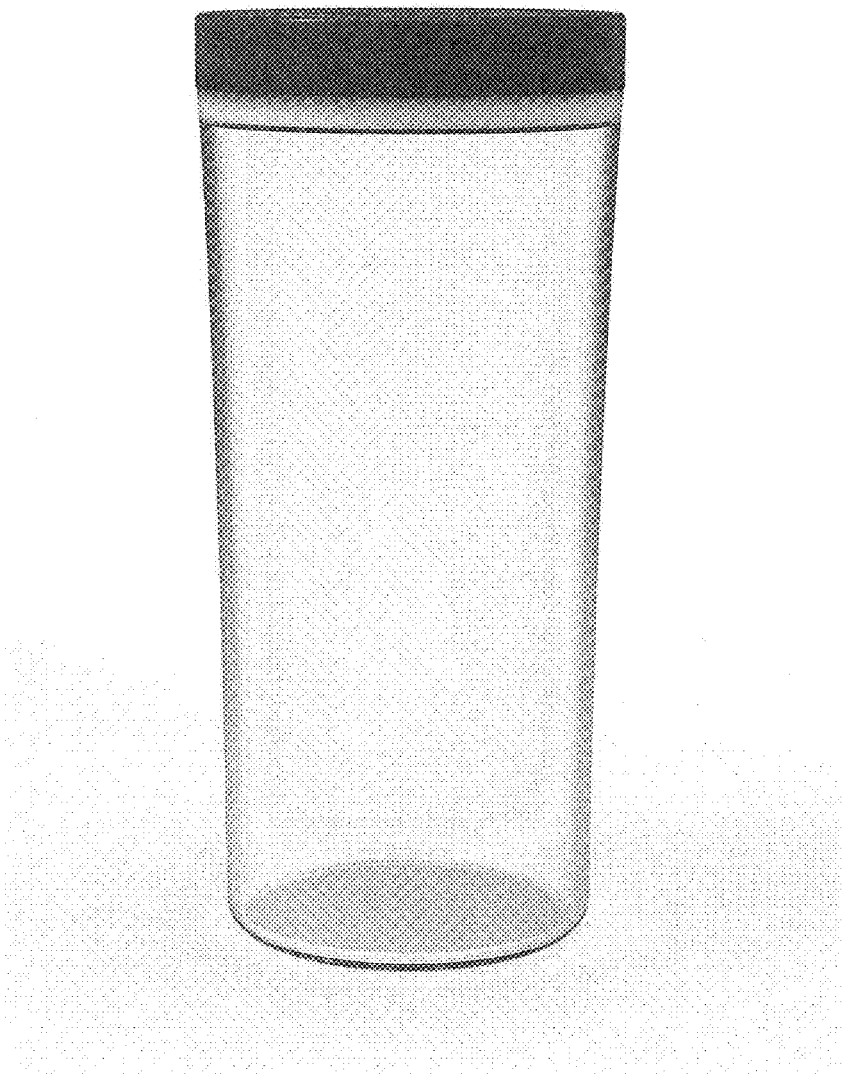
Figure 11C:
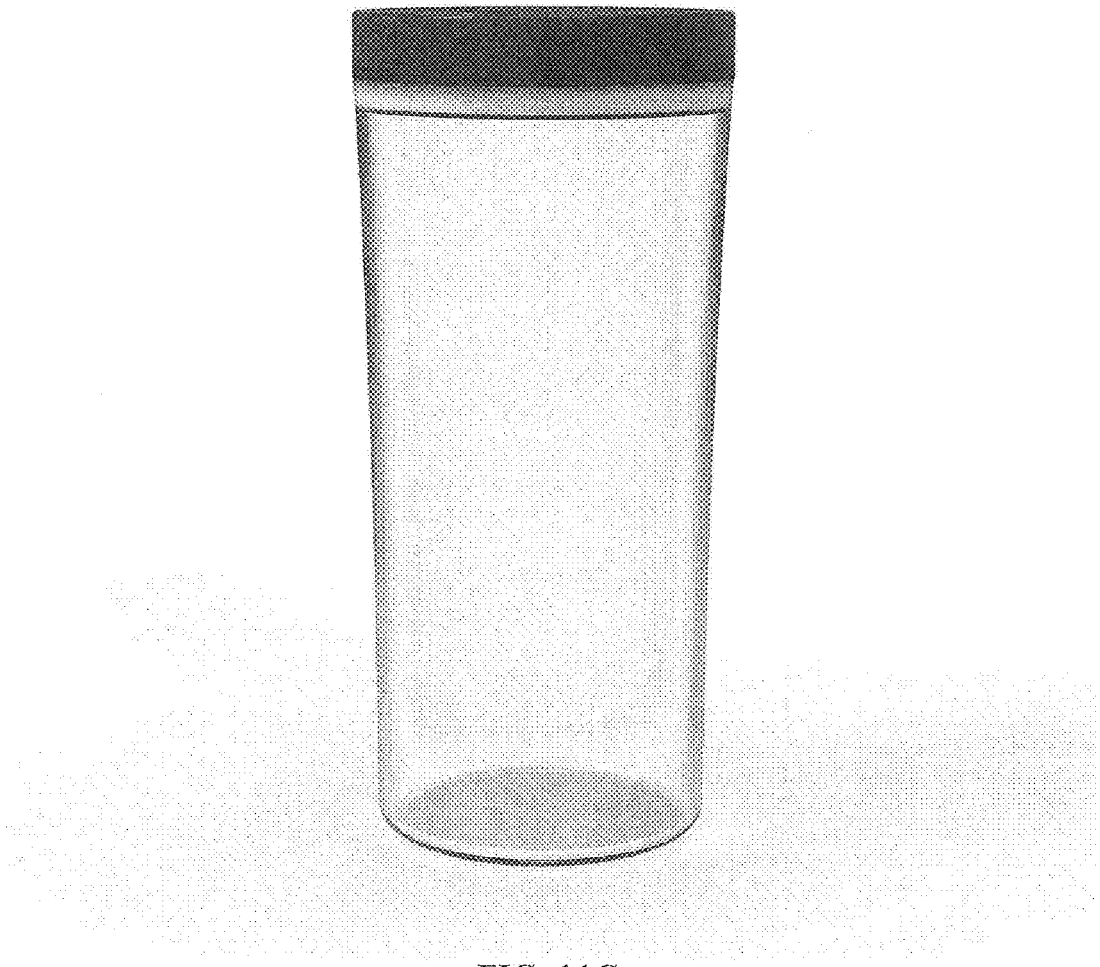
Figure 11D:
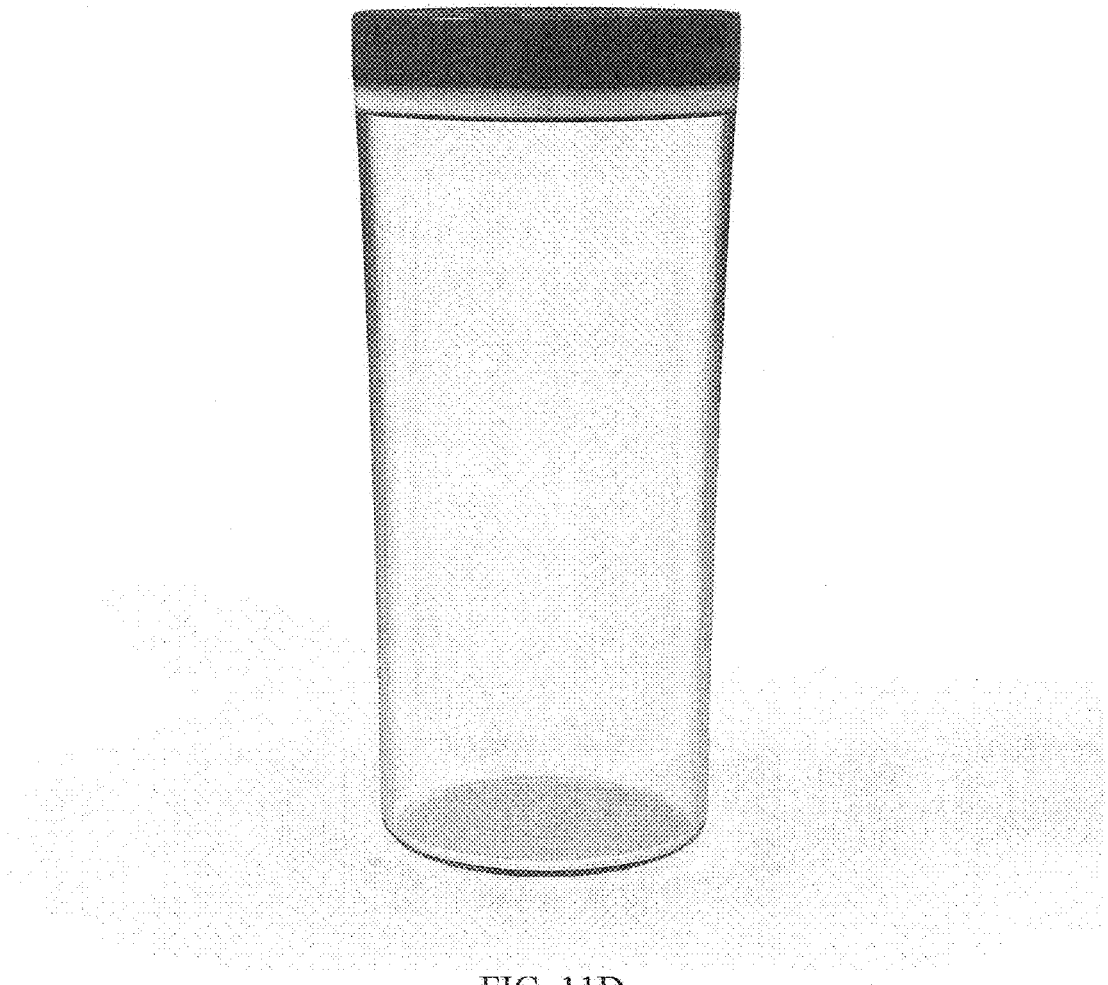
Figure 11E:
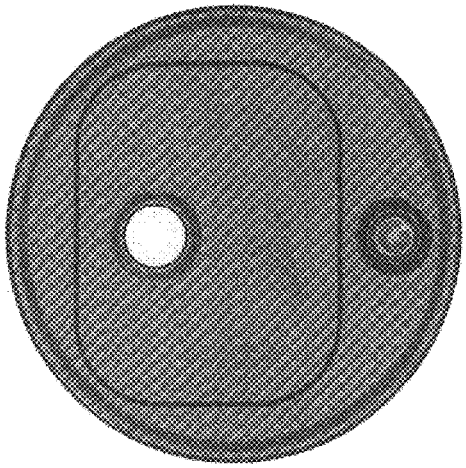
Figure 11F:
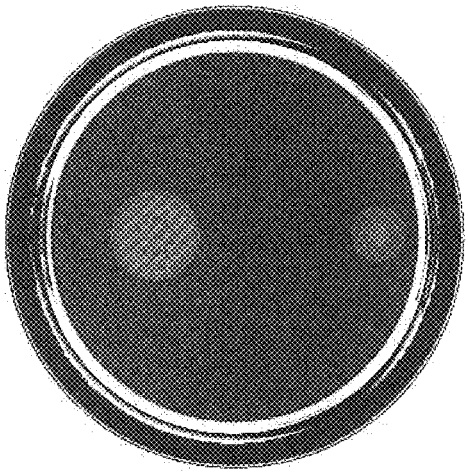
Figure 11G:
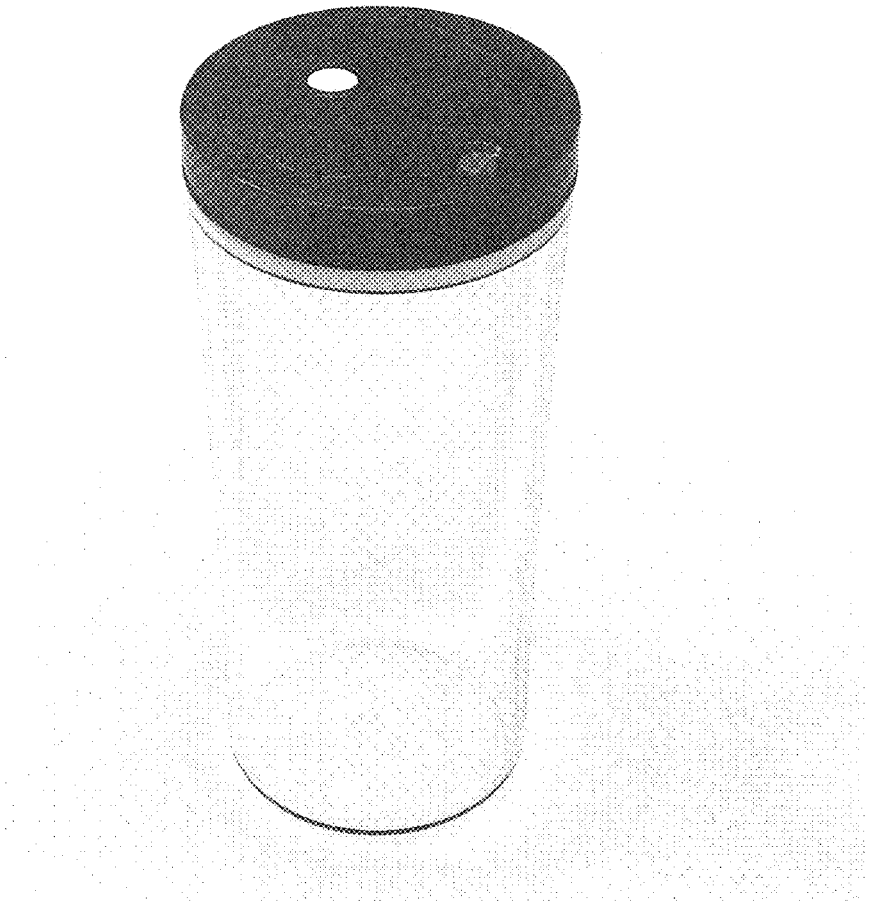
Figure 12A:
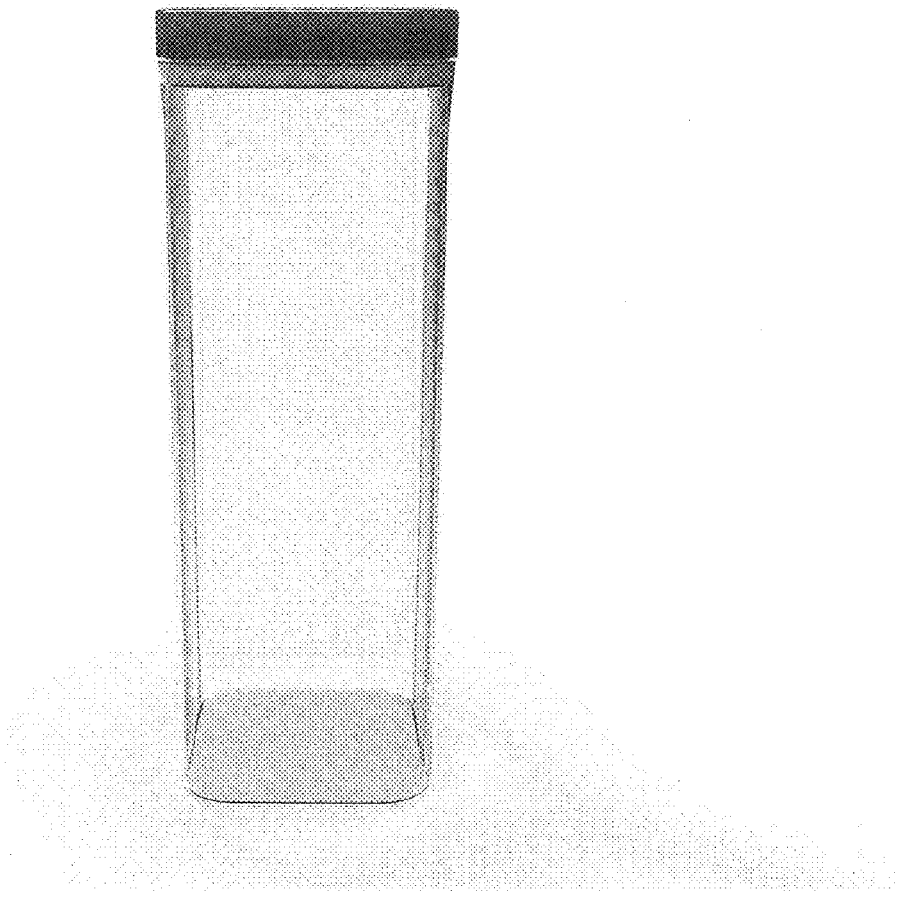
FIGS. 12A-12G illustrates a fourth embodiment of a square container with a bellows-equipped lid according to the presently disclosed invention.
Figure 12B:
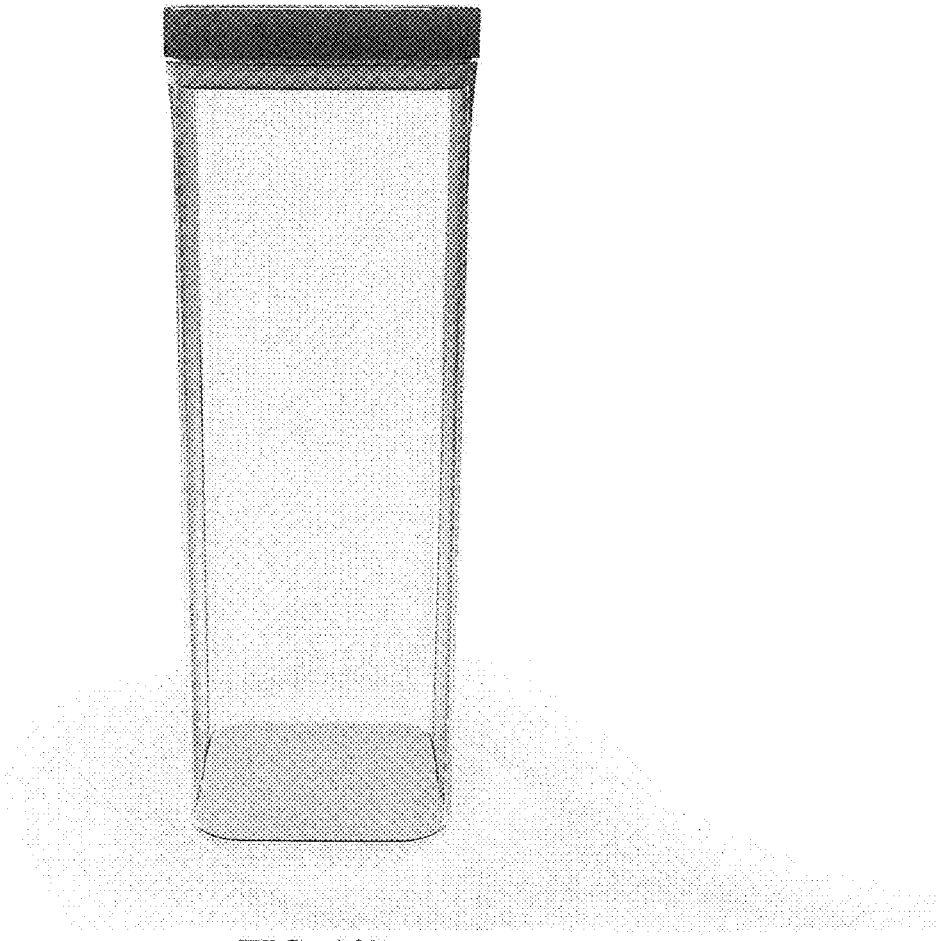
Figure 12C:
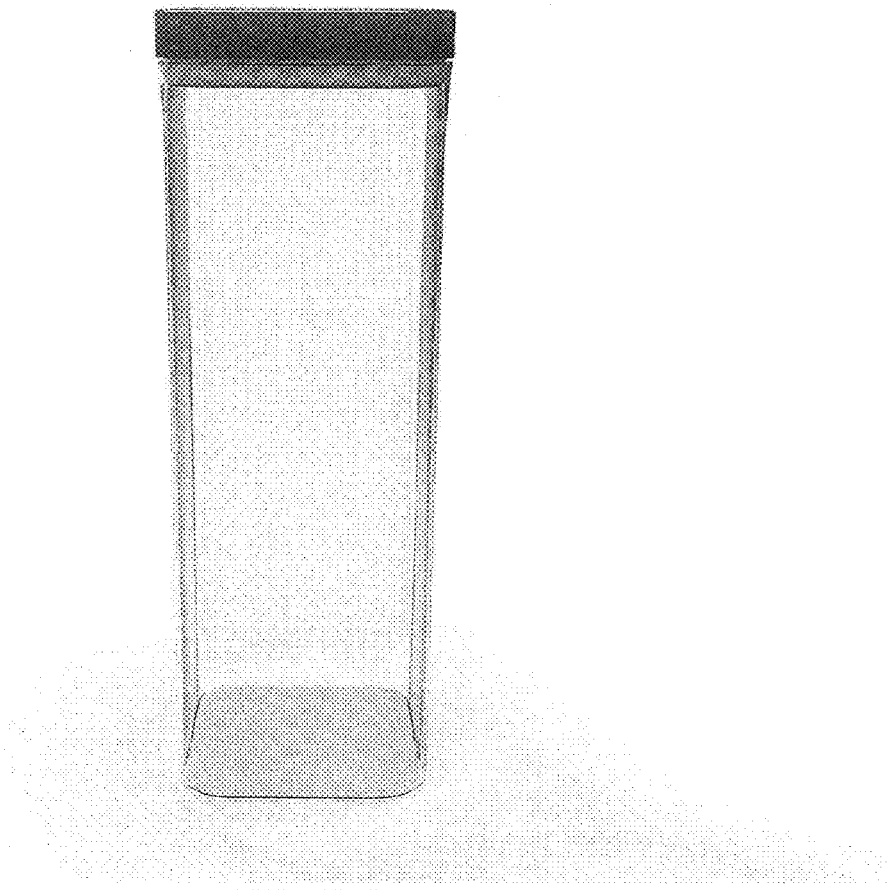
Figure 12D:
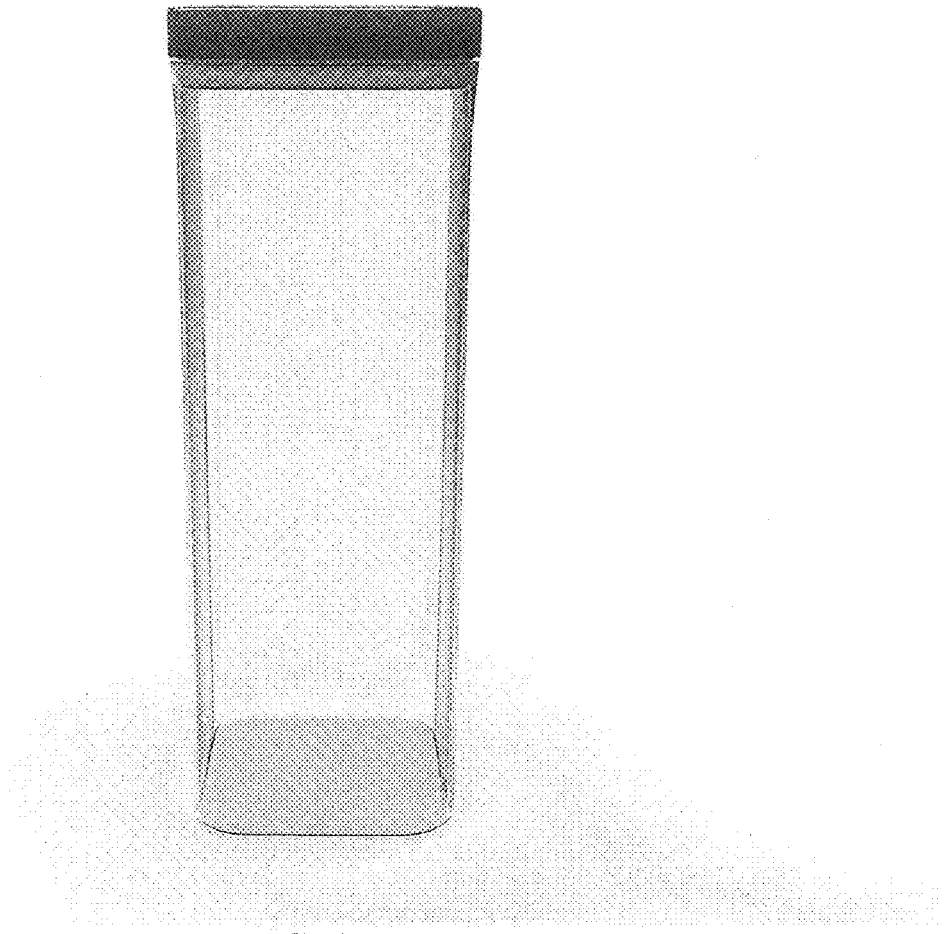
Figure 12E:
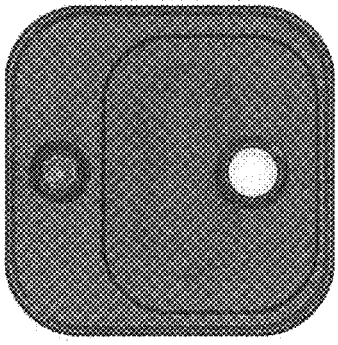
Figure 12F:
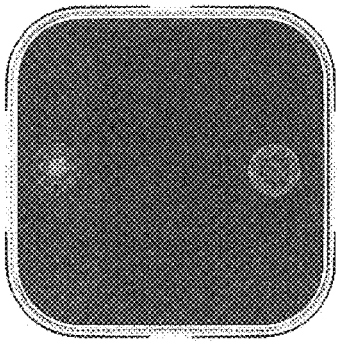
Figure 12G:
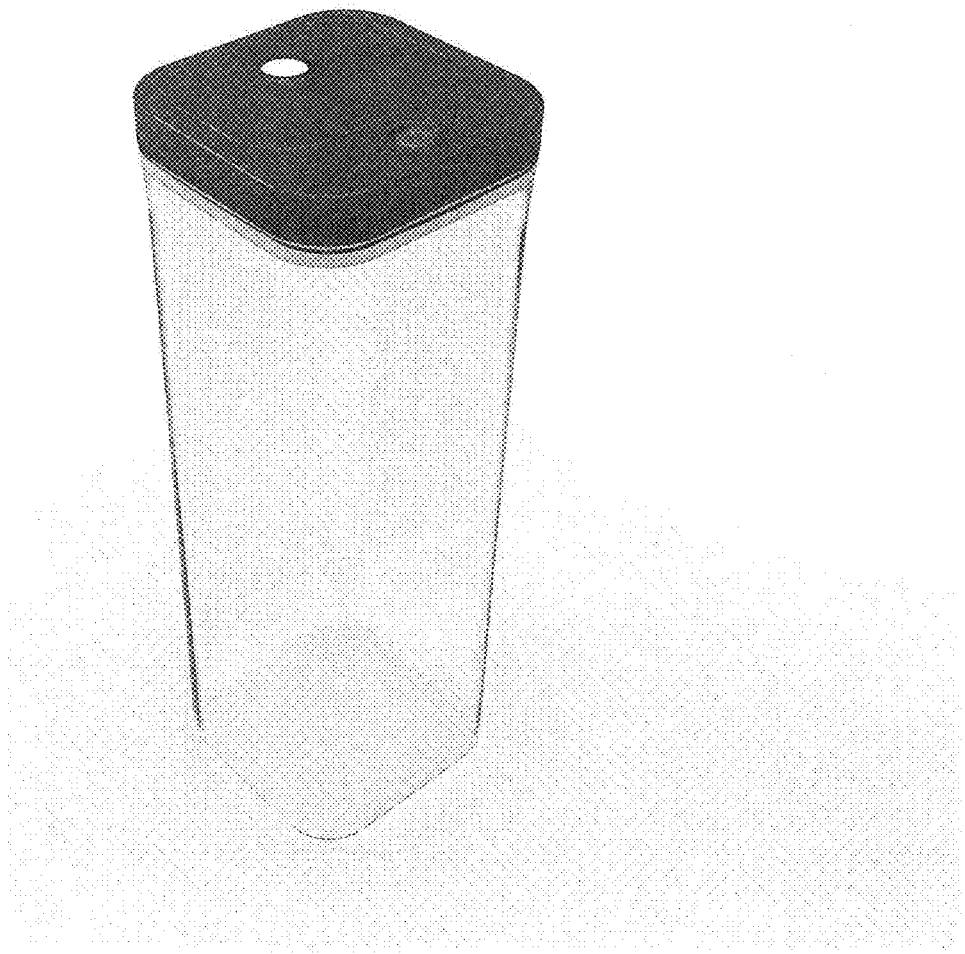
Figure 13:
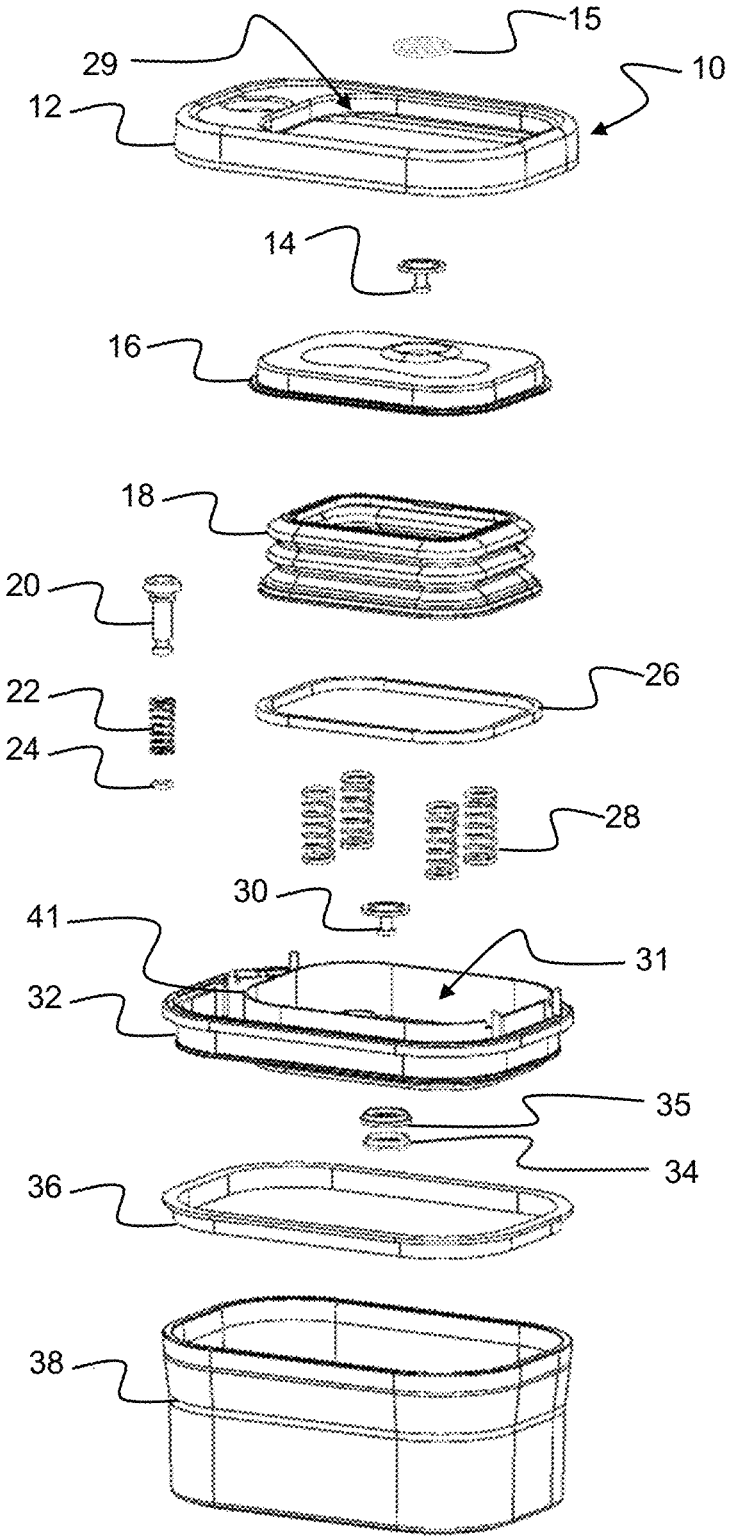
FIG. 13 is an exploded, perspective view of a rectangular container with a bellows-equipped lid, similar to the embodiment of FIGS. 1A-1G, according to the presently disclosed invention.
Figure 14A:
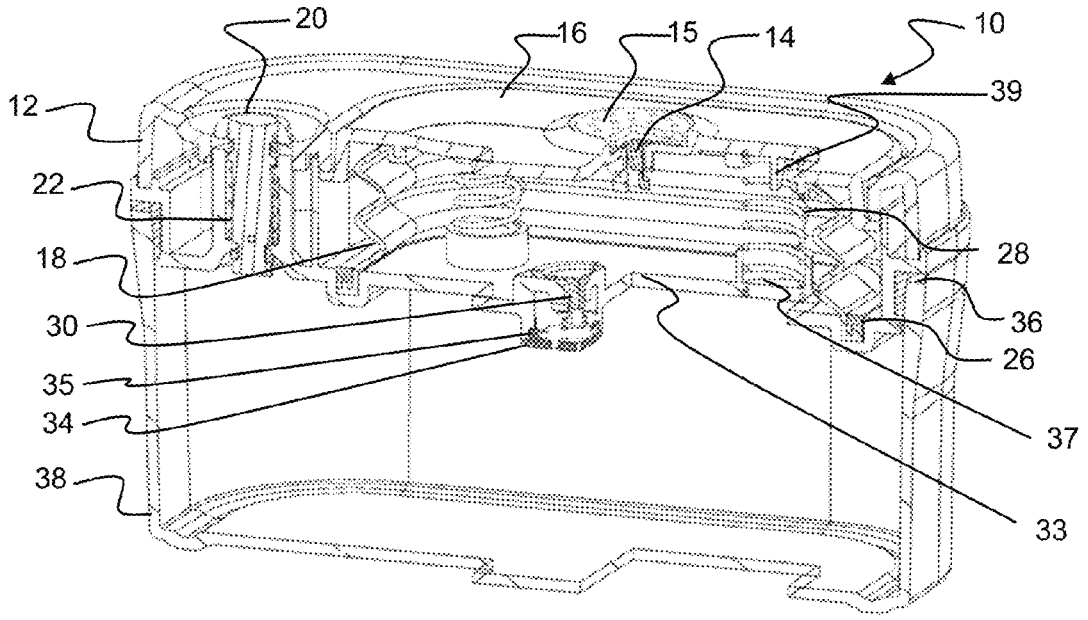
FIG. 14A is a cut-away perspective view of the container and lid of FIG. 13 prior to actuation of the bellows.
Figure 14B:
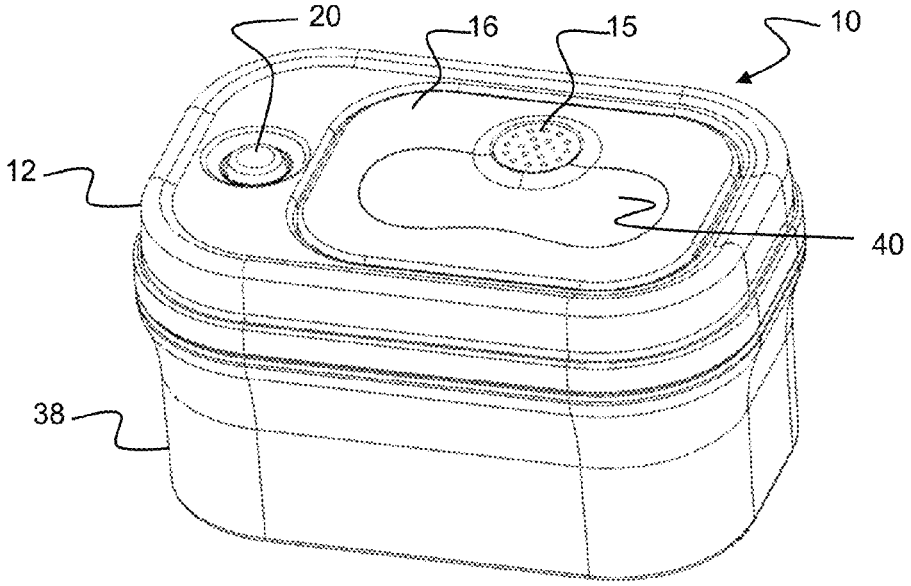
FIG. 14B is a perspective view of the container and lid of FIG. 13 prior to actuation of the bellows.

While the depicted lids have a shape, viewed from above or below, that compliments the opening or mouth of the respective container, the fundamental components and operative nature of each lid is the same. With reference to FIGS. 13, 14A and 14B, a rectangular lid assembly 10 is shown, though the following description is applicable to all of the lids illustrated in FIGS. 1A through 12G. Starting from the upper surface of the lid assembly, an upper cover 12 has a bellows aperture 29 for receiving a bellows plate 16 therein. Disposed within the bellows plate is a first one-way valve 14 used to evacuate air from a pump chamber into the atmosphere as the bellows plate is manually depressed relative to the upper cover. Overlying the one-way valve is a vented cover plate 15. The cover plate is provided with a plurality of vent holes dimensioned to enable air to pass therethrough unimpeded while at the same time inhibiting the introduction of particulates that could otherwise interfere with the operation of the one-way valve.

A lower peripheral surface of the bellows plate 16 is in air-tight contact with a bellows 18, which in turn has a lower peripheral surface in contact with a sealing ring 26. The sealing ring is disposed on a floor surface 33 within a cavity 31 formed within a lower cover 32 such that a pump chamber is formed between the bellows plate, bellows, sealing ring, and lower cover cavity floor surface. The cavity is defined by the floor surface and vertically extending walls 41 projecting upwardly from the floor surface. An upper extent of the vertically extending walls sealingly mates with a lower peripheral edge of the upper cover 12 defining the bellows aperture 29.

In the pump chamber, through the lower cavity floor surface, is a second one-way valve 30 having an associated perforated valve cover 34. The perforations in the valve cover enable air to flow through the second one-way valve. Disposed between the perforated valve cover and the second one-way valve is a waterproof diaphragm 35 formed of a disc of plastic porous material having a porosity selected to enable the flow of gaseous molecules therethrough but to inhibit the flow of liquids. Thus, the diaphragm inhibits the flow of liquid into the bellows or pump chamber. A thickened ring of material is formed on the peripheral edge of the diaphragm to enable a secure fluid-proof seal between the perforated valve cover and the second one-way valve. The second valve is used to evacuate air from within the container beneath the lid assembly into the pump chamber after the bellows plate has been manually depressed and released as the resilient members urge the bellows plate upward in the absence of manual compression.

Also within the pump chamber are a plurality of resilient members 28, such as compression coil springs, each oriented to have a substantially vertical axis of symmetry and travel.

As illustrated, four springs are employed. Each is radially displaced from a vertical axis of symmetry of the lid assembly 10. Preferably, the radial displacements are equal in length. The springs are in contact with an underside of the bellows plate 16 and the lower cover cavity floor surface 33. Physical features formed on or in the underside of the bellows plate and/or on or in the cavity floor surface. As illustrated examples of such features, each spring is retained in place with respect to the bellows plate by a downwardly projecting post 39 and with respect to the cavity floor surface by an upwardly projecting socket 37. Other resilient members, such as leaf springs, can also be used, and some number other than four resilient members can be employed, though three is a preferred minimum number. Radially displacing the resilient members enables smooth vertical translation of the bellows plate even when pressure is applied at an angle to the vertical axis.

Disposed within and extending through the upper cover 12 and the lower cover 32 is a release valve 20 and associated resilient member 22 and sealing ring 24. The release valve is employed to selectively release the vacuum within a sealed container. A user manually depresses the release valve in a downward direction, against the resisting force of the respective spring 22, thus temporarily creating a physical space between the sealing ring on the lower extent of the release valve and the surrounding portion of the lower cover, allowing air from the surrounding atmosphere to enter the container beneath the lid assembly, thereby facilitating removal of the lid assembly 10. In one embodiment, the upper end of the release valve and the upper cover do not form an airtight seal.

The lid assembly 10 further comprises a peripheral interface seal 36 about the lower cover 32 that enables creation of an airtight seal between the lid assembly and the respective container 38 when installed therein. The interface seal may be provided with or comprised of one or more resilient rings of deformable material that facilitate the airtight seating of the lid assembly within the container opening.

In FIGS. 14A and 14B, the lid assembly 10 is disposed in the respective container 38 but the bellows plate 16 has not yet been manually operated by a user.

Figure 15A:
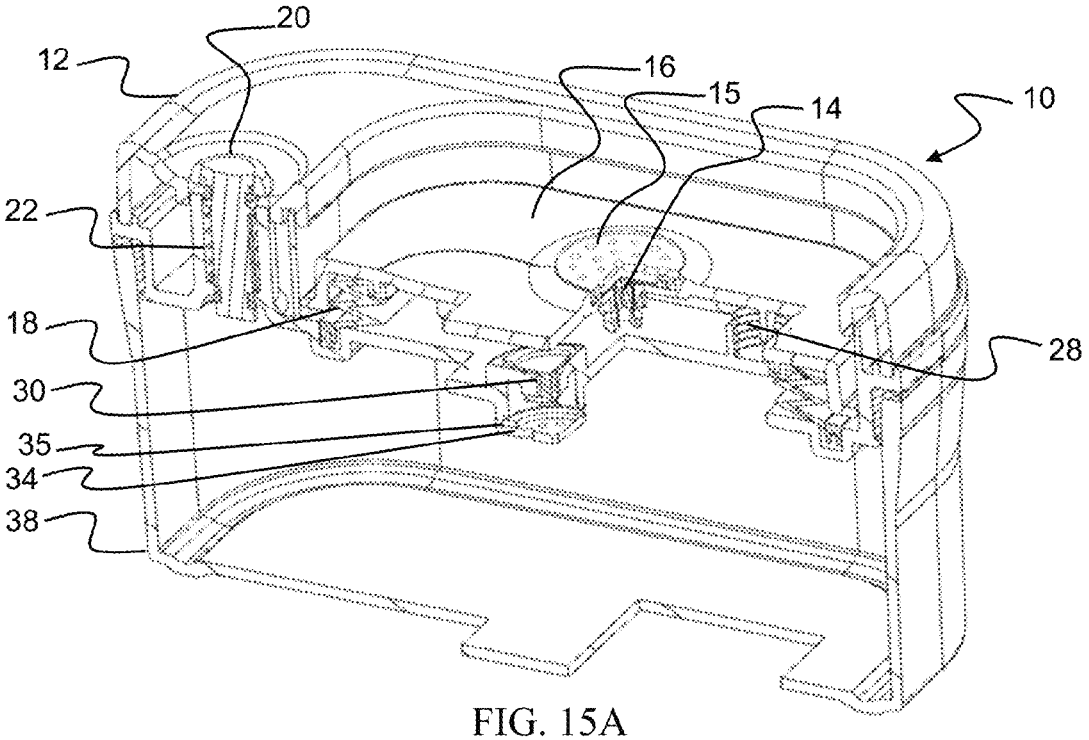
FIG. 15A is a cut-away perspective view of the container and lid of FIG. 13 after actuation of the bellows.
Figure 15B:
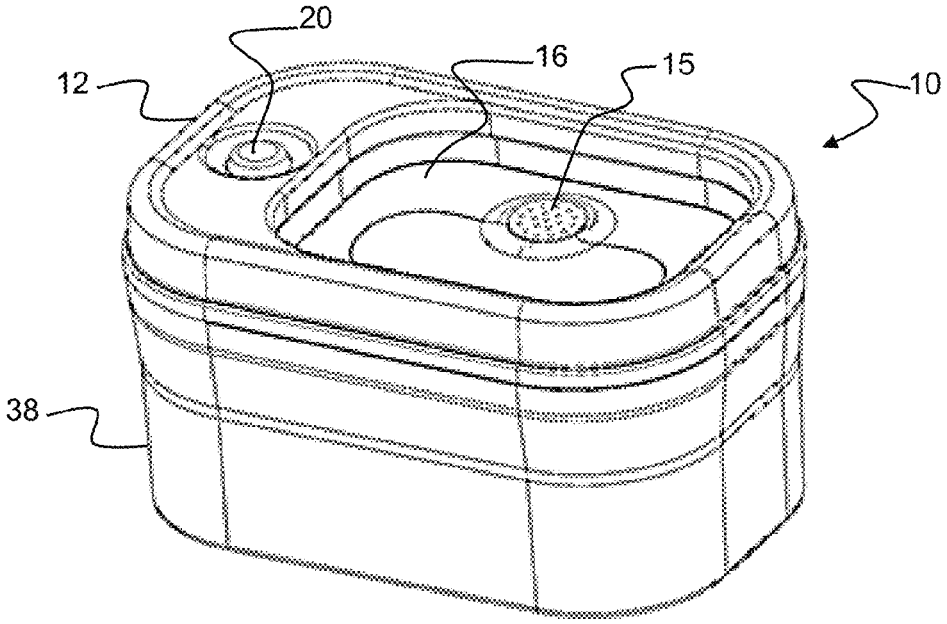
FIG. 15B is a perspective view of the container and lid of FIG. 13 after actuation of the bellows.

In FIGS. 15A and 15B, a user has pressed down upon or compressed the bellows plate 16, against the resistive force of the plural resilient members 28, at least once. As the bellows plate is pressed down within the cavity 31 of the lower cover 32, air within the pump chamber is compressed and the internal pressure becomes greater than that in the surrounding atmosphere. As a result, the first one-way valve 14 is temporarily forced open and air within the pump chamber is evacuated. As depicted, the first and second one-way valves 14, 30 each interface to the respective surrounding surface via a deformable ring of pliant material. With respect to the first one-way valve, the valve is urged into a closed position by the pliant ring. However, when the pump chamber internal pressure rises upon bellows plate depression, the valve rises with respect to the pliant ring and internal air is released.

When a user ceases applying downward pressure on the bellows plate, the resilient members 28 urge the bellows plate 16 upward. The pump chamber air pressure is thus lowered with respect to the air pressure within the container. This forces the second one-way valve 30 to move upward against the resistive force of the respective pliant ring, thereby allowing air from within the container to flow through the perorated valve cover 34 and diaphragm 35 and into the pump chamber. The user again actuates the bellows plate downward, evacuating air from the pump chamber into the atmosphere, then releases the bellows plate, thereby evacuating air form the container into the pump chamber. The process is preferably repeated until the air pressure within the pump chamber with the bellows plate fully depressed is substantially equivalent to the container internal air pressure. Under this condition, the air pressure within the container and pump chamber is significantly less than that of the surrounding atmosphere. This negative pressure draws the bellows plate 16 down against the resilient members 28, as shown in FIGS. 15A and 15B.

To enable removal of the lid assembly 10 once vacuum conditions exist within the container, a user depresses the release valve 20, against the resistive force of the respective spring 22, thereby creating a space between the sealing ring 24 and the lower cover 32, enabling atmospheric air to flow into the container and releasing the vacuum condition therein. As pressure rises in the container, the second one-way valve 30 is forced open, against the urging of the respective pliant ring, allowing pressure within the container and within the pump chamber to equalize, and allowing the bellows plate 16 to rise. This configuration enables simple and reliable vacuum release, even when a user has wet or oily fingers.

A convenient feature of the illustrated lid assembly 10 is a gently curved and depressed region 40 formed in the bellows plate 16. Depending upon the dimensions of the lid assembly, this depressed region may be sized to comfortably receive three fingertips of an average adult. The slight downward curvature helps align the downward pressure applied by the fingertips of a user towards the vertical axis, thereby enabling more efficient operation of the bellows. In combination with the plural, and preferably four, resilient members 28, the bellows plate 16 is maintained is a substantially orthogonal, or horizontal, plane with respect to the substantially vertical axis of bellows plate movement. This reduces the friction between the bellows plate and the surrounding bellows enclosure 31 that would otherwise resist bellows plate movement were there to be only one centrally disposed spring between the bellows plate and the bottom of the bellows enclosure. The depressed region can also assume other shapes that help center and align the downward force applied by a user to the bellows plate, depending upon the size of the bellows plate and other factors.

Figure 16A:
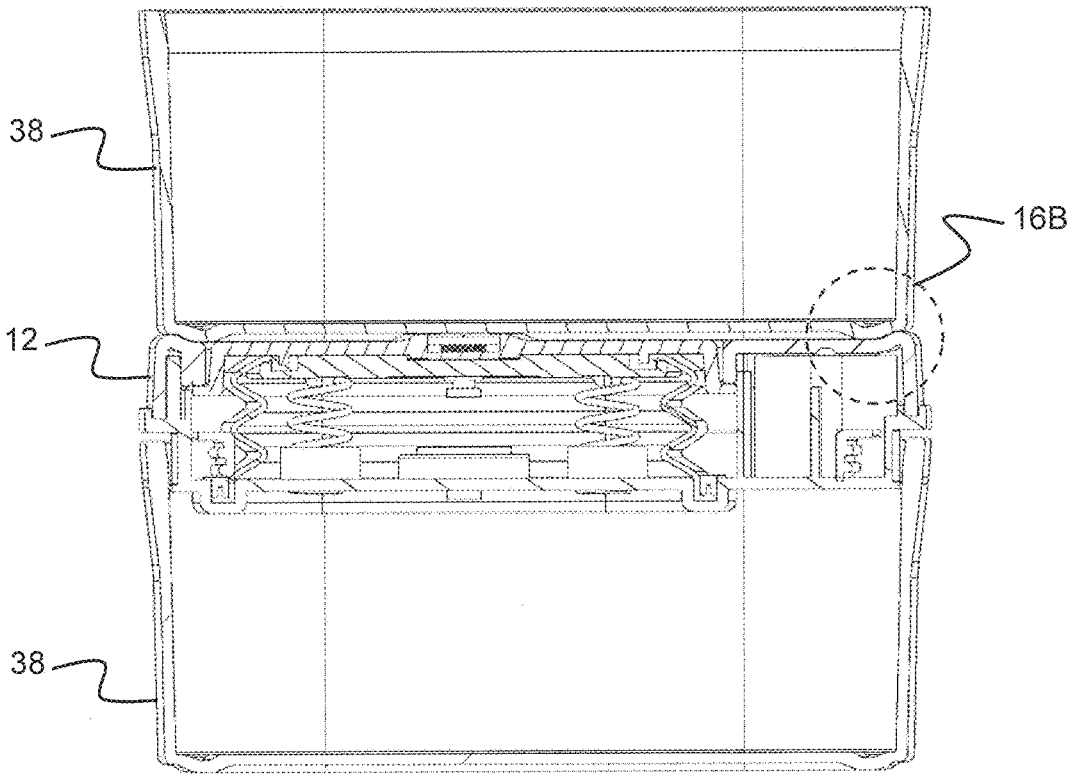
FIG. 16A is a sectional elevation view of a container disposed on top of and nesting with the bellows-equipped lid of another container, such as illustrated in the embodiment of FIGS. 1A-1G.
Figure 16B:
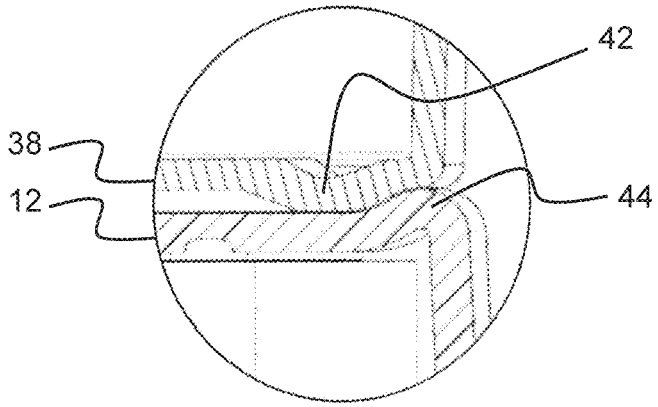
FIG. 16B is a close-up view of the portion of FIG. 16A enclosed in a dashed-line circle.

FIGS. 16A and 16B illustrate a convenient feature of the presently disclosed bellows-enabled lid and container. FIG. 16B is a close-up, cut-away view of an upper container 38 lower extent and lid upper cover 12 shown in a dashed circle in FIG. 16A. As is evident in FIG. 16B, the container lower extent is provided with a profile that compliments the upper surface of the upper cover. While various configurations may be employed, as illustrated, the container is provided with a slight downward projection or bead 42 that may be continuous around the lower edge of the respective container. This projection is received within a ridge 44 formed about the outer lateral edge of the lid cover. These complimentary features help keep vertically stacked containers in alignment and resist relative horizontal movement that could result in the toppling of one or both containers. As a further benefit, the downward projection beneath the container eliminates the presence of a continuous flat lower surface that could otherwise be prone to adhesion to a wet surface such as a kitchen counter and to the buildup of mold therebetween.

Many changes in the details, materials, and arrangement of parts and steps, herein described and illustrated, can be made by those skilled in the art in light of teachings contained hereinabove. Accordingly, it will be understood that the following claims are not to be limited to the embodiments disclosed herein and can include practices other than those specifically described, and are to be interpreted as broadly as allowed under the law.

What is claimed is:

1. A vacuum sealing lid assembly for a storage container, comprising:

an upper cover having a bellows aperture and a lower peripheral edge;

a lower cover having an upper peripheral edge configured to sealingly mate with the upper cover lower peripheral edge, the lower cover having a cavity defined by a floor surface of the lower cover and by vertically extending walls that project upwardly from the floor surface and terminating in an upper extent configured to mate with the upper cover proximate the bellows aperture;

a pump chamber within the cavity comprising:

a bellows plate disposed within the bellows aperture for substantially linear orthogonal translation relative to the upper cover and having a lower peripheral edge, a bellows having an open upper end and an open lower end, the upper end being configured to sealingly mate with the bellows plate lower peripheral edge and the lower end being configured to sealingly mate with the lower cover cavity floor surface, and a plurality of bellows resilient members extending between a lower surface of the bellows plate and the lower cover cavity floor surface;

a first one-way valve disposed in the bellows plate and configured to enable selective evacuation of air from within the pump chamber into the atmosphere external to the lid assembly as the bellows plate is manually compressed relative to the upper cover, against the urging of the bellows resilient members;

a second one-way valve disposed in the lower cover cavity floor surface and configured to enable selective evacuation of air from an area beneath the lid assembly into the pump chamber as the bellows plate is urged upward by the bellows resilient members in the absence of manual compression of the bellows plate;

a release valve disposed in a release valve cavity defined by the upper cover and the lower cover;

a release valve resilient member disposed in the release valve cavity and configured to exert on the release valve an upward force relative to the upper cover; and a sealing ring disposed on a lower extent of the release valve and configured to sealingly mate with the lower cover;

wherein the release valve is configured to enable selective introduction of air from the atmosphere into an area beneath the lid assembly as the release valve is manually compressed relative to the upper cover, against the urging of the release valve resilient member, wherein the bellows resilient members are radially displaced with respect to a vertical axis of symmetry of the bellows plate.

2. The lid assembly of claim 1, further comprising a vented cover plate disposed on an outer surface of the first one-way valve for enabling air to flow therethrough and to inhibit the introduction of particulates into the first one-way valve.

3. The lid assembly of claim 1, further comprising a perforated valve cover disposed beneath the second one-way valve, on the lower cover, the perforated valve cover having a plurality of perforations for enabling air to flow therethrough and to inhibit the introduction of particulates into the second one-way valve.

4. The lid assembly of claim 3, further comprising a waterproof diaphragm disposed intermediate the second one-way valve and the perforated valve cover, the diaphragm having a plurality of pores the porosity of which is selected to enable the flow of air therethrough but to inhibit the flow of liquids therethrough.

5. The lid assembly of claim 4, wherein the diaphragm further comprises a thickened peripheral ring, between the second one-way valve and the perforated valve cover, for enabling a secure fluid-proof seal.

6. The lid assembly of claim 1, wherein the plurality of bellows resilient members is at least three bellows resilient members.

7. The lid assembly of claim 1, wherein the bellows resilient members are compression coil springs.

8. The lid assembly of claim 1, further comprising physical features on the underside of the bellows plate and on the lower cover cavity floor surface for retaining the bellows resilient members in place during manual compression and release of manual compression of the bellows plate relative to the upper cover.

9. The lid assembly of claim 1, wherein the plurality of bellows resilient members are radially displaced with respect to the vertical axis of symmetry of the bellows plate by substantially the same distance.

10. The lid assembly of claim 1, further comprising a peripheral interface seal disposed about the outer periphery of the lower cover.

11. The lid assembly of claim 1, wherein the bellows plate further comprises a depressed region on an upper surface thereof.

12. The lid assembly of claim 11, wherein the depressed region is configured to align a downward pressure applied by a user to the depressed region towards the vertical axis of symmetry.

13. The lid assembly of claim 1, further comprising a ridge formed about an outer lateral edge of the upper cover.

14. The lid assembly of claim 13, wherein the ridge is configured to keep vertically stacked containers having a projection at least partially around a lower edge of the container in alignment and resist relative horizontal movement.

* * * * *